US006517213B1

(12) United States Patent
Fujita et al.

(10) Patent No.: US 6,517,213 B1
(45) Date of Patent: Feb. 11, 2003

(54) INDICATOR DEVICE AND ILLUMINATION DEVICE

(75) Inventors: Toshihiro Fujita, Osaka (JP); Akito Okamoto, Osaka (JP); Masaru Mamiya, Osaka (JP); Ikkan Nishihara, Osaka (JP); Shinichi Tanabe, Osaka (JP)

(73) Assignee: IDEC Izumi Corporation (JP)

( * ) Notice: Subject to any disclaimer, the term of this patent is extended or adjusted under 35 U.S.C. 154(b) by 0 days.

(21) Appl. No.: 09/194,495

(22) PCT Filed: Mar. 30, 1998

(86) PCT No.: PCT/JP98/01451

§ 371 (c)(1),
(2), (4) Date: Nov. 25, 1999

(87) PCT Pub. No.: WO98/44475

PCT Pub. Date: Oct. 8, 1998

(30) Foreign Application Priority Data

| | | |
|---|---|---|
| Mar. 31, 1997 | (JP) | 9-079764 |
| Mar. 31, 1997 | (JP) | 9-099721 |
| Mar. 3, 1998 | (JP) | 10-050506 |
| Mar. 13, 1998 | (JP) | 10-062600 |

(51) Int. Cl.[7] ..... H01J 1/62

(52) U.S. Cl. ..... 362/84; 362/29; 362/800; 362/231; 362/489; 362/34

(58) Field of Search ..... 362/84, 29, 489, 362/231, 800, 34; 40/543, 575

(56) References Cited

U.S. PATENT DOCUMENTS

| | | | | |
|---|---|---|---|---|
| 5,029,046 A | * | 7/1991 | Kameda | 362/28 |
| 5,315,491 A | * | 5/1994 | Spencer et al. | 362/84 |
| 5,477,430 A | * | 12/1995 | LaRose | 362/84 |
| 5,759,671 A | * | 6/1998 | Tanaka et al. | 428/166 |
| 5,982,092 A | * | 11/1999 | Chen | 313/512 |
| 6,068,383 A | * | 5/2000 | Robertson et al. | 362/84 |
| 6,120,160 A | * | 9/2000 | Nakagawa | 362/97 |

FOREIGN PATENT DOCUMENTS

| | | |
|---|---|---|
| JP | 50-120396 | 3/1975 |
| JP | 54-40095 | 3/1979 |
| JP | 55-118282 | 2/1980 |
| JP | 56-38878 | 8/1981 |
| JP | 57-108285 | 12/1982 |
| JP | 58-1975 | 4/1983 |
| JP | 59149178 | 10/1984 |
| JP | 62-500746 | 3/1987 |
| JP | 62137489 | 6/1987 |
| JP | 62-154488 | 9/1987 |
| JP | 63-137395 | 9/1988 |

(List continued on next page.)

OTHER PUBLICATIONS

Three (3) Japanese Office Actions issued Oct. 3, 2000 in related applications.

Japanese Office Action issued Jul. 25, 2000 in a related application.

English–language statement of relevance for each of the above–listed Japanese–language references.

*Primary Examiner*—Sandra O'Shea
*Assistant Examiner*—Anabel Ton
(74) *Attorney, Agent, or Firm*—Ostrolenk, Faber, Gerb & Soffen, LLP

(57) ABSTRACT

An indicator device is intended to make an indication by illuminating a predetermined indicating surface, and comprises a light source (12) for emitting a light (L1) of the first wavelength and a fluorescent plate (22) disposed between the light source and the indicating surface for changing at least part of the light of the first wavelength projected from the light source into a light (L2) of the second wavelength longer than the first wavelength and projecting it towards the indicating surface.

32 Claims, 62 Drawing Sheets

FOREIGN PATENT DOCUMENTS

| | | |
|---|---|---|
| JP | 64-38685 | 3/1989 |
| JP | 1-293388 | 11/1989 |
| JP | 2-158091 | 6/1990 |
| JP | 2-287491 | 11/1990 |
| JP | 3-17694 | 1/1991 |
| JP | 3-24692 | 3/1991 |
| JP | 3-98083 | 4/1991 |
| JP | 3107890 | 5/1991 |
| JP | 3-113489 | 5/1991 |
| JP | 3219283 | 9/1991 |
| JP | 4-75383 | 7/1992 |
| JP | 4-268594 | 9/1992 |
| JP | 4-368988 | 12/1992 |
| JP | 5-152609 | 6/1993 |
| JP | 5-280014 | 10/1993 |
| JP | 06-10985 | 2/1994 |
| JP | 6-82625 | 3/1994 |
| JP | 6149165 | 5/1994 |
| JP | 6-149165 | 5/1994 |
| JP | 6337647 | 12/1994 |
| JP | 7-176794 | 7/1995 |
| JP | 8-7614 | 1/1996 |
| JP | 8227278 | 9/1996 |
| JP | 9185337 | 7/1997 |

* cited by examiner-

INDICATOR DEVICE AND ILLUMINATION DEVICE

BACKGROUND OF THE INVENTION

1. Field of the Invention

The present invention relates to an indicator device, such as an industrial (especially manufacturing-industrial) indicator lamp, which guides a light from a light source to a predetermined indicating surface to make an optical indication entirely on the indicating surface, an illuminating device which guides the light from the light source to a light-projected surface to make an illumination entirely on the light-projected surface and an indicator device (LED bulb) consisting of an emitter body with light emitting diode (LED) elements mounted two-dimensionally and a dome-shaped cap member attached thereto.

2. Description of the Background Art

In order for a safe operation of an in-plant system and the like, it is necessary for an operator to always monitor the condition of machinery, facilities and the like while performing operation, control, management and handling over the machinery. For this reason, a control panel and the like in the plant are provided with an indicator lamp to indicate the condition of the system. The indicator lamp has a light-transmissible plate (inscription plate) with characters such as "ON", "OFF", "OPERATION" and "ALERT", signs, pictures and the like. When the light source behind the inscription plate is turned on according to the operating condition of the system, an optical indication is made entirely on the indicating surface, being visually recognized by the operator. The indicator lamp may be provided in a variety of forms, and among typical forms are a unit indicator lamp for indicating a single information, a collective indicator lamp for indicating plural pieces of information and an illuminated push-button switch with indicator lamp having an additional function of operating the system, such as operation/stop.

In short, the indicator lamp is a device provided on a panel surface of the control panel to inform the operator of the system condition, and assumes a dominant position in a man-machine interface for a safe operation of the system by the operator.

Anyway, there is a request for color-coded representation in such an indicator lamp. Since a control panel and the like usually has a plurality of indicator lamps, if color-coding depending on purposes is made and information (characters, signs, signs and pictures) with coded colors is given, instead of information being monochromatically presented, the viewability of the indicator lamp can be improved.

In the today's light source available for the indicator lamp, however, the kind of colors of light emitted therefrom is limited and therefore there is a limit of color-coded representation.

Further, it is necessary to prevent the shape of an emitter in the light source (dots of an LED element and filament or bulb of an incandescent bulb) from being externally recognized so that the operator can easily recognize indication such as characters (what are represented by the characters).

Furthermore, a halogen lamp may be used as the light source to achieve a pure-white indicator lamp, but this causes a problem of short lifetime of the light source due to a great amount of heating values, so that it can not be applied to actual use as of today.

If the color of the indicator lamp in an on state (the color of indication light) and the color in an off state (its appearance color) are different, there arises a problem that the color of the indicator lamp in the on state can not be known from the color in the off state. If the color of the indicator lamp in the on state can not be known, especially in a case where a plurality of indicator lamps having plural kinds of colors different from one another are provided in the control panel and the like, it is not easy to recognize what color an indicator lamp in the off state will have in the on state and that makes it difficult to intuitively recognize what the indicator lamp informs with color information.

Though an indication color obtained by transmitting a light from the light source using an incandescent bulb through a milky-white plate has been conventionally called "white" in this art, the color temperature of the incandescent bulb can not be considered white, being much different from pure white obtained by the light source using a unit of red, green and blue LED elements or the halogen lamp, and the above request is not satisfied.

SUMMARY OF THE INVENTION

Objects of The Invention

The present invention is intended to solve the above problems in the prior-art indicator device and an object of the present invention is to provide an indicator device capable of making an optical indication with any colors.

Another object of the present invention is to provide an indicator device which allows high-order achievement in both highly-intensified indication and high diffusibility of light.

A further object of the present invention is to provide an indicator device and an illuminating device capable of eliminating variation in the amount of light on an indicating surface or a light-projected surface.

An yet object of the present invention is to provide an indicator device which achieves any-color indication light from a light emitted by a single-color light source and allows the color of the indicating surface in an on state of the light source (indication light) to be easily recognized from the color of the indicating surface in an off state of the light source with higher productivity and lower cost.

Still another object of the present invention is to provide an indicator device (LED bulb) capable of emitting a light of white or other delicate color which is difficult to emit with a single LED element.

Constitution and Action of The Invention

According to the present invention, an indicator device which makes an indication by illuminating a predetermined indicating surface comprises: a light source for emitting a light of a first wavelength; and a fluorescent plate provided between the light source and the indicating surface, for changing at least part of the light of the first wavelength projected thereto from the light source into a light (L2) of a second wavelength longer than the first wavelength and projecting the light of the second wavelength towards the indicating surface.

In the present invention, since the fluorescent plate provided between the light source and the indicating surface changes at least part of the light of the first wavelength projected thereto from the light source into the light of the second wavelength longer than the first wavelength and projects it towards the indicating surface, the color of the light of the second wavelength and the ratio of the light of the second wavelength projected from the fluorescent plate and the light of the first wavelength through the fluorescent plate can be easily changed only by changing the kind of the fluorescent plate to be used, and as a result indication lights of various colors for illuminating the indicating surface can be easily obtained from the single light of the first wavelength. Therefore, since the light source has only to be provided with one kind of light source for emitting the light of the first wavelength, it is possible to ensure higher productivity and lower cost as compared with, for example, a case of changing combination of kinds of the LED elements to be used according to the color of the indication light.

According to the present invention, the indicator device further comprises: a filter provided between the fluorescent plate and the indicating surface, for transmitting at least part of the light projected from the fluorescent plate towards the indicating surface, and in the indicator device, a color of a light through the filter to illuminating the indicating surface in an on state of the light source and an appearance color of the filter which substantially defines a color of the indicating surface in an off state of the light source are substantially identical or similar to each other.

In the present invention, since the light through the filter to illuminate the indicating surface when the light source is on and the appearance color of the filter which defines the color of the indicating surface when the light source is off are substantially identical of similar to each other, the color of the indicating surface in the on state of the light source (in other words, the color of the indication light which makes a lighting of the indicating surface) can be intuitively recognized with ease from the color of the indicating surface in the off state of the light source, and what the surface-illuminated indicator device indicates can be intuitively understood with ease from the color of the indicating surface in the off state.

Further, providing the filter allows only the desired color component (wavelength component) to be extracted among the components of the light emitted from the fluorescent plate, and the color of the light from the fluorescent plate can be thereby changed or corrected easily. As a result, indication lights of various colors can be easily obtained by changing combination of the fluorescent plate and the filter.

According to the present invention, in the indicator device, the fluorescent plate and the filter are united as a wavelength changing member comprising a fluorescent layer having a function of the fluorescent plate and a filter layer having a function of the filter.

In the present invention, since the fluorescent plate and the filter are united as a wavelength changing member comprising the fluorescent layer and the filter layer, the number of parts can be reduced and it is thereby possible to ensure simplification of fabrication process and lower cost.

One indicator device according to the present invention is a surface-illuminated indicator device for making an indication by illuminating a predetermined indicating surface, and the device comprises (a) a light source having a first emitter for emitting the light of the first wavelength and a second emitter for emitting a light of another wavelength different from the first wavelength; and (b) a fluorescent plate having a light-incident surface receiving the light from the light source and a light-outgoing surface facing the indicating surface, for changing part of the light of the first wavelength into the light of the second wavelength longer than the first wavelength.

The above indicator device has a characteristic feature that the color of the light projected from the light-outgoing surface is changeable by changing the emitting condition of the first and second emitters.

As the fluorescent plate, a plate substantially transmitting the light of another wavelength may be used.

On the other hand, another indicator device according the present invention is a surface-illuminated indicator device for making an indication by illuminating a predetermined indicating surface, and the device comprises (a) a light source having a first emitter for emitting the light of the first wavelength and a second emitter for emitting a light of another wavelength different from the first wavelength; and (b) a fluorescent body (wavelength changing member) consisting of a plurality of layered fluorescent plates each having a light-incident surface receiving the light from the light source and a light-outgoing surface facing the indicating surface, for changing part of the light of the first wavelength into a plurality of lights of wavelengths longer than the first wavelength.

The above indicator device has a characteristic feature that the color of the light projected from the light-outgoing surface is changeable by changing the emitting condition of the first and second emitters.

Also in this constitution, as the fluorescent plate, a plate substantially transmitting the light of another wavelength may be used.

In one and another indicator devices according to the present invention, it is preferable to further provide a light diffusion member for diffusing the light on an optical path of the light going from the light source towards the indicating surface, and a hologram diffusion plate may be used as the light diffusion member.

Instead of providing the hologram diffusion plate, a light diffusion material may be mixed into the fluorescent plate.

As an especially-characteristic application of the present invention, the first emitter is a semiconductor light-emitting element which emits a blue light as the light of the first wavelength and the fluorescent plate has the fluorescent characteristics of absorbing part of the blue light emitted from the semiconductor light-emitting element to emit a yellow light as the light of the second wavelength, and it is possible to obtain a substantially white light for the optical indication when only the first emitter is turned on.

A light of a first chromatic color can be projected from the light-outgoing surface when only the first emitter among the light source is turned on, a light of a second chromatic color can be projected from the light-outgoing surface when only the second emitter among the light source is turned on, and a light of a third chromatic color obtained by additive color mixing of the light of the first chromatic color and the light of the second chromatic color can be projected from the light-outgoing surface when both the first and second emitters are turned on.

Further, providing a luminance changing unit for changing luminances of the first and second emitters depending on whether either the first or second emitter is turned on or both the first and second emitters are turned on prevents large variation in luminance of the indication light caused by switching operation of the emitting condition.

According to the present invention, in the indicator device, the light source has the first emitter for emitting the light of the first wavelength and the second emitter for emitting the light of another wavelength different from the first wavelength, and the color of the light projected from the fluorescent plate is changeable by projecting the lights emitted from the first and second emitters into the fluorescent plate and changing the emitting condition of the first and second emitters.

These and other objects, features, aspects and advantages of the present invention will become more apparent from the following detailed description of the present invention when taken in conjunction with the accompanying drawings.

DESCRIPTION OF THE PREFERRED EMBODIMENTS

The First Preferred Embodiment

Figure 1:
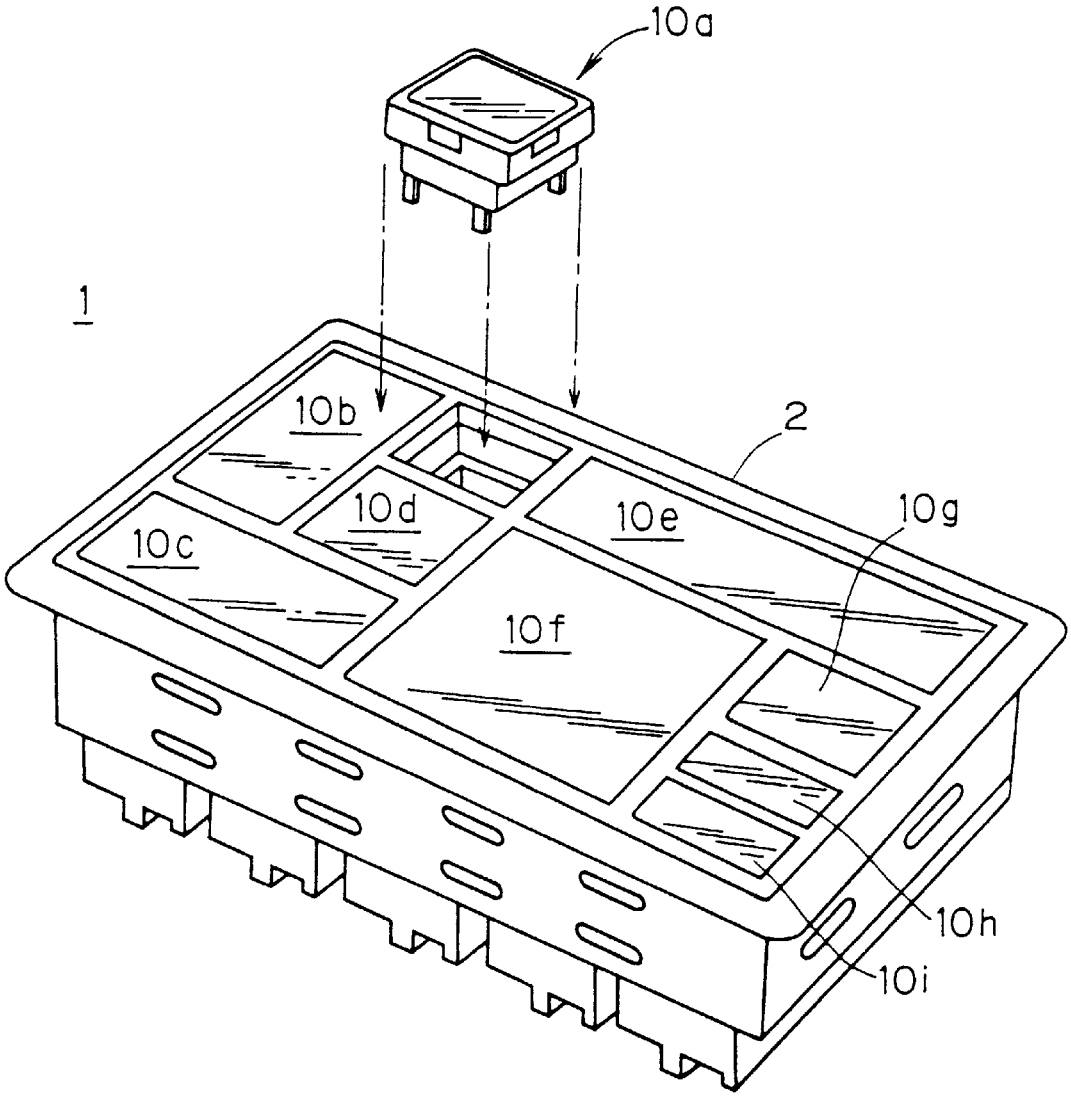
FIG. 1 is a perspective view showing a collective indicator lamp to which a first preferred embodiment of an indicator device in accordance with the present invention is applied.

FIG. 1 is a perspective view showing a collective indicator lamp to which the first preferred embodiment of an indicator device (surface-illuminated indicator device) in accordance with the present invention is applied. Though the collective indicator lamp 1 is placed with the upside of FIG. 1 facing an operator as an indicating surface side when it is actually used, this figure shows it with the indicating surface side facing upward for convenience of illustration.

The collective indicator lamp 1 is constituted of a plurality of unit indicator lamps 10*a*, 10*b*, . . . , 10*i* assembled in a housing 2. The unit indicator lamps 10*a*, 10*b*, . . . , 10*i* have different sizes and indication colors but have the same basic structure. Each of the unit indicator lamps 10*a*, 10*b*, . . . , 10*i* corresponds to the first preferred embodiment of the surface-illuminated indicator device in accordance with the present invention. Hereinafter, the unit indicator lamp 10*a* will be taken for discussion on its structure, and discussion on the structures of other ones will be omitted.

Figure 2:
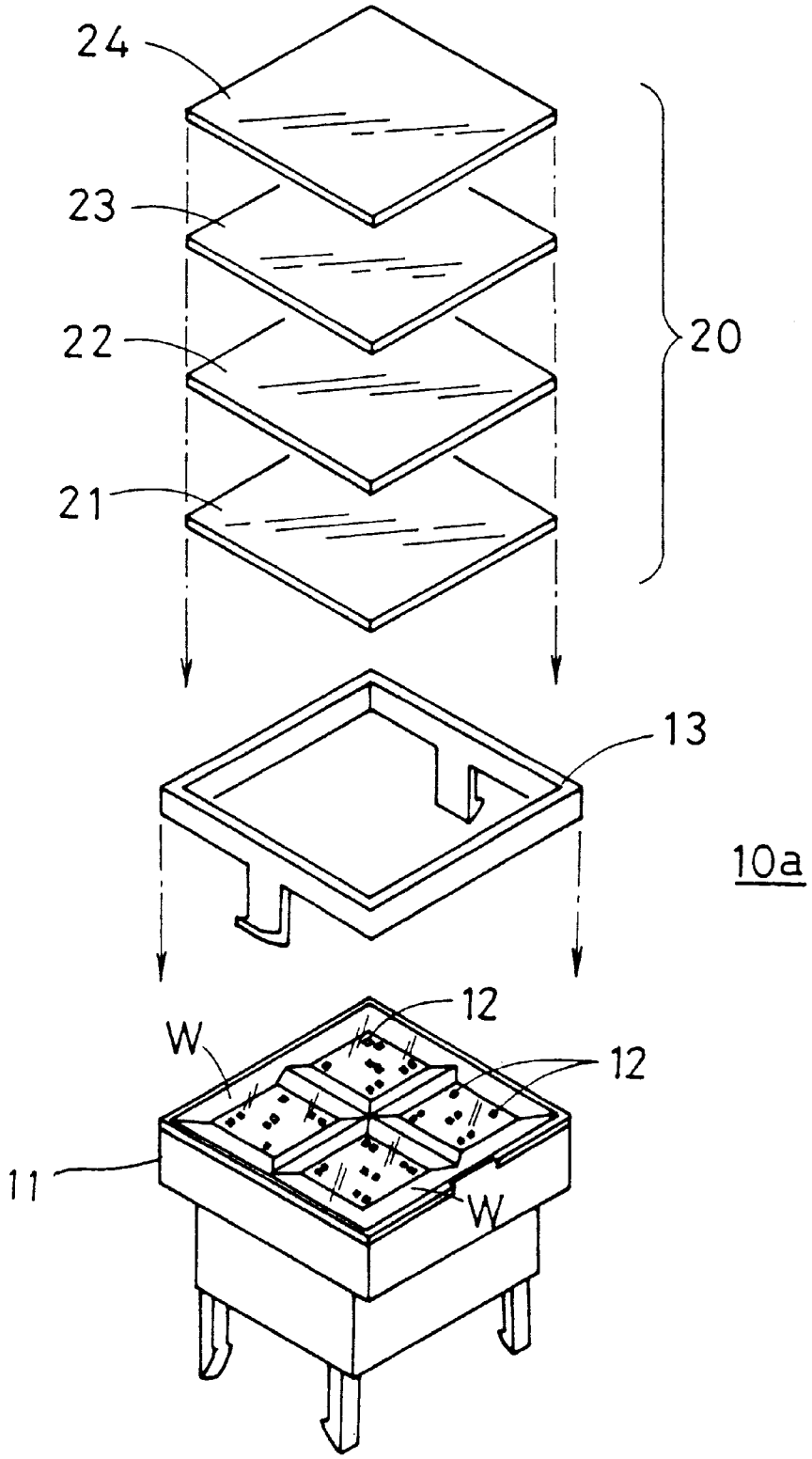
FIG. 2 is an exploded perspective view showing a unit indicator lamp which is a constituent of the collective indicator lamp of FIG. 1.
Figure 3:
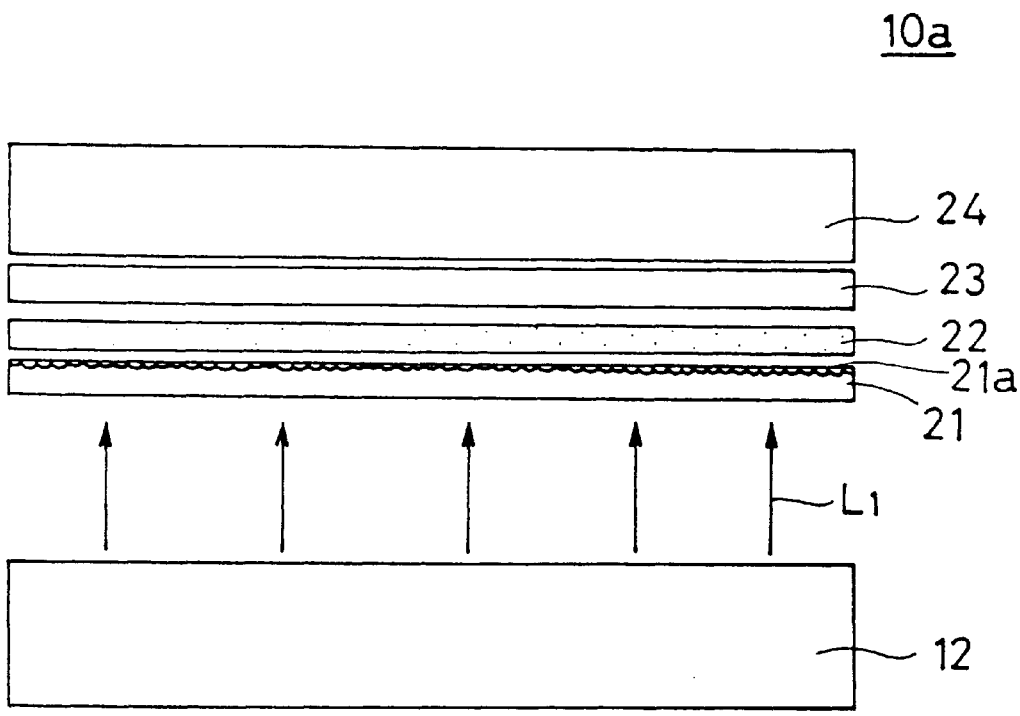
FIG. 3 is a schematic cross section of the unit indicator lamp of FIG. 2.

FIG. 2 is an exploded perspective view of the unit indicator lamp 10*a*. FIG. 3 is a schematic cross section of the unit indicator lamp 10*a* of FIG. 2. In the unit indicator lamp 10*a*, a plurality of light sources (LED elements) 12 are arranged in a matrix inside a resin case 11 having a window W. Each light source 12 is mounted on a major surface of a print board and accommodated in the case 11. Its light-emitting part is exposed, facing upward in the case 11. An LED element which is a constituent of the light source 12 emits a light of a wavelength (the first wavelength) allocated to the unit indicator lamp 10*a*.

On the other hand, a frame 13 is placed on the periphery of an upper surface of the window W. The frame 13 is fit into the housing 2 of FIG. 1 with the case 11 therebetween. A compound plate 20 is fit into the frame 13. The compound plate 20 has a layered structure consisting of four plates;

① a diffusion plate 21 having a hologram surface 21*a*,

② a fluorescent plate 22,

③ an inscription plate 23 made of a transparent resin, and

④ a cover plate 24 made of a transparent resin.

On the inscription plate 23, characters and signs to be represented are inscribed.

Figure 4:
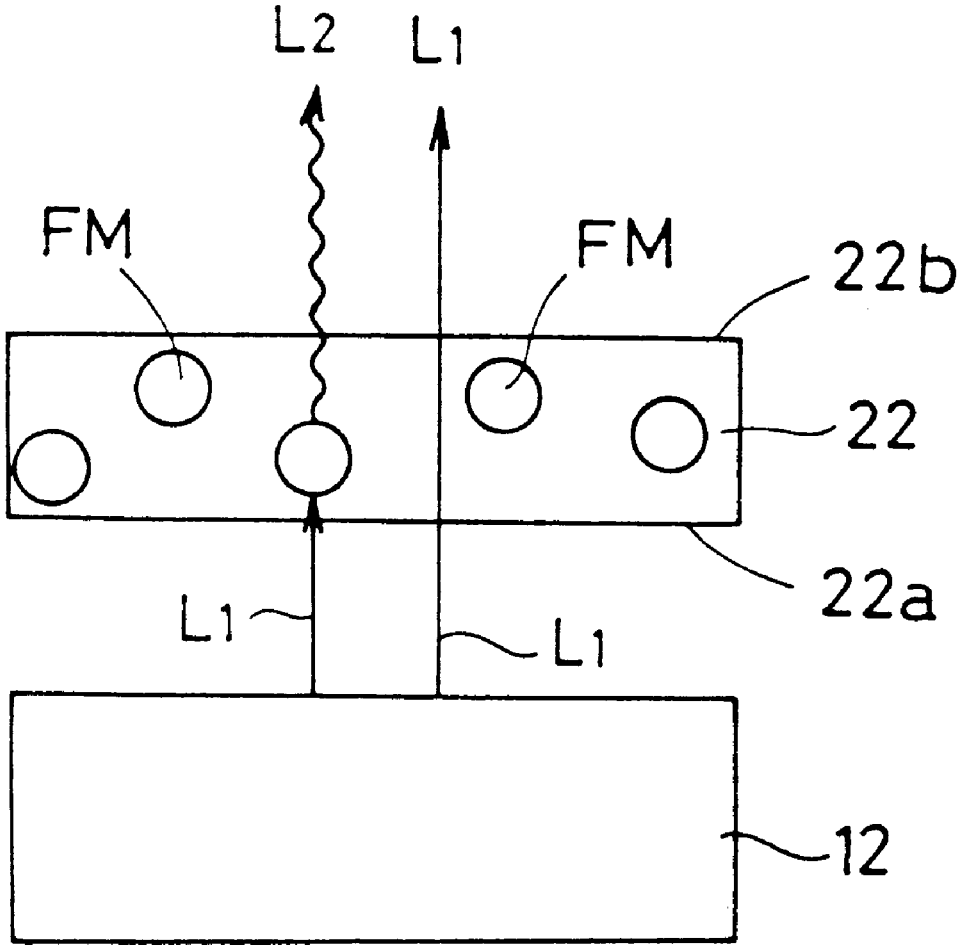
FIG. 4 is a schematic diagram showing optical characteristics of a fluorescent plate of the unit indicator lamp of FIG. 2.

Among them, the fluorescent plate 22 is provided in accordance with a main characteristic feature of the present invention. The fluorescent plate 22 receives the light of the first wavelength from the light source 12 and transmits part of the incident light towards the indicating surface (the upper side of this figure), and it emits a light of the second wavelength longer than the first wavelength from the rest of the incident light towards the indicating surface. FIG. 4 schematically shows this optical phenomenon.

FIG. 4 is a schematic diagram showing optical characteristics of the fluorescent plate 22. The fluorescent plate 22 is obtained by mixing a fluorescent material (color changing coating) having fluorescent characteristics discussed later into a transparent resin material and forming the mixture in a sheet, a plate or the like. The reference sign FM of this figure shows the fluorescent material. The fluorescent material FM has the fluorescent characteristics of emitting the light L2 of the second wavelength (indicated by the wavy line of this figure) longer than the first wavelength when it returns to the ground state after it is excited by the light L1 of the first wavelength indicated by the solid line of this figure. The fluorescent characteristics will be discussed, taking a specific example in the exemplary experiment after the sixth preferred embodiment.

In the fluorescent plate 22 having such fluorescent characteristics as a whole, when the light L1 of the first wavelength from the light source 12 enters a light-incident surface 22*a* through the hologram diffusion plate 21, part of the incident light L1 goes out towards the indicating surface from a light-outgoing surface 22*b* as shown in this figure while the rest of the light L1 is absorbed in the fluorescent material FM and the light (fluorescence) L2 of the second wavelength longer than the first wavelength is emitted from the light-outgoing surface 22*b*.

Referring back to FIG. 2, the lights of the first and second wavelengths projected from said fluorescent plate 22 is guided through the inscription plate 23 and the cover plate 24 towards the indicating surface, where an optical indication is thereby made.

In the indicator lamp (surface-illuminated indicator device) 10*a* of this preferred embodiment, the color of light for optical indication (indication color) on the indicating surface side is defined by combination of the lights of the first and second wavelengths, in other words, combination of kinds of the light source 12 and the fluorescent plate 22, and therefore the optical indication can be made with any color by controlling this combination. This combination of the light source 12 and the fluorescent plate 22 will be discussed in the exemplary experiment after the sixth preferred embodiment, taking combination examples.

As shown in FIG. 4, the light-incident surface 22*a* and the light-outgoing surface 22*b* of the fluorescent plate 22 are opposed to each other and the fluorescent plate 22 is placed so that its light-incident surface 22*a* may face the light source 12. That produces the following effects.

In a case, as a comparison example, where the light from the light source is directly guided through the inscription plate towards the indicating surface to make an optical indication, an operator who makes an observation from the indicating surface side feels a light-emitting surface recessed. By contrast, in a case where the fluorescent plate 22 is interposed, since the fluorescent plate 22 emits the light of the second wavelength, the light of the second wavelength allows the operator to feel the light-emitting surface going up near the indicating surface and have better viewability than that of the comparison example.

Further, in this preferred embodiment, the hologram diffusion plate 21 is provided to diffuse the light from the light source 12 at a predetermined diffusion angle and thereafter project the diffused light to the fluorescent plate 22. This hologram diffusion plate 21 is provided with the diffusion surface (hologram surface) 21*a* utilizing light diffraction phenomenon on one-side surface of the transparent material, which can diffuse a light without attenuating it. With this, the unit indicator lamp 10*a* can prevent the shape of the light source 12 from being externally recognized without providing an element for substantially absorbing or attenuating a light, such as a milky-white inscription plate. In short, this preferred embodiment can achieve both "highly-intensified indication" and "high diffusibility of light" at the same time.

As mentioned above, one of the colors conventionally requested most as the indication color is "pure white". In this respect, the indicator lamp 10*a* of this preferred embodiment has only to use an LED element emitting a blue light as the light source 12 and the fluorescent plate 22 having fluorescence characteristics of emitting a yellow light (the light of the second wavelength) from part of the blue light (the light of the first wavelength) emitted from the light source 12.

In this case, it is not necessary to use a package of LED elements emitting red, green and blue lights, for example, as the light source and an LED element emitting a single-color light can be used as the light source. That makes it possible to provide a white indicator lamp (surface-illuminated indicator device) at lower cost. Further, since the light source 12 needs less amount of heating values, it is possible to ensure longer lifetime of the indicator lamp without any problem on heating of the light source that would arise when the halogen lamp is used as the light source.

Furthermore, since the optical indication with white light can be made, providing a filter which transmits only a specified wavelength component in an appropriate position (e.g., a surface of the inscription plate 23) on a side of the light-outgoing surface 22*b* of the fluorescent plate 22 (FIG. 4) allows the indication color of the indicator lamp 10*a* to be changed into any color corresponding to the filter. In other words, the indicator lamp 10*a* comprising the light source 12 with blue LED element and the fluorescent plate 22 having fluorescence characteristics of emitting the yellow light from part of the blue light from the light source 12 can change the light for optical indication from white to a color defined substantially by the filter when additionally provided with a filter near the light-outgoing surface 22*b* of the fluorescent plate 22. Therefore, by appropriately changing the filter, the indication color of the indicator lamp 10*a* can be changed into any color.

The Second Preferred Embodiment

Figure 5:
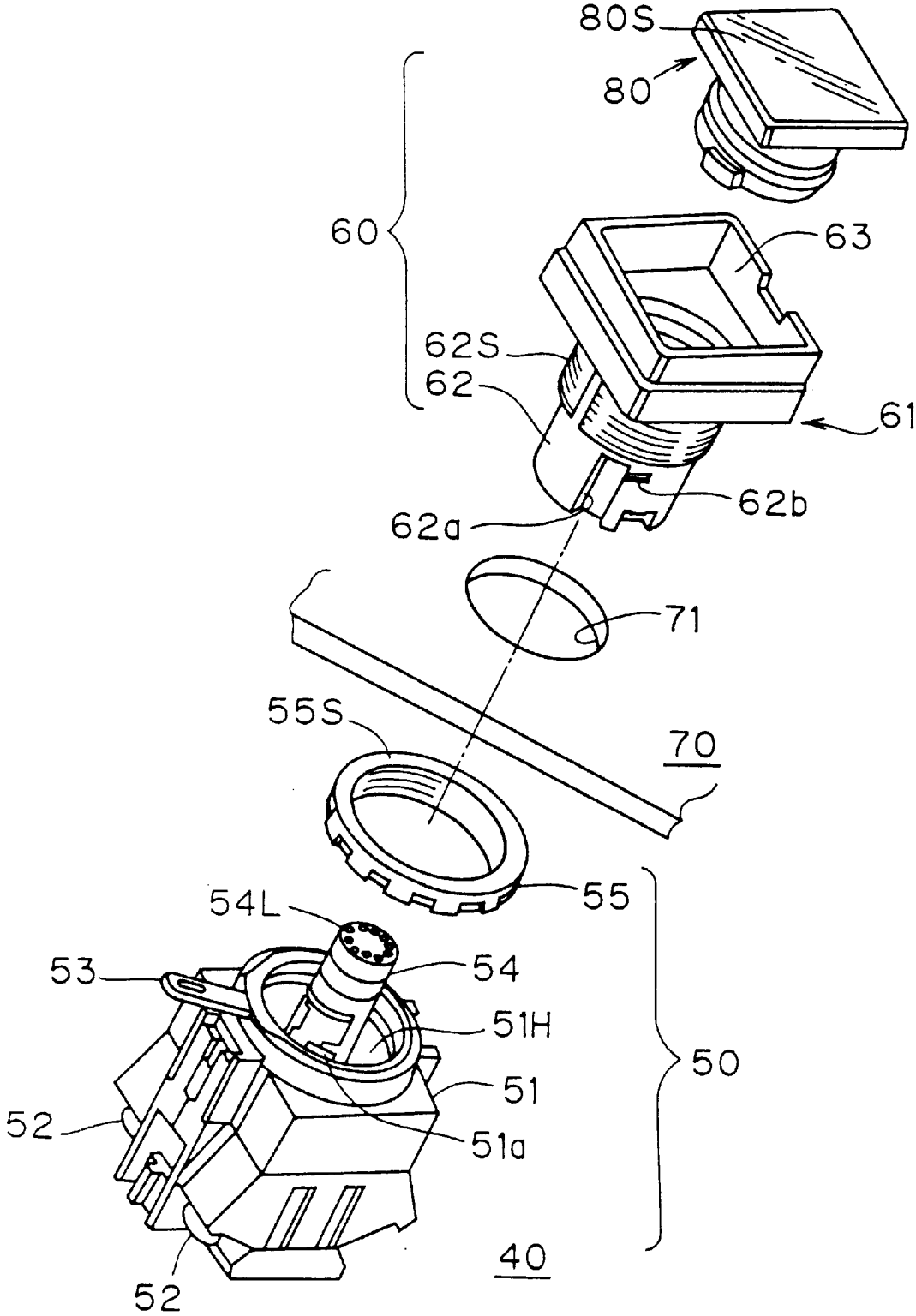
FIG. 5 is a perspective view showing an illuminated push-button switch to which a second preferred embodiment of the indicator device in accordance with the present invention is applied.
Figure 6:
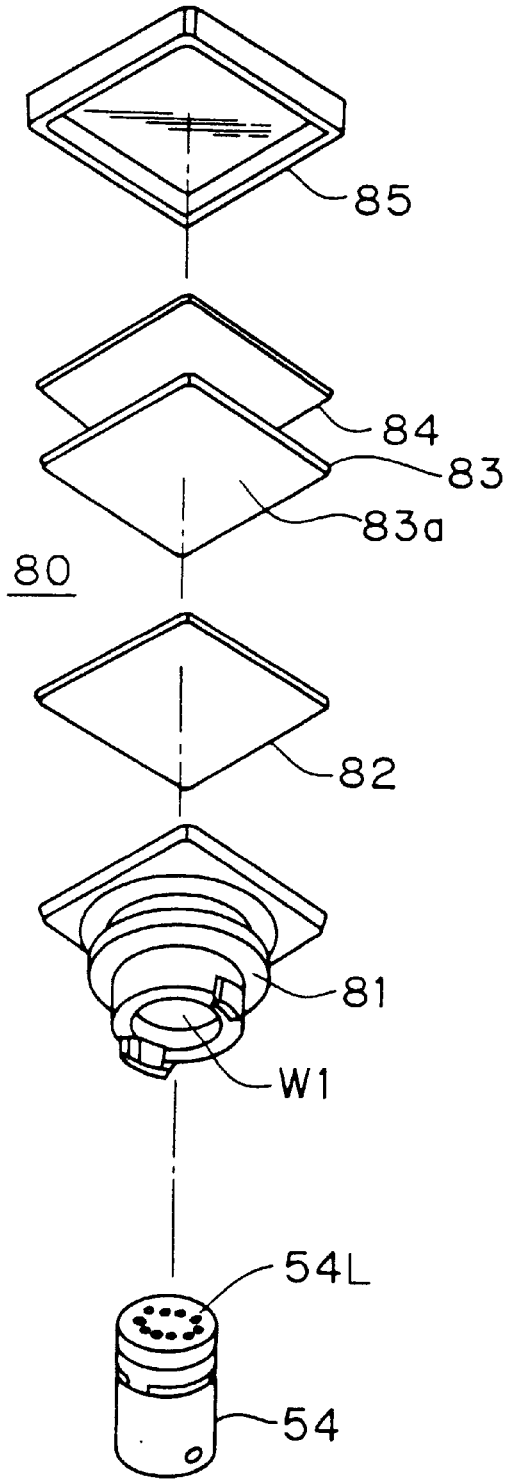
FIG. 6 is a partly-exploded perspective view of FIG. 5.

FIG. 5 is a perspective view showing an illuminated push-button switch to which the second preferred embodiment of the indicator device (surface-illuminated indicator device) in accordance with the present invention is applied. FIG. 6 is a partly-exploded perspective view of FIG. 5. FIG. 5 shows a case where an illuminated push-button switch 40 is attached to a panel 70 such as a control panel. The illuminated push-button switch 40 is of separate type, broadly consisting of an operation unit 60 and a contact unit 50. The operation unit 60 is inserted into a mounting hole 71 from the front side (operation side) of the panel 70. The contact unit 50 is connected to a waist portion 62 of the operation unit 60 on the rear side of the panel 70.

The contact unit 50 internally has a switch contact, to which an LED unit light source4 54 is attached. The LED unit light source 54 is of substantially cylindrical-shaped and on its top portion arranged are a plurality of LED elements 54L. A ring 55 used for attaching the operation unit 60 to the panel 70 and a lock lever 53 used for fixing connection between the operation unit 60 and the contact unit 50 are separately provided. The contact unit 50 is electrically connected to a required apparatus through a terminal 52.

On the other hand, the operation unit 60 consists of an operation unit body 61 and a push unit 80. On the waist portion 62 of the operation unit body 61, an insert groove 62*a* is provided so that a ledge 51*a* formed in an inner wall of the mounting hole 51H can be fit therein. Fitting the ledge 51*a* into the insert groove 62*a*, the waist portion 62 of the operation unit 60 is inserted into the mounting hole 51H of the contact unit 50.

When the insertion is completed and the lock lever 53 is rotated, a projection (not shown) of the lock lever 53 disposed inside the ledge 51*a* rotates and the projection is thereby fitted into a fixing groove 62*b* provided orthogonally to the inserting groove 62*a* to connect and fix the operation unit 60 and the contact unit 50. Further, an external thread 62S is formed on the waist portion 62 and is in threaded engagement with an internal thread surface 55*s* of the ring 55 to mount the operation unit body 61 on the panel 70.

A rectangular receptacle 63 is formed in an upper portion of the operation unit body 61, into which the push unit 80 is accommodated. Though the push unit 80 will be discussed later in detail, when the push unit 80 is pushed down by hand after assembling, the push unit 80 open or close (on or off) a contact in the contact unit 50. The LED unit light source 54 is turned on or off in response to opening or closing of the contact. Alternately, as another constitution, the LED unit light source 54 may be turned on or off in response to a signal from an external apparatus (a controller or the like) connected to the illuminated push-button switch 40.

An operation surface 80S of the push unit 80 is light-transmissible, and the characters and the like inside the operation surface 80*s* is illuminated by a light from the LED unit light source 54, thereby being externally recognized.

FIG. 6 shows the explored push unit 80. In this figure, a lower portion of the push unit 80 is a hollow base 81 having a transmission hole W1 and on this base layered are three plated in the following order;

① a hologram diffusion plate 82,

② a fluorescent plate 83 having the same fluorescence characteristics as the fluorescent plate 22 of the first preferred embodiment, and ③ an achromatic and transparent inscription plate 84 made of resin such as acrylic resin.

An achromatic and transparent front plate 85 made of e.g., acrylic resin is provided as a member defining the operation surface 80S of FIG. 5. Required characters and the like are inscribed on the inscription plate 84.

The LED unit light source 54 is so inserted as to be opposed to the diffusion plate 82 with the transmission hole W1 interposed therebetween. When the LED unit light source 54 is on, the light of the first wavelength from the LED elements 54L enters the light-incident surface 83*a* of the fluorescent plate 83 through the hologram diffusion plate 82. Part of the incident light goes on towards the indicating surface (upper side of this figure) while the rest of the incident light is changed in wavelength into the light of the second wavelength longer than the first wavelength by the fluorescent material (not shown) of the fluorescent plate 83. As a result, the lights of the first and second wavelengths are projected from the light-outgoing surface. The outgoing light of the first and second wavelengths goes through the inscription plate 84 and the front plate 85 in this order to make a surface-illuminated indication with the indication color defined by the first and second wavelengths on the indicating surface side.

Thus, in the second preferred embodiment, like the first preferred embodiment, since the color of the light for optical indication on the indicating surface side is defined by combination of the first and second wavelengths, in other words, combination of the kinds of the LED unit light source 54 and the fluorescent plate 83, it is possible to make an optical indication with any color by controlling the combination.

As shown in FIG. 6, since the light-incident surface 83*a* and the light-outgoing surface of the fluorescent plate 83 are opposed to each other and the fluorescent plate 83 is disposed so that the light-incident surface 83*a* may face the LED unit light source 54, it is possible to produce a visual effect as if the light-emitting surface might go up towards the indicating surface for the operator and thereby improve the viewability.

Moreover, providing the hologram diffusion plate 82 allows achievement of "highly-intensified indication" and "high diffusibility of light" at the same time, like the first preferred embodiment.

Further, using a blue LED element as the LED element 54L and a fluorescent plate having fluorescence characteristics of emitting a yellow light from part of the blue light emitted from the LED unit light source 54 as the fluorescent plate 83 allows the indication color of the indicator lamp in the illuminated push-button switch to be set white with less amount of heating values, like the first preferred embodiment.

Furthermore, in the illuminated push-button switch capable of making a white optical indication, by additionally providing a filter near the light-outgoing surfer of the fluorescent plate 83, it is possible to change the color of the light for optical indication from white to a color substantially defined by the filter. Therefore, the indication color of the indicator lamp in the illuminated push-button switch can be changed to any color by appropriately changing the filter.

The Third Preferred Embodiment

Figure 7:
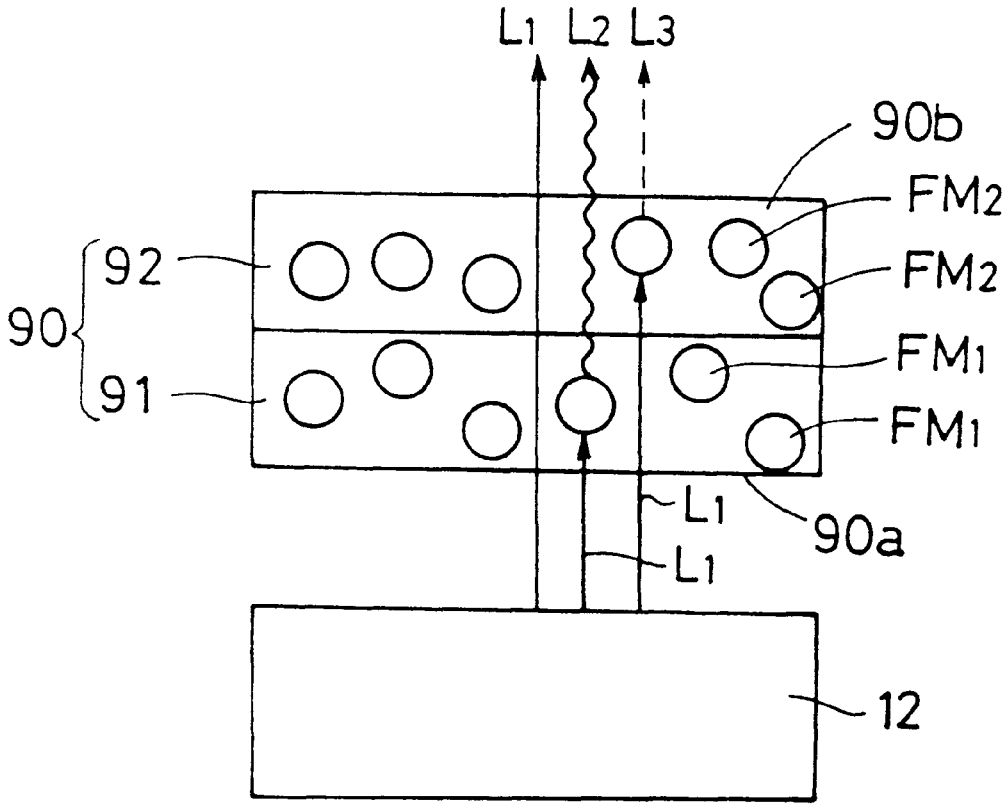
FIG. 7 is a schematic cross section showing a third preferred embodiment of the indicator device in accordance with the present invention.

FIG. 7 is a schematic cross section showing the third preferred embodiment of the indicator device (surface-illuminated indicator device) in accordance with the present invention. The surface-illuminated indicator device of this preferred embodiment is largely different from the first preferred embodiment of FIG. 4 in that a fluorescent body (wavelength changing member) consisting of two layered fluorescent plates 91 and 92 is provided to emit not only the light of the second wavelength but also a light of the third wavelength, instead of the single fluorescent plate 22 provided to emit the light of the second wavelength in the first preferred embodiment. Other basic constitution of the third preferred embodiment is the same as that of the first preferred embodiment.

The fluorescent body 90 consists of the following two layered plates;

① the fluorescent plate 91 which transmits part of the light L1 of the first wavelength towards the light-outgoing surface (upper side of this figure) and emits the light L2 of the second wavelength longer than the first wavelength from the rest of the incident light L1 towards the light-outgoing surface, and ② the fluorescent plate 92 which transmits part of the light L1 and the whole light L2 towards the light-outgoing surface (upper side of this figure) and emits a light L3 of the third wavelength longer than the first wavelength from the rest of the light L1 towards the light-outgoing surface.

With this constitution, when the light L1 of the first wavelength from the light source 12 is given to a light-incident surface 90*a* of the fluorescent body 90, the fluorescent plate 91 first transmits part of the light L1 of the first wavelength towards the fluorescent plate 92, and fluorescent materials FM1 absorb the rest of the incident light L1 and each emit the light L2 of the second wavelength longer than the first wavelength towards the fluorescent plate 92. The fluorescent plate 92, receiving the lights L1 and L2 of the first and second wavelengths, projects part of the light L1 of the first wavelength and the whole light L2 of the second wavelength from a light-outgoing surface 90*b* of the fluorescent body 90 towards the indicating surface (upper side of this figure), and fluorescent materials FM2 absorb the rest of the light L1 of the first wavelength and each emit the light L3 of the third wavelength longer than the first wavelength to be projected from the light-outgoing surface 90*b* towards the indicating surface. Thus, the lights L1 to L3 of the first to third wavelengths make an optical indication entirely on the indicating surface.

Further, the fluorescent materials FM2 absorb part of the light L2 of the second wavelength and emit a light of the fourth wavelength (not shown) longer than the second wavelength to be projected from the light-outgoing surface 90*b* towards the indicating surface.

Thus, in the third preferred embodiment, since the indication color on the indicating surface is defined by the lights L1 to L3 of the first to third wavelengths and the like, the indication color can be controlled more finely as compared with the first preferred embodiment where the indication color is defined by the lights L1 and L2 of two wavelengths.

Furthermore, also in the third preferred embodiment, since the light-incident surface 90*a* and the light-outgoing surface 90*b* of the fluorescent body 90 are opposed to each other and the fluorescent body 90 is disposed so that the light-incident surface 90*a* may face the LED unit light source 12, it is possible to produce a visual effect as if the light-emitting surface might go up towards the indicating surface for the operator and thereby improve the viewability, like the first and second preferred embodiments.

Though the two fluorescent plates are layered to constitute the fluorescent body 90, more than two fluorescent plates may be layered to constitute the fluorescent body 90. Further, the fluorescent plates may be layered in any order.

The Fourth Preferred Embodiment

In the first to third preferred embodiments, the fluorescent plates 22, 83, 91 and 92 are obtained by mixing the fluorescent material FM into a transparent resin material and forming the mixture in a sheet, plate or the like. In this case, most of the fluorescence created in the fluorescent plates (light created in each of the fluorescent plates 22, 83, 91 and 92) goes inside the fluorescent plate, being guided to an end surface, and is released in density according to the law of total reflection. For this reason, the fluorescence projected from the light-outgoing surface towards the indicating surface tends to decrease in its amount. In this respect, by mixing the diffusion material besides the fluorescent material FM into the fluorescent plate, the fluorescence can be diffused inside the fluorescent plate and projected towards the indicating surface without being concentrated in the end surface.

The Fifth Preferred Embodiment

Figure 8:
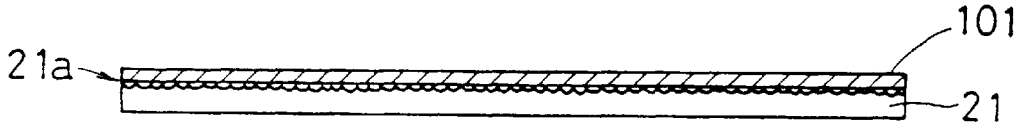
FIG. 8 is a schematic cross section showing a structure of a fluorescent plate of a fifth preferred embodiment of the indicator device in accordance with the present invention.

In a case where the diffusion material is mixed into the fluorescent plate as shown in the fourth preferred embodiment, the light diffusion material absorbs the light to cause a loss which is an obstacle to highly-intensified indication. Then, as shown in FIG. 8, the other surface of the hologram diffusion plate 21 (the surface provided with the hologram surface 21*a*) is thinly coated with the fluorescent material FM and the coating film is used as a fluorescent plate 101. The fluorescent plate 101 thus obtained can efficiently project the fluorescence created inside the fluorescent plate 101 towards the indicating surface, without mixing the diffusion material therein.

Figure 9:
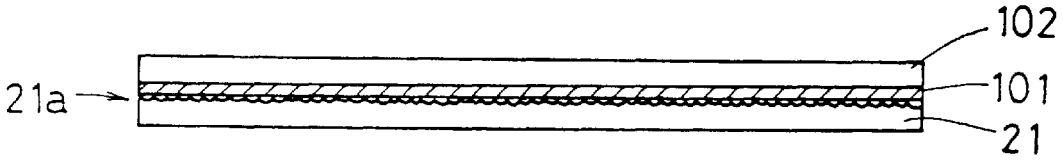
FIG. 9 is a schematic cross section showing an exemplary improvement of the indicator device of FIG. 8.

To protect the filmlike fluorescent plate 101 thus obtained, there may be another constitution where a transparent plate 102 is placed on the fluorescent plate 101 as shown in FIG. 9 and the transparent plate 102 and the hologram diffusion plate 21 sandwich the fluorescent plate 101.

The Sixth Preferred Embodiment

Figure 10:
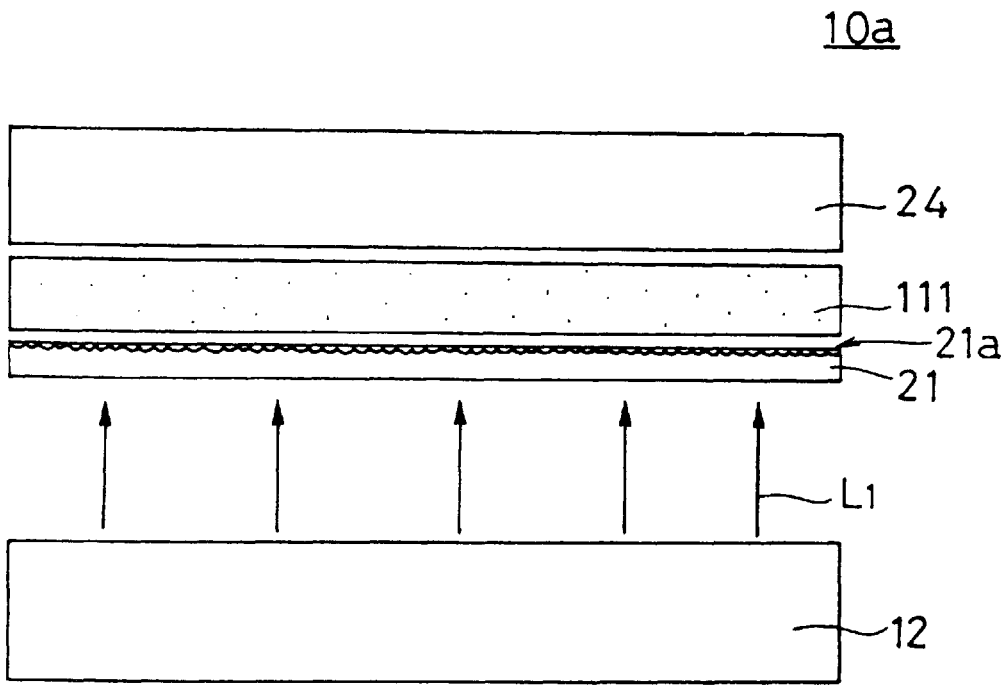
FIG. 10 is a schematic cross section showing a structure of a fluorescent plate of a sixth preferred embodiment of the indicator device in accordance with the present invention.

FIG. 10 is a schematic cross section showing the sixth preferred embodiment of the indicator device (surface-illuminated indicator device) in accordance with the present invention. This device is largely different from the device of the first preferred embodiment in that a fluorescent plate 111 having both functions of the fluorescent plate 22 and the inscription plate 23 of the first preferred embodiment is provided. Specifically, the fluorescent plate 111 is obtained by mixing the fluorescent material and diffusion material into the transparent resin material and forming the mixture in a sheet, plate or the like, and on its surface inscribed are characters and signs to be represented. Other basic constitution of the sixth preferred embodiment is the same as that of the first preferred embodiment.

Variations of The First to Sixth Preferred Embodiments

Though the hologram diffusion plate 21 is disposed between the light source 12 and the fluorescent plate 22 in the first preferred embodiment, the hologram diffusion plate 82 is disposed between the LED unit light source 54 and the fluorescent plate 83 in the second preferred embodiment and the hologram diffusion plate 21 is disposed between the light source 12 and the fluorescent plate 111 in the sixth preferred embodiment, where the hologram diffusion plate is disposed is not limited to these and it may be disposed in any position on an optical path of the light going from the light source towards the indicating surface. With consideration of viewability, it is desirable that the hologram diffusion plate should be placed on a side of the light source relative to the fluorescent plate. In this arrangement, since the light through the hologram diffusion plate is diffused at a predetermined angle and enters the fluorescent plate as a disperse light going in various directions to hit the fluorescent materials at high probability, the fluorescent plate entirely emits a light, to improve the viewability.

Though the hologram diffusion plate is used as the light diffusion member to diffuse the light going from the light source towards the indicating surface in the above preferred embodiments, a conventional well-known light diffusion plate may be used instead of the hologram diffusion plate.

Though the light diffusion means such as the hologram diffusion plate is provided in the above preferred embodiments, since the light diffusion member has no effect on the indication color, the light diffusion member is not an essential constituent element for controlling the indication color but it is desirable to provide it in order for the operator to easily recognize the indication such as characters.

Exemplary Experiments of The First to Sixth Preferred Embodiments

Figure 11:
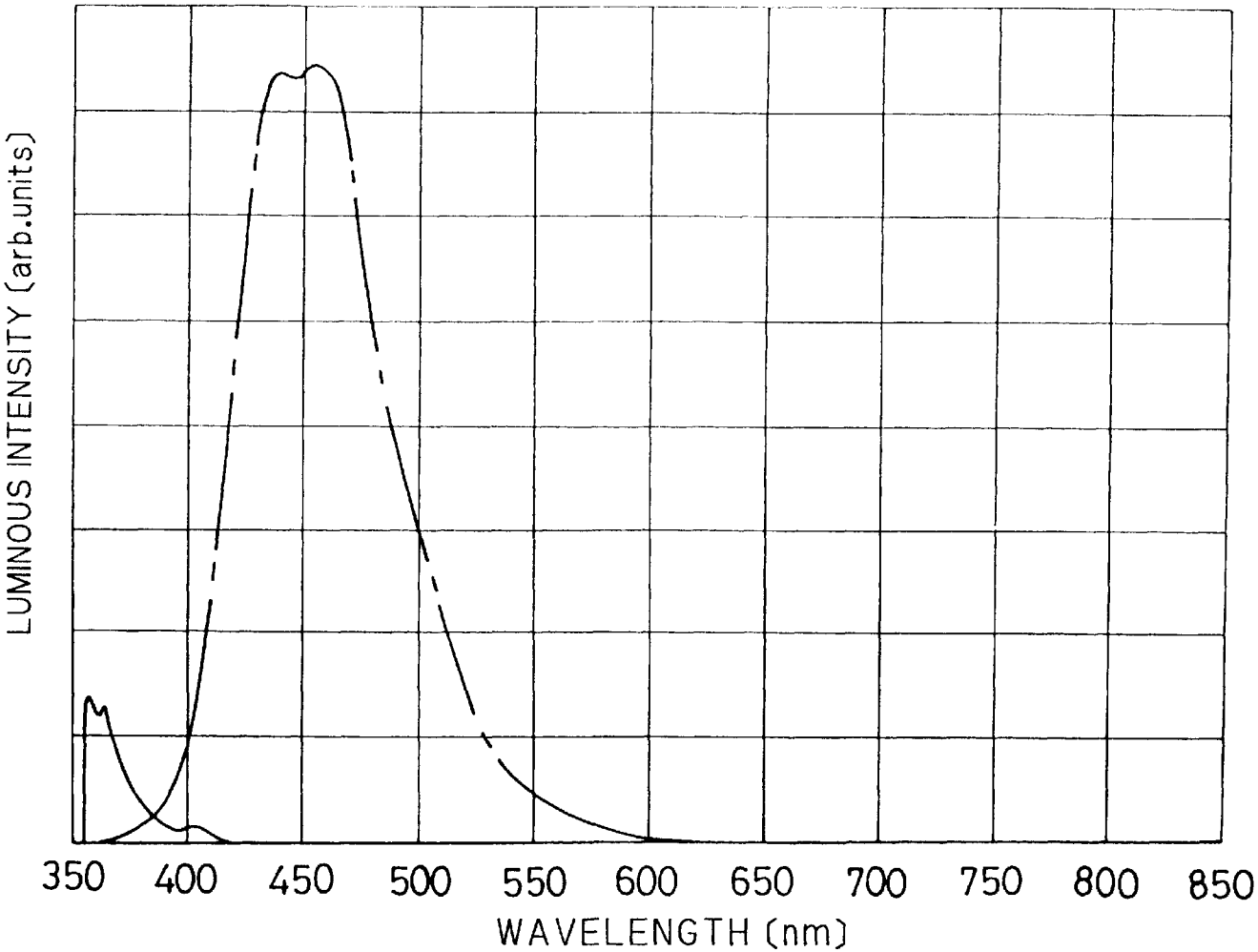
FIG. 11 is a graph showing light spectra from a blue LED element and a block light in an exemplary experiment of the first to sixth preferred embodiments.

Now, three kinds of fluorescent plates, green, orange and red ones, are prepared, and a light from the blue LED element (the light having spectrum represented by the one-dot chain line of FIG. 11) is projected to the light-incident surface of each fluorescent plate and a fluorescence projected from a surface orthogonal to the light-incident surface is received. A study is made thus on spectrum of the fluorescence into which the incident light is changed.

Figure 12:
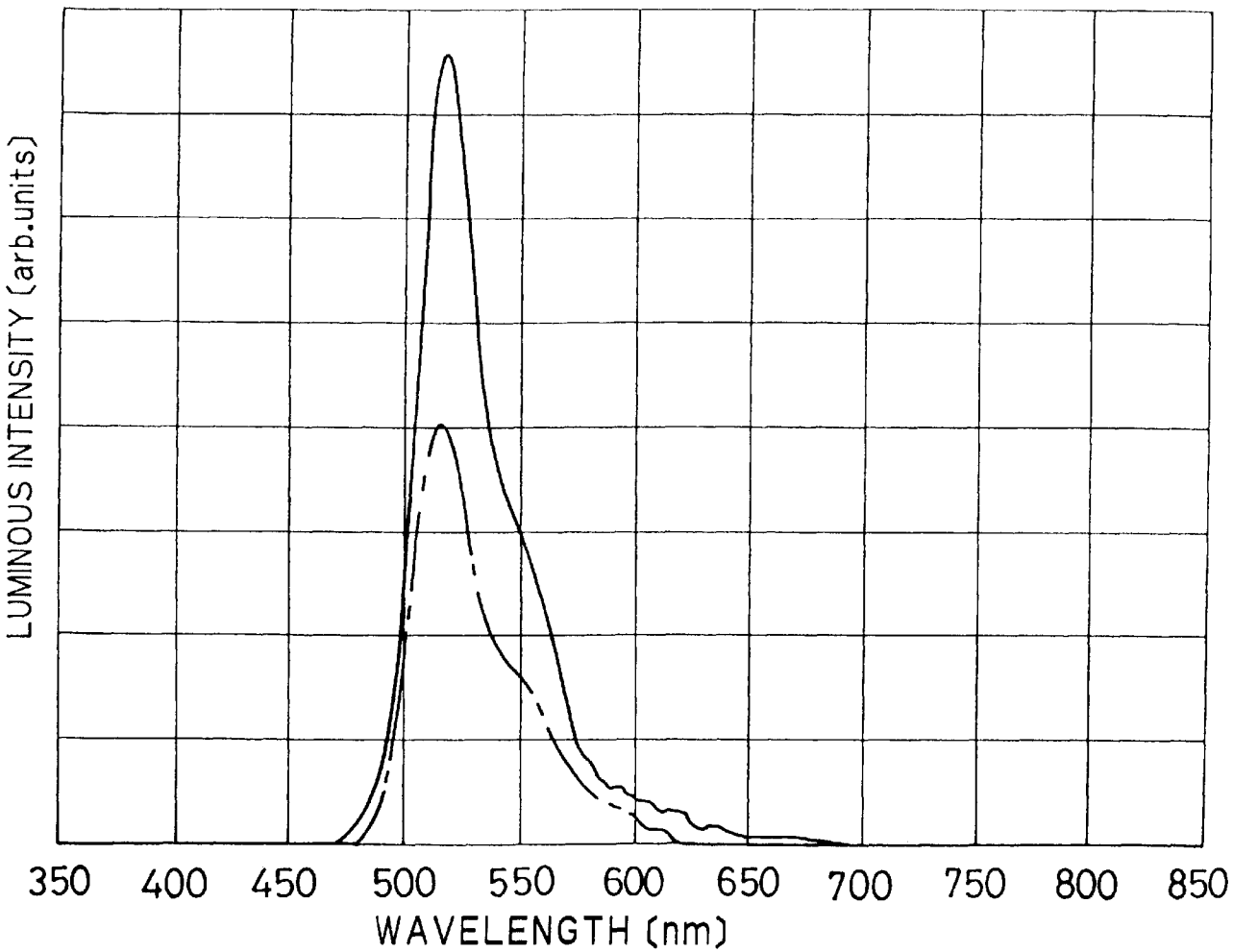
FIG. 12 is a graph showing fluorescence spectra from a green fluorescent plate when a light enters the green fluorescent plate from the blue LED element in the exemplary experiment of the first to sixth preferred embodiments.
Figure 13:
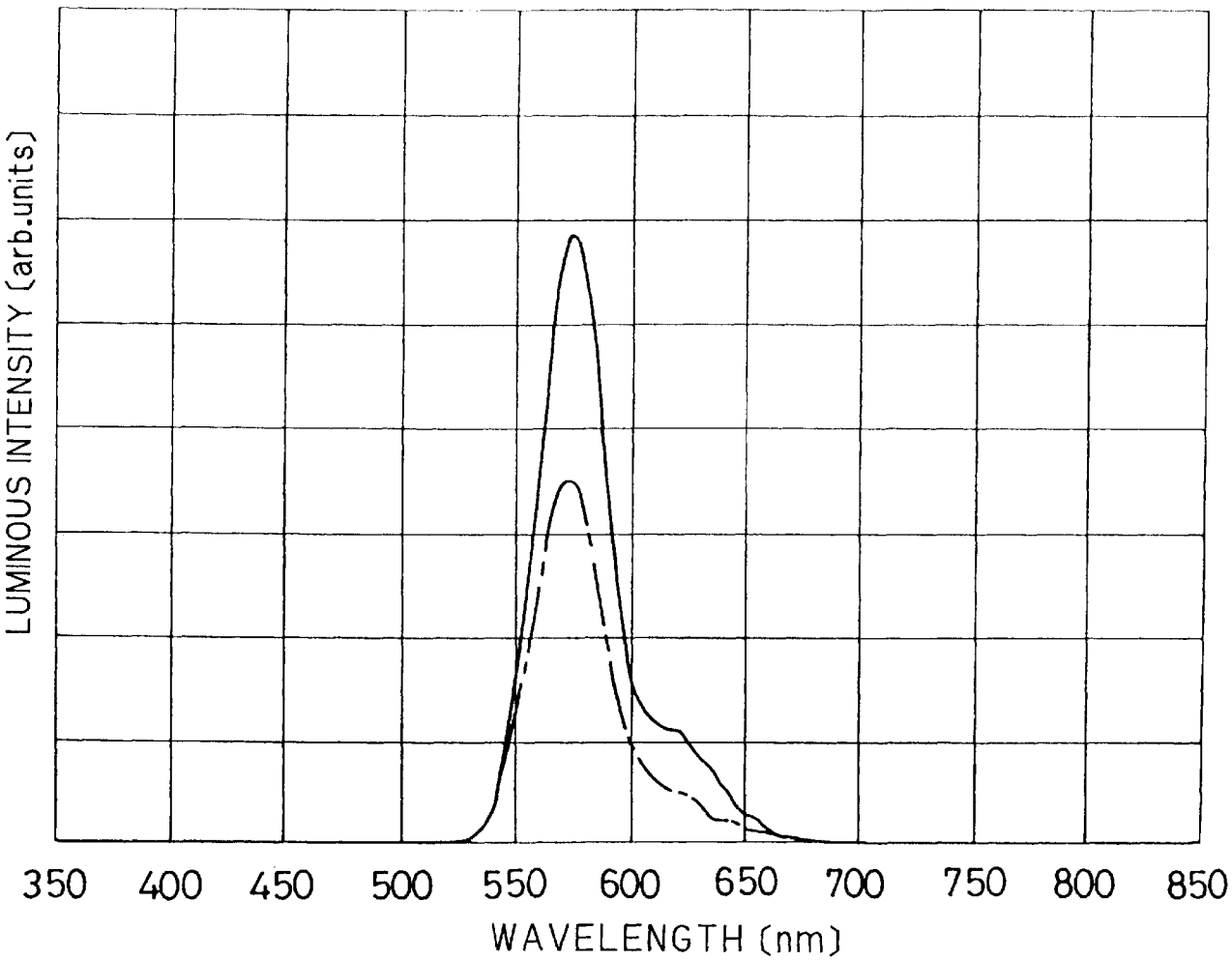
FIG. 13 is a graph showing fluorescence spectra from an orange fluorescent plate when a light enters the orange fluorescent plate from the blue LED element in the exemplary experiment of the first to sixth preferred embodiments.
Figure 14:
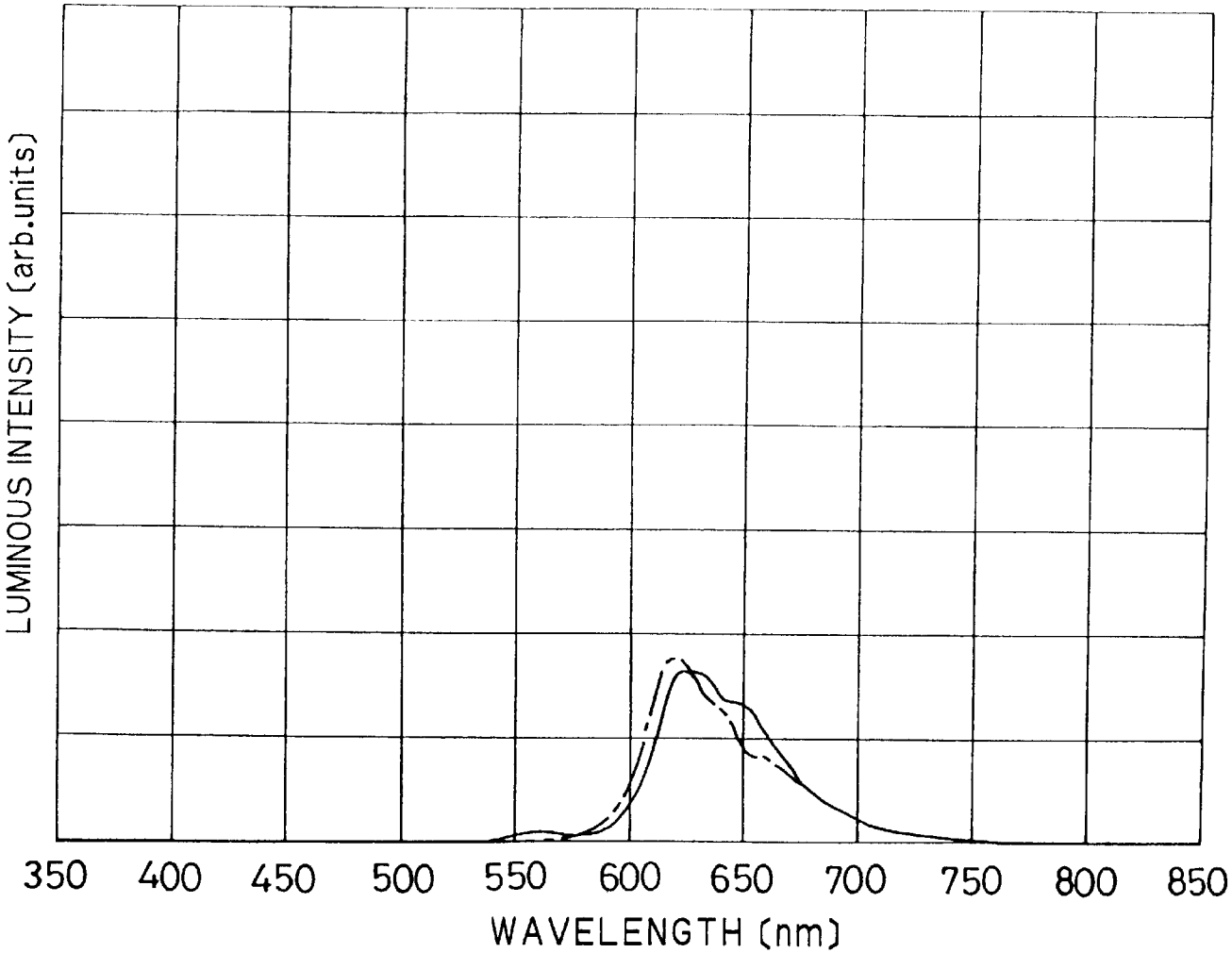
FIG. 14 is a graph showing fluorescence spectra from a red fluorescent plate when a light enters the red fluorescent plate from the blue LED element in the exemplary experiment of the first to sixth preferred embodiments.

FIG. 12 is a graph showing a fluorescence spectrum (one-dot chain line) from the green fluorescent plate when a light enters the green fluorescent plate from the blue LED element. FIG. 13 is a graph showing a fluorescence spectrum (one-dot chain line) from the orange fluorescent plate when a light enters the orange fluorescent plate from the blue LED element. FIG. 14 is a graph showing a fluorescence spectrum (one-dot chain line) from the red fluorescent plate when a light enters the red fluorescent plate from the blue LED element.

Further, for reference, the solid lines of FIGS. 12 to 14 represent fluorescence spectra projected from the green, orange and red fluorescent plates, respectively, when a black light (ultraviolet light source) having a spectrum represented by the solid line of FIG. 11 enters the fluorescent plates.

As shown in FIGS. 12 to 14, by projecting the light of the first wavelength from the blue LED element to the fluorescent plate, the light (fluorescence) of the second wavelength longer than the first wavelength can be projected from the fluorescent plate. Then, as discussed in the above preferred embodiments, the lights of the first and second wavelengths are guided towards the indicating surface, to make an optical indication entirely on the indicating surface with an indication color defined by the combination of the first and second wavelengths.

Figure 15:
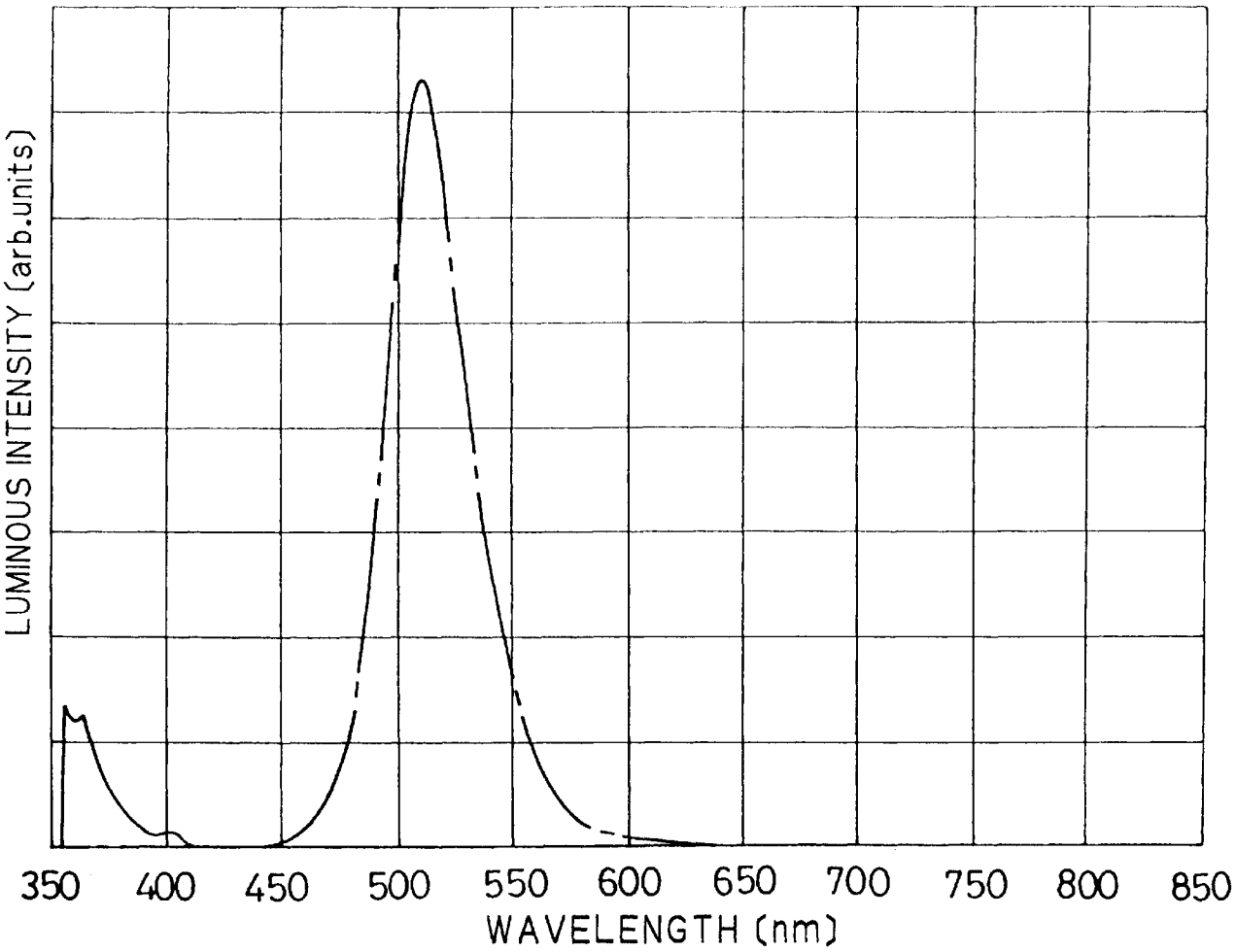
FIG. 15 is a graph showing light spectra from a green LED element and the black light in an exemplary experiment of the first to sixth preferred embodiments.
Figure 16:
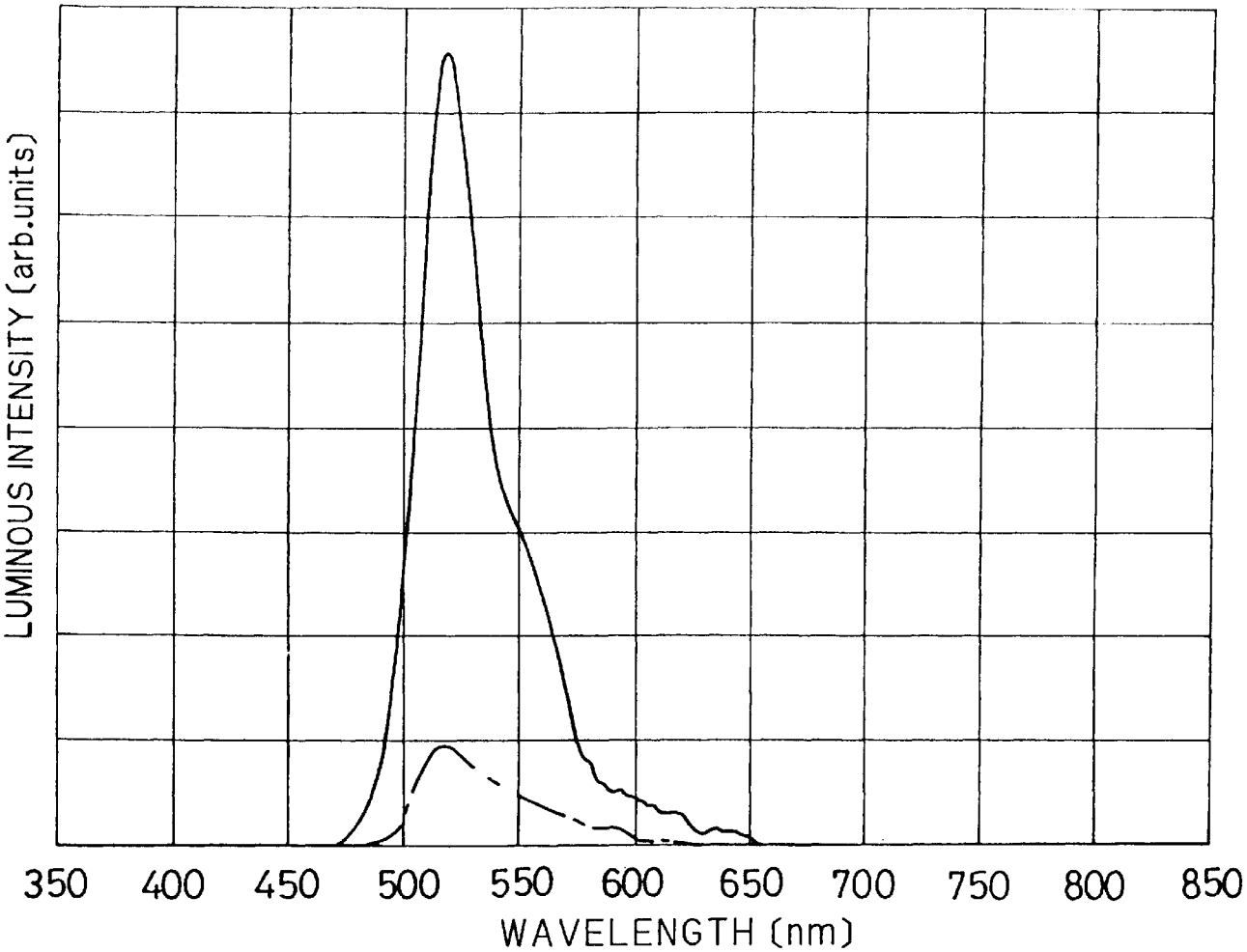
FIG. 16 is a graph showing fluorescence spectra from the green fluorescent plate when a light enters the green fluorescent plate from the green LED element in the exemplary experiment of the first to sixth preferred embodiments.
Figure 17:
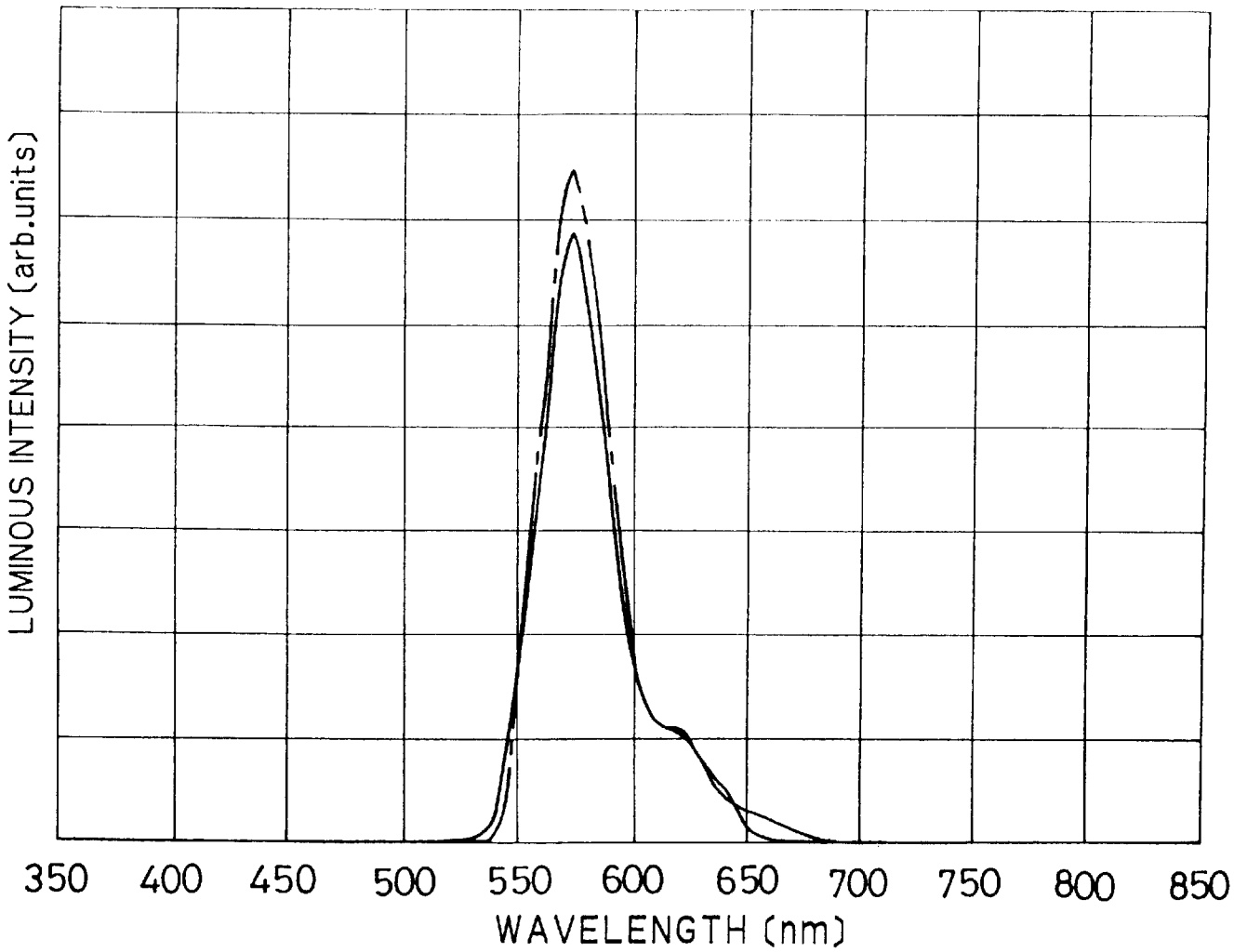
FIG. 17 is a graph showing fluorescence spectra from the orange fluorescent plate when a light enters the orange fluorescent plate from the green LED element in the exemplary experiment of the first to sixth preferred embodiments.
Figure 18:
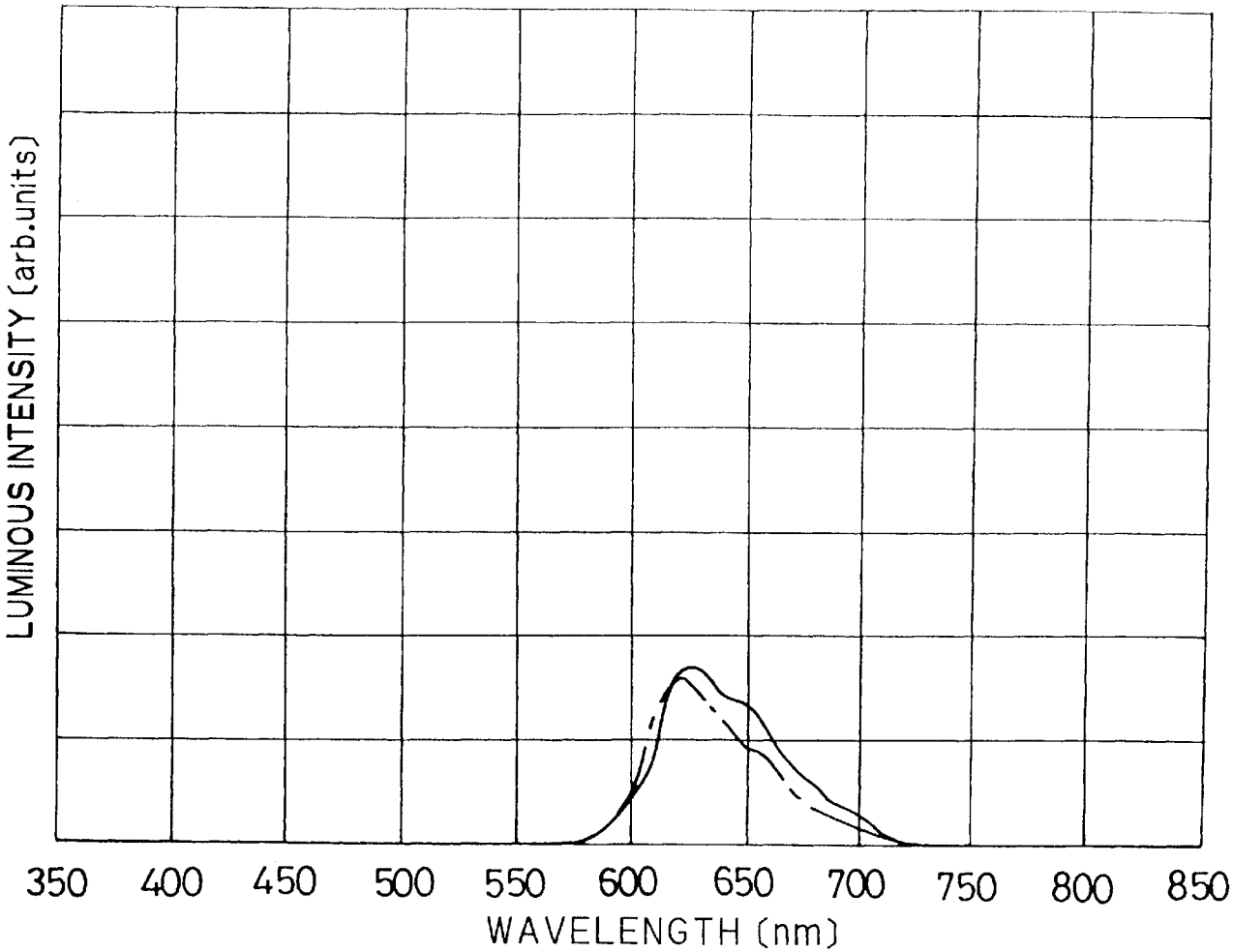
FIG. 18 is a graph showing fluorescence spectra from the red fluorescent plate when a light enters the red fluorescent plate from the green LED element in the exemplary experiment of the first to sixth preferred embodiments.

When a light from a green LED element (a light having a spectrum represented by the one-dot chain line of FIG. 15) enters the above fluorescent plates, the same results as above are obtained. FIG. 16 is a graph showing a fluorescence spectrum (on-dot chain line) from the green fluorescent plate when the light enters the green fluorescent plate from the green LED element. FIG. 17 is a graph showing a fluorescence spectrum (on-dot chain line) from the orange fluorescent plate when the light enters the orange fluorescent plate from the green LED element. FIG. 18 is a graph showing a fluorescence spectrum (one-dot chain line) from the red fluorescent plate when the light enters the red fluorescent plate from the green LED element.

Further, for reference, the solid lines of FIGS. 16 to 18 represent fluorescence spectra projected from the green, orange and red fluorescent plates, respectively, when the black light having a spectrum represented by the solid line of FIG. 15 enters the fluorescent plates.

Next, the blue LED element is prepared as the light source 12 in the indicator lamp (surface-illuminated indicator device) of FIG. 4 and a yellow fluorescent plate is prepared as the fluorescent plate 22. An experiment is made on an indication color for optical indication entirely on the indicating surface.

Table 1 shows the indication color obtained by this combination.

TABLE 1

| | | x | y |
|---|---|---|---|
| Light Source 12 | Blue LED | 0.133 | 0.149 |
| Fluorescent Plate 22 | Yellow Fluorescent Plate | 0.287 | 0.323 |

Columns "x" and "y" of this Table and following Tables 2 to 4 show x-component and y-component of chromaticity coordinates according to the CIEXYZ colorimetric system of color representation. The values of columns "x" and "y" represent x-component and y-component of a color of light emitted from the light source 12 or those of a color of light projected from the fluorescent plate 22, 91 or 92.

As can be seen from Table 1, a color of the light projected from the fluorescent plate 22 is the indication color on the indicating surface side and the color has the x-component of 0.287 and the y-component of 0.323.

Table 2 shows the indication color when the blue LED element is used as the light source 12 and the green fluorescent plate is used as the fluorescent plate 22 in the indicator lamp (surface-illuminated indicator device) of FIG. 4.

TABLE 2

| | | x | y |
|---|---|---|---|
| Light Source 12 | Blue LED | 0.133 | 0.149 |
| Fluorescent Plate 22 | Green Fluorescent Plate | 0.409 | 0.555 |

As can be seen from Table 2, a color of the light projected from the fluorescent plate 22 is the indication color on the indicating surface side and the color has the x-component of 0.409 and the y-component of 0.555.

Next, the blue LED element is prepared as the light source 12 in the indicator lamp (surface-illuminated indicator device) of FIG. 7 and the yellow fluorescent plate and the red fluorescent plate are prepared as the fluorescent plates 91 and 92. An experiment is made on indication colors for optical indication entirely on the indicating surface.

Table 3 shows the indication color obtained by this combination.

TABLE 3

| | | x | y |
|---|---|---|---|
| Light Source 12 | Blue LED | 0.133 | 0.149 |
| Fluorescent Plate 91 | Yellow Fluorescent Plate | 0.287 | 0.323 |
| Fluorescent Plate 92 | Red Fluorescent Plate | 0.428 | 0.223 |

As can be seen from Table 3, a color of the light projected from the fluorescent plate 92 is the indication color on the indicating surface side and the color has the x-component of 0.428 and the y-component of 0.223.

Next, the blue LED element is prepared as the light source 12 in the indicator lamp (surface-illuminated indicator device) of FIG. 7 and the green fluorescent plate and the orange fluorescent plate are prepared as the fluorescent plates 91 and 92. An experiment is made on indication colors for optical indication entirely on the indicating surface in this combination.

Table 4 shows the indication color obtained by this combination.

TABLE 4

| | | x | y |
|---|---|---|---|
| Light Source 12 | Blue LED | 0.133 | 0.149 |
| Fluorescent Plate 91 | Green Fluorescent Plate | 0.200 | 0.631 |
| Fluorescent Plate 92 | Orange Fluorescent Plate | 0.445 | 0.517 |

As can be seen from Table 4, a color of the light projected from the fluorescent plate 92 is the indication color on the indicating surface side and the color has the x-component of 0.445 and the y-component of 0.517.

As shown in the above experimental results, it is possible to control the indication color on the indicating surface side at high flexibility by combination of kinds of the light source and the fluorescent plates.

The Seventh Preferred Embodiment

Figure 19:
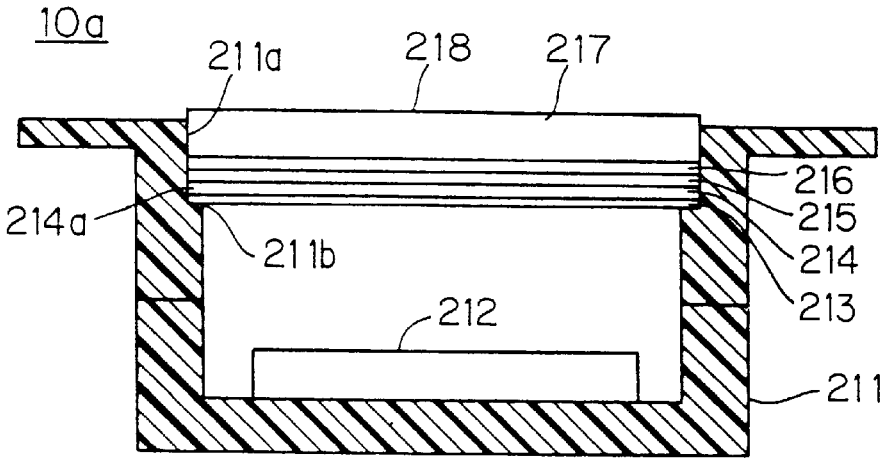
FIG. 19 is a cross section showing a structure of a unit indicator lamp to which a seventh preferred embodiment of the indicator device in accordance with the present invention is applied.

FIG. 19 is a cross section showing the seventh preferred embodiment of the indicator device (surface-illuminated indicator device) in accordance with the present invention. The surface-illuminated indicator device (unit indicator lamp) 10*a* of this preferred embodiment is largely different from that of the first preferred embodiment of FIGS. 2 and 3 in that a prism sheet 213 discussed later is used as the light diffusion member to further improve dispersive efficiency of light.

In a case 211 of the unit indicator lamp 10*a*, an LED unit 212 is disposed and in an opening 212*a* of the case 211, the five following layered plates are fitted from a side of the LED unit 212;

① a prism sheet 213 (sheet member),
② a fluorescent plate 214,
③ a diffusion plate 215,
④ an inscription plate 216, and
⑤ a cover plate 217.

A surface on the outer side of the cover plate 217 serves as the indicating surface 218. The prism sheet 213, the fluorescent plate 214, the diffusion plate 215, the inscription plate 216 and the cover plate 217 are of square plate-like shape with the same size and the prism sheet 213 and the fluorescent plate 214 entirely cover the indicating surface 218.

On an internal side wall of the opening 211*a* of the case 211, a level-difference portion 211*b*, being inwardly protruded. This level-difference portion 211*b* works to control the amount of insertion of the prism sheet 213, the fluorescent plate 214, the diffusion plate 215, and the inscription plate 216 and the cover plate 217 into the opening 211*a*.

Figure 20:
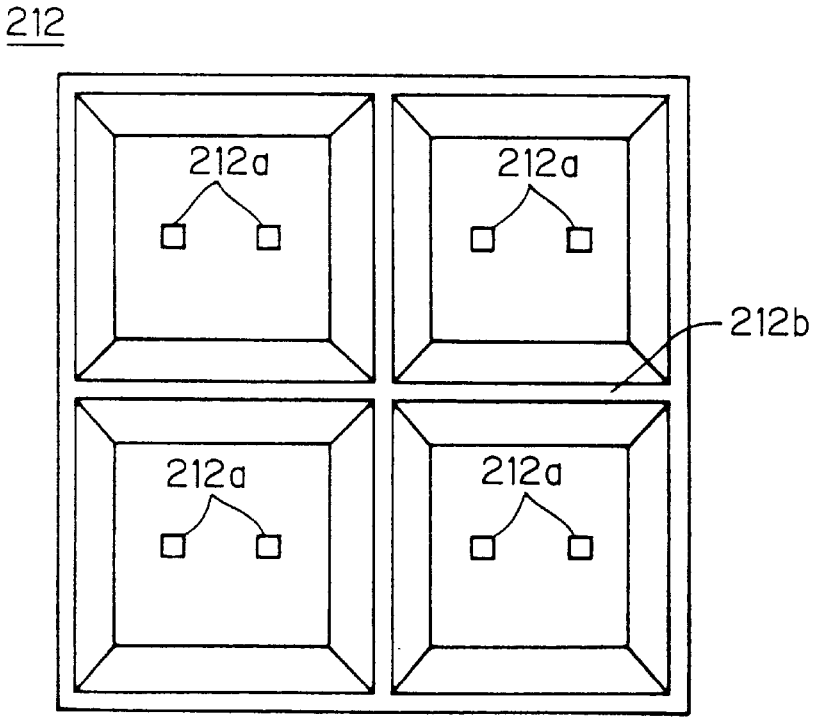
FIG. 20 is a plan view showing an LED unit which is a constituent of the unit indicator lamp of FIG. 19.
Figure 21:
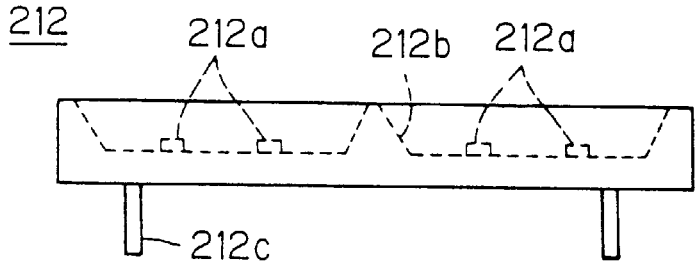
FIG. 21 is a side view of the LED unit of FIG. 20.

FIG. 20 is a plan view of the LED unit 212, and FIG. 21 is a side view thereof On an upper surface of the LED unit 212 provided is a meshy cleat 212*b* to efficiently guide the light emitted from the LED elements 212*a* (light source) towards the indicating surface 218. Two LED elements 212*a* are placed in each of four LED placement regions surrounded by the cleat 212*b*. Sloping surfaces of the cleat 212*b* surrounding the four LED placement regions are reflecting surfaces to efficiently guide the light from the LED elements 212*a* towards the indicating surface 218. Each of the LED elements 212*a* emits the light of the first wavelength (herein, the light of blue wavelength). Further, the LED elements 212*a* are supplied with power through terminals 212*c* provided at the bottom of the LED unit 212.

Figure 22:
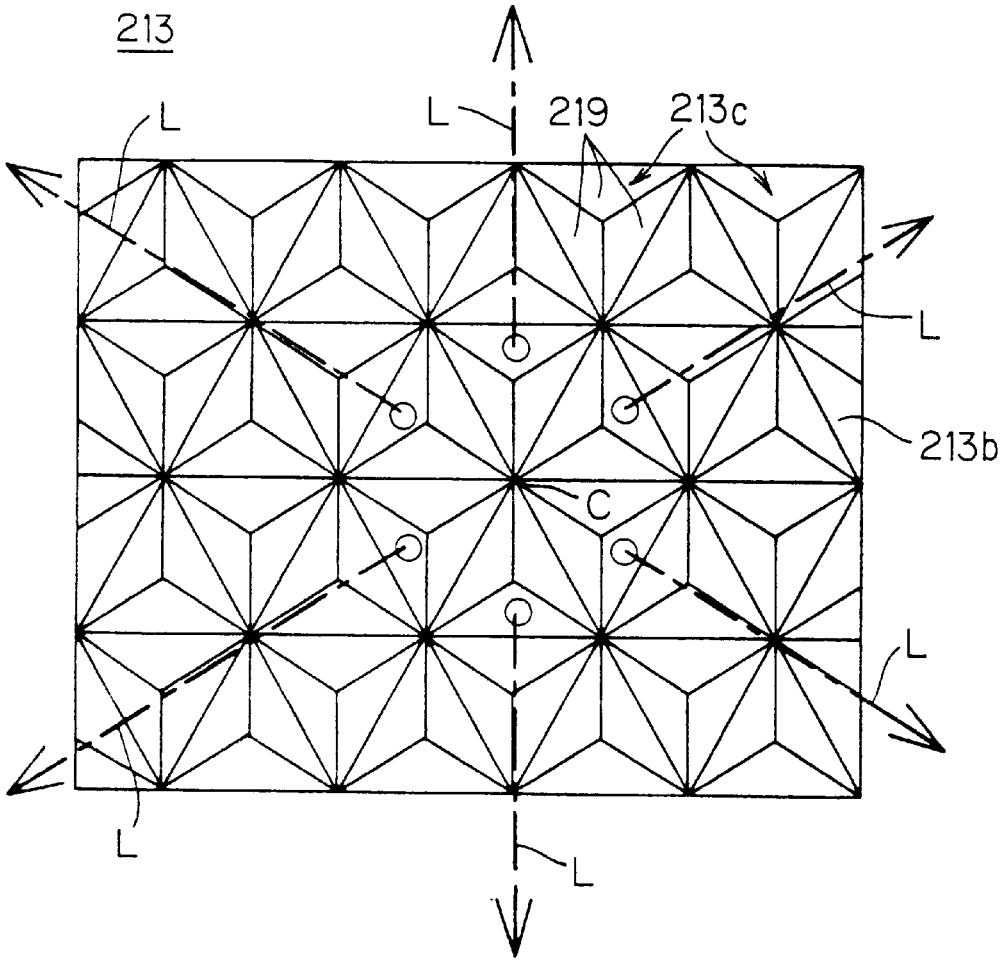
FIG. 22 is a plan view showing a prism sheet which is a constituent of the unit indicator lamp of FIG. 19.
Figure 23:
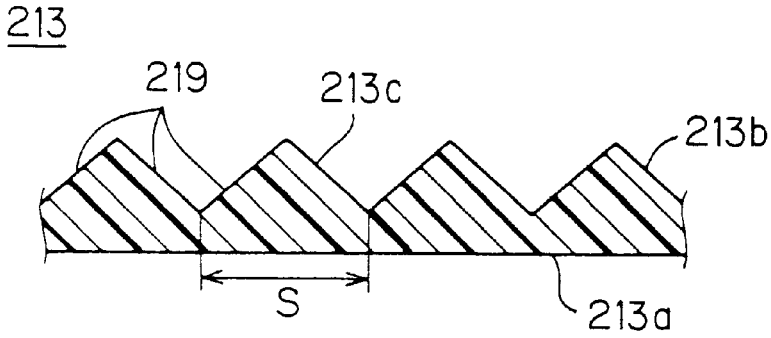
FIG. 23 is a cross section of the prism sheet of FIG. 22.

FIG. 22 is a plan view showing the prism sheet 213 which is a characteristic feature of the present invention, and FIG. 23 is a cross section thereof. The prism sheet 213 is a member of square plate-like shape having a thickness of about 1 mm and made of a transparent resin such as acrylic resin. A light-incident surface 213*a* of the prism sheet 213 facing the LED unit 212 is flat and a light-outgoing surface 213*b* facing the indicating surface 218 is provided with a plurality of very small prisms 213*c* disposed without any clearance.

Figure 24:
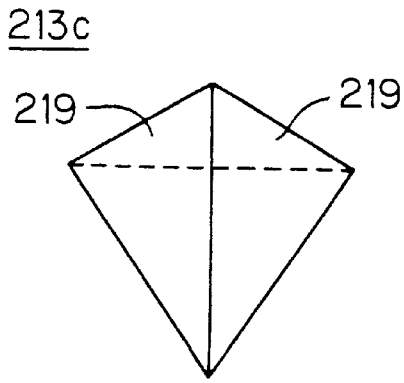
FIG. 24 is a perspective view showing a prism which is provided for the prism sheet of FIG. 22.

Each of the prisms 213*c* provided in the prism sheet 213 is of comer-cube obtained by cutting the comers of a rectangular solid so that the bottom surface may become a regular triangle as shown in FIG. 24. Therefore, each of upper three surfaces of the prism 213*c* is a prism surface 219 of isosceles triangle. The size S of the prism 213*c* is preferably not larger than several hundred $\mu$m, and more preferably not larger than several ten $\mu$m.

The prisms 213*c* have the same size and are orderly arranged so that their prism surfaces 219 may face the indicating surface 218 and the regular-triangle bottom surfaces of adjacent prisms 213*c* may be in intimate contact with each other (in other words, the adjacent prisms 213*c* are in contact, sharing three sides of regular-triangle bottom surface). The light-outgoing surface 213*b* of the prism sheet 213 is thereby covered with a plurality of prisms 213*c* without any clearance.

Next, the optical characteristics of the prism sheet 213 will be discussed. When a light L emitted from the LED elements 212*a* enters a center portion C of adjacent six prisms 213*b* through the light-incident surface 213*a*, as shown in FIG. 22, the incident light L is dispersed in six directions by refraction or the like in the prism sheet 213 and then projected out. Therefore, viewed from the side of the light-outgoing surface 213*b* through the prism sheet 213, one LED element 212*a* looks as if there are six ones.

Referring back to FIG. 19, the fluorescent plate 214 made of a transparent resin is obtained by mixing the fluorescent material which receives the light of the first wavelength and emits the light (fluorescence) of the second wavelength longer than the first wavelength into the base material. Herein, the fluorescent material which receives the light of blue wavelength (the first wavelength) and emits the light of yellow wavelength (the second wavelength) is mixed therein.

The fluorescent plate 214 has a light-incident surface receiving a light from the LED unit 212 and a light-outgoing surface facing the indicating surface 218. When the light of blue wavelength from the LED unit 212 enters the fluorescent plate 214 through the light-incident surface, part of the incident light goes through the fluorescent plate 214 and the rest of the light is changed into a light of yellow wavelength to go out from the fluorescent plate 214. In other words, a white color made from the lights of blue wavelength and yellow wavelength is projected from the light-outgoing surface of the fluorescent plate 214 and the white light is used as the indication light.

The diffusion plate 215 is obtained by mixing an inorganic or organic material for diffusing a light into a base material of resin. The light entering the diffusion plate 215 is therefore diffused and projected. The inscription plate 216 made of transparent resin is inscribed with characters and signs to be represented through printing, engraving or the like. Though the diffusion plate 215 is used herein, a diffusion material for diffusing a light may be mixed into the fluorescent plate 214, instead of using the diffusion plate 215, so that the fluorescent plate 214 may have a light diffusion function.

The light emitted from the LED elements 212*a* of the LED unit 212 enters the prism sheet 213, being dispersed, and enters the fluorescent plate 214. Since the prism sheet 213 has a function of dispersing the incident light into six directions as mentioned above, a small number of LED elements 212*a* can produce the same effect as a large number of LED elements 212*a* irradiating the fluorescent plate 214 with light, and the amount of light entering the fluorescent plate 214 is uniform on its light-incident surface. This device uses eight LED elements 212*a* and produces the same effect as forty-eight LED elements irradiating the fluorescent plate 214 with light.

The light entering the prism sheet 213 is refracted and multidirectionally dispersed inside the prism sheet 213 and goes out from the prism sheet 213 at divergent-directional angle. Therefore, the light from the LED elements 212*a* can enter a peripheral portion of the fluorescent plate 214 shadowed by the level-difference portion 211*b* in the opening 211*a* of the case 211.

Thus, when the light of blue wavelength enters the fluorescent plate 214, the fluorescent plate 214 projects the white light to be used as the indication light as discussed above. The white indication light enters the diffusion plate 215, being diffused to be further uniform, and projected from the indicating surface 218 in the outer surface of the cover plate 217 through the inscription plate 216, with uniform amount of light and uniform color, to make a two-dimensional representation on the indicating surface 218. At this time, on the indicating surface 218, the information inscribed on the inscription plate 216 is represented with white indication light.

In this preferred embodiment, since the light emitted from the LED elements 212*a* is dispersed by the prism sheet 213 to enter the fluorescent plate 214, the light from the LED elements 212*a* can be projected to the peripheral portion 214*a* of the fluorescent plate 214 shadowed by the level-difference portion 211*b* in the opening 211*a* of the case 211. Besides, variation in the amount of light caused by less number of LED elements 212*a* to be provided as compared with the areas of the fluorescent plate 214 and indicating surface 218 and the reflection of the cleat 212*b* in the LED unit 212 and the like can be cut and a uniform amount of light can be applied entirely on the fluorescent plate 214 with less number of LED elements 212*a*. That prevents variation in the amount of light and color of the white indication light on the indicating surface 218, to achieve an excellent indication.

Since the white indication light projected from the fluorescent plate 214 is further uniformed by the diffusion plate 215, more highly-uniformed indication light can be achieved.

Since the prism sheet 213 is made of resin, it is suitable for mass production and can be manufactured at lower cost.

Though a fluorescent plate obtained by mixing the fluorescent material which receives the light of blue wavelength and emits the light of yellow wavelength into its base material is used as the fluorescent plate 214 in this preferred embodiment, indication lights of various colors may be obtained by controlling the combination of the light of the first wavelength emitted from the LED elements 212*a* and the light of the second wavelength emitted from the fluorescent plate 214, like the first preferred embodiment.

Further, there may be another case where only the light emitted from the fluorescent plate 214 is used as the indication light by cutting the light of blue wavelength emitted from the LED elements 212*a* and providing a filter for transmitting only the light emitted from the fluorescent material in the fluorescent plate 214 between the fluorescent plate 214 and the indicating surface 218. That makes it possible to purely extract the color of the light emitted from the fluorescent plate 214 as the color of the indication light.

Furthermore, though the collective indicator lamp 1 of FIG. 1 is constituted of a plurality of unit indicator lamps 10*a*, 10*b*, . . . , 10*i*, there may be another constitution where the collective indicator lamp 1 is made of a single indicator lamp, the LED unit 212 is formed in a form of one board and its indicating surface portion is divided as shown in FIG. 1 on which the inscription plate and the like are placed.

The Eighth Preferred Embodiment

Figure 25:
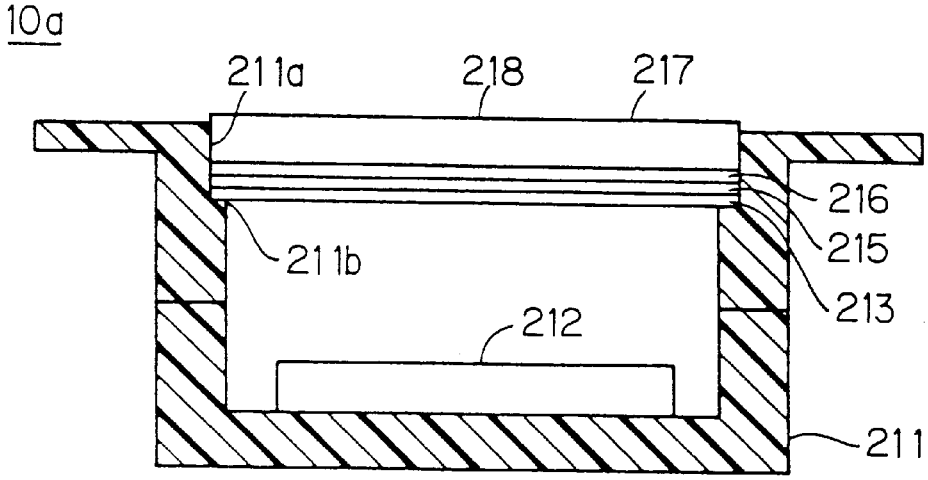
FIG. 25 is a cross section showing a unit indicator lamp to which an eighth preferred embodiment of the indicator device in accordance with the present invention is applied.

FIG. 25 is a cross section showing the unit indicator lamp 10*a* to which a second preferred embodiment of the indicator device in accordance with the present invention is applied. The indicator lamp 10*a* has a constitution where the fluorescent plate 214 is omitted in the indicator lamp 10*a* of the seventh preferred embodiment. Elements which correspond to those of the indicator lamp 10*a* shown in FIG. 19 are given the same reference signs and will not be discussed.

In the indicator lamp 10*a* of this preferred embodiment, since the light from the LED unit 212 is guided through the prism sheet 213 towards the indicating surface 218, uniform amount of light from the LED unit 212 can be projected from the whole indicating surface 218, to produce the same effect as the seventh preferred embodiment, of an excellent indication without variation and the like.

The Ninth Preferred Embodiment

Figure 26:
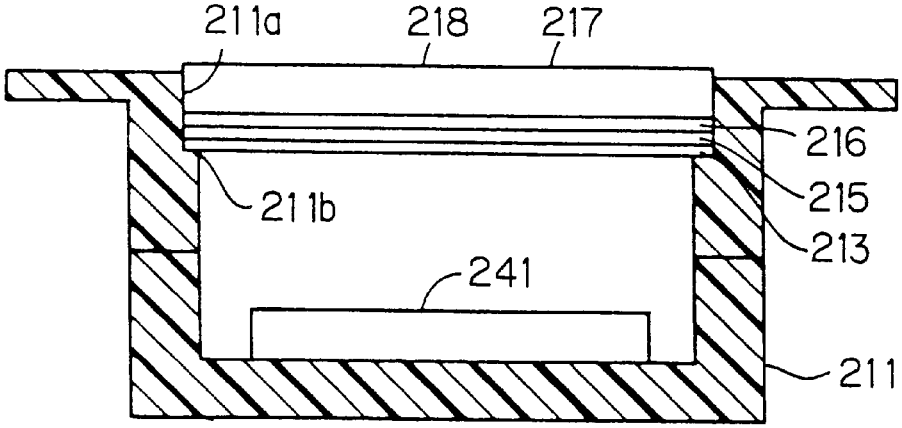
FIG. 26 is a cross section showing a unit indicator lamp to which a ninth preferred embodiment of the indicator device in accordance with the present invention is applied.
Figure 27:
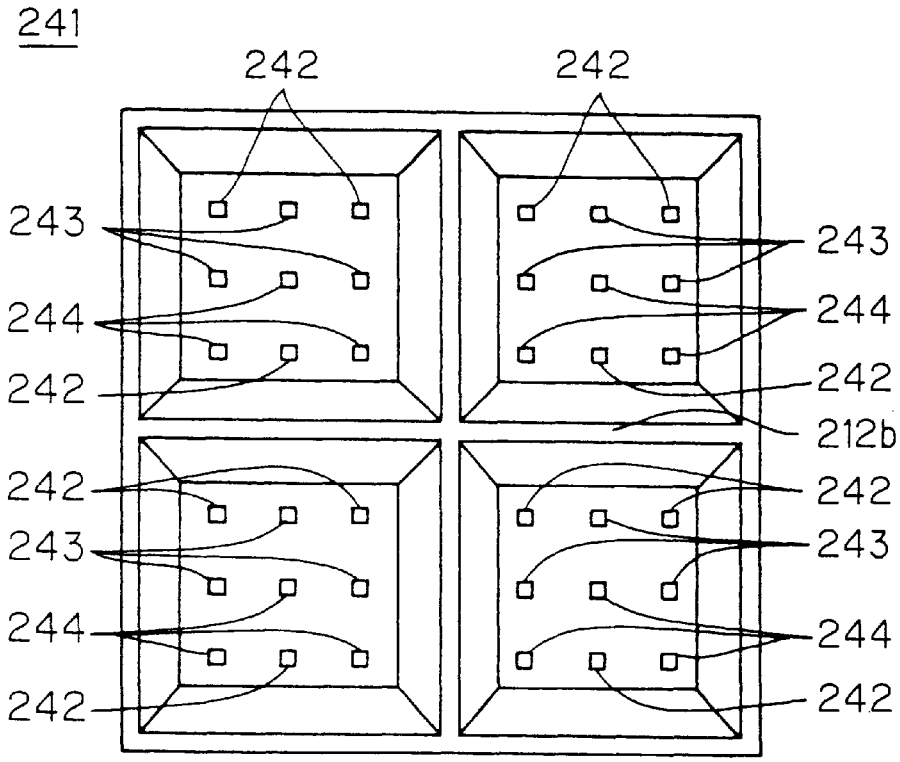
FIG. 27 is a plan view showing an LED unit which is a constituent of the unit indicator lamp of FIG. 26.

FIG. 26 is a cross section showing the unit indicator lamp 10*a* to which the ninth preferred embodiment of the indicator device in accordance with the present invention is applied, and FIG. 27 is a plan view of an LED unit 241 included in the indicator lamp 10*a*. The indicator lamp 10*a* has the same constitution as that of the eighth preferred embodiment except that it uses the LED unit 241 comprising three kinds of LED elements 242, 243 and 244 emitting lights of red, green and blue wavelengths, and corresponding elements are given the same reference signs and will not be discussed.

In the LED unit 241 of this preferred embodiment, as shown in FIG. 27, three elements for each of the three kinds of LED elements 242, 243 and 244 are arranged in matrix inside each of four LED placement regions surrounded by the meshy cleat 212*b* on its upper surface.

Figure 28:
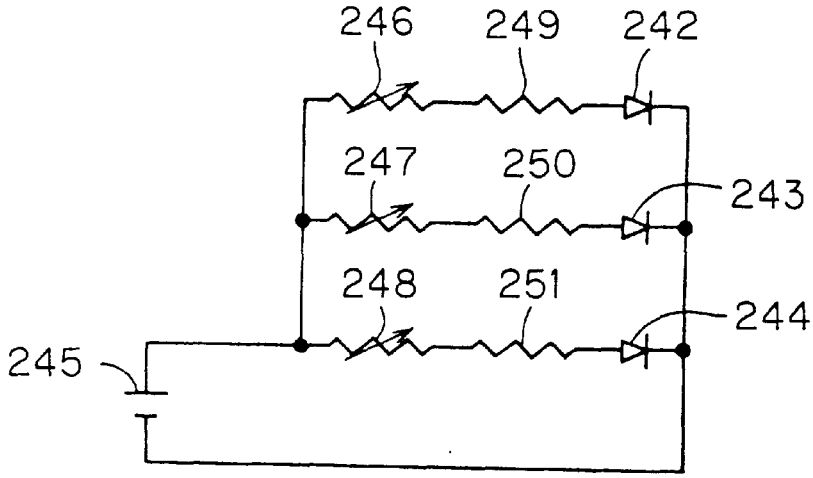
FIG. 28 is a circuit diagram showing an electrical configuration of the LED unit of FIG. 27.

FIG. 28 is a circuit diagram of the LED unit 241, where the three kinds of LED elements 242, 243 and 244 are connected in parallel to a DC power supply 245 and variable resistors 246, 247 and 248 (current controlling unit) and protection resistors 249, 250 and 251 are connected between the DC power supply 245 and the LED elements 242, 243 and 244, respectively. Therefore, by changing resistance values of the variable resistors 246, 247 and 248, current values to be supplied for the LED elements 242, 243 and 244, respectively, can be independently controlled.

Though only one LED element 242 (243, 244) is connected to the variable resistor 246 (247, 248) in the illustration of FIG. 28, a plurality of LED elements 242 (243, 244) may be connected in series. Further, the constituent elements in the circuit configuration of FIG. 28 other than the DC power supply 245 are placed inside the LED unit 241 and the DC power supply 245 are placed outside the indicator lamp 10*a*.

Figure 29:
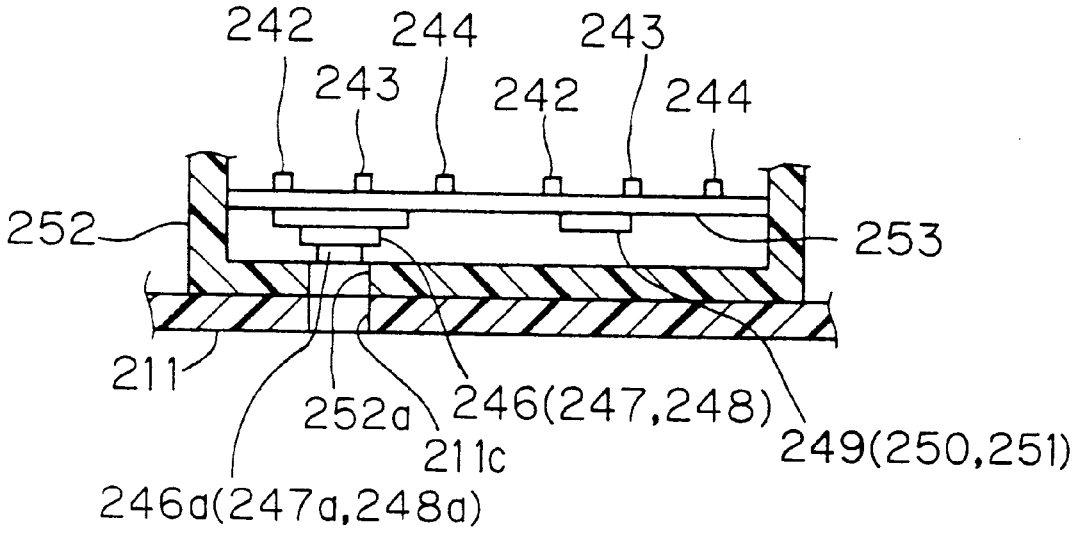
FIG. 29 is a cross section showing part of the unit indicator lamp of FIG. 26 where a variable resistor is provided.
Figure 30:
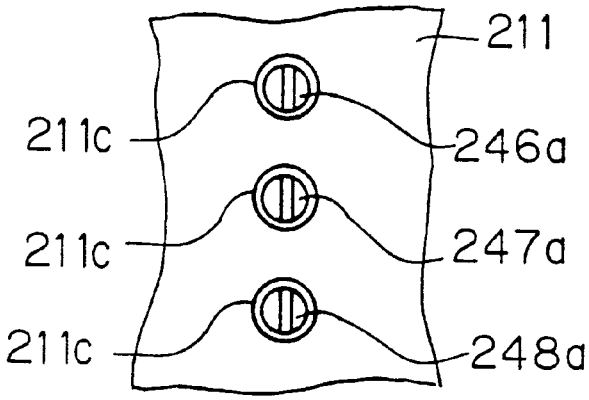
FIG. 30 is a fragmentary bottom view of FIG. 29.

FIG. 29 is a cross section showing part of the unit indicator lamp 10*a* where the variable resistors 246, 247 and 248 are provided, and FIG. 30 is a bottom view thereof. The variable resistors 246, 247 and 248 and the protection resistors 249, 250 and 251 are placed on the back side of a substrate 253 provided in the case 252 of the LED unit 241 for providing the LED elements 242, 243 and 244.

The variable resistors 246, 247 and 248 are provided with rotary shafts 246*a*, 247*a* and 248*a*, and through holes 211*c* and 252*c* are provided therefor on bottom surfaces of the cases 211 and 252 of the indicator lamp 10*a* and the LED unit 241 so that the rotary shafts 246*a*, 247*a* and 248*a* can be externally controlled with a minus driver and the like. Further, the variable resistors 246, 247 and 248 may be placed outside the indicator lamp 10*a*, being connected with wires.

In the indicator lamp 10*a* thus constituted, a light obtained by superposing the lights emitted by the red, green and blue LED elements 242, 243 and 244 is used as the indication light. Therefore, the color of the indication light can be changed to any color such as white by changing each of the resistance values of the variable resistors 246, 247 and 248 to control the value of current to be supplied for each of the three kinds of LED elements 242, 243 and 244 and control the amount of light emitted from each of the three kinds of LED elements 242, 243 and 244.

The light emitted from the LED elements 242, 243 and 244 enters the prism sheet 213, being sufficiently dispersed to be uniform, and enters the diffusion plate 215 as the indication light of uniform amount and uniform color, being diffused to be further uniform. After that, the light goes through the inscription plate 216 and is projected from the whole indicating surface 218 of the cover plate 217.

Thus, this preferred embodiment produces an effect of obtaining the indication light of any color only by controlling the resistance values of the variable resistors 246, 247 and 248 and also produces the same effect as the seventh preferred embodiment, of preventing variation in amount of light and color of the indication light to achieve an excellent indication and the like.

When the lights from plural kinds of light sources emitting lights of different colors are superposed to obtain the light of desired color, in order to achieve the light of uniform color, it is necessary to ensure a large distance between the indicating surface 218 and the light source, and that causes a problem of darker light. In this preferred embodiment, however, since the light from the LED elements 242, 243 and 244 is dispersed efficiently by the prism sheet 213 to be uniform, it is possible to reduce the distance between the LED elements 242, 243 and 244 and the indicating surface 218 and achieve a sufficient lightness with less number of LED elements 242, 243 and 244.

Further, since this preferred embodiment has the constitution to achieve the indication light of desired color by controlling the current values with the variable resistors 246, 247 and 248 to control the amount of light emitted from the LED elements 242, 243 and 244, the color of the indication light can be easily controlled.

Furthermore, since the resistance values of the variable resistors 246, 247 and 248 can be externally controlled, it is easy to control the resistance value, and since the resistance value can be controlled while observing the indicating condition, it is easy to make a fine-tuning of color tone and the like of the indication light.

The Tenth Preferred Embodiment

Figure 31:
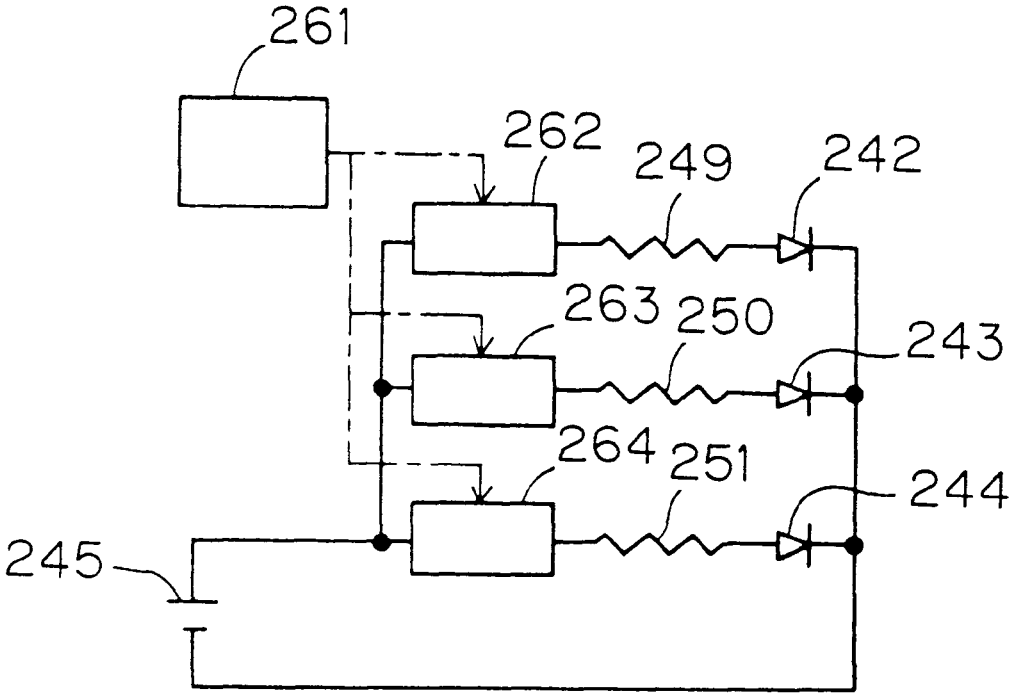
FIG. 31 is a block diagram showing an electrical configuration of the LED unit provided in a unit indicator lamp to which a tenth preferred embodiment of the indicator device in accordance with the present invention is applied.

FIG. 31 is a block diagram showing an LED unit provided in an indicator lamp to which the tenth preferred embodiment of the indicator device in accordance with the present invention is applied. The indicator lamp has the same constitution as the indicator lamp 10*a* of the ninth preferred embodiment discussed earlier except that current controllers 262, 263 and 264 are provided for changing the value of the current to be supplied for the LED elements 242, 243 and 244 in response to instructions from a control unit 261, instead of the variable resistors 246, 247 and 248, and corresponding elements are given the same reference signs and will not be discussed.

For example, plural kinds of colors for the indication light to be produced are each registered in the control unit 261 beforehand with data indicating the values of currents to be supplied to the LED elements 242, 243 and 244 in generation of the indication light of the color. The control unit 261 externally receives an instruction corresponding to a desired color, to determine the color of the indication light to be produced among the plural kinds of colors on the basis of the received instruction.

When the indication color is determined to be the predetermined color, the control unit 261 controls the values of currents to be supplied for the LED elements 242, 243 and 244 through the current controllers 262, 263 and 264, respectively, based on the data registered beforehand and thereby adjusts the ratio of the amounts of lights emitted from the LED elements 242, 243 and 244, to obtain the indication light of predetermined color.

This embodiment produces an effect of automatically obtaining the indication light of predetermined color without specially controlling the variable resistors 246, 247 and 248 as well as the effect of the ninth preferred embodiment to obtain the indication light of any color while preventing variation in the amount of light or color and so on.

Further, it is possible to change the color of the indication light continuously or step-by-step and so on, and therefore flexibility of indication can be increased.

Variations of The Seventh to Tenth Preferred Embodiments

Though each of the prisms 213*c* provided on the light-outgoing surface 213*b* of the prism sheet 213 is of corner-cube in the seventh to tenth preferred embodiments, its shape is not limited to the comer-cube, but may be other polypyramid such as general triangular pyramid, rectangular pyramid, hexagonal pyramid and the like only if the prisms 213*c* can cover the light-outgoing surface 213*b* without any clearance.

Though the inscription plate 216 is provided on a side of the diffusion plate 215 facing the indicating surface 218 in the seventh to tenth preferred embodiments, it may be provided on a side of the diffusion plate 215 facing the LED units 212 and 241.

Though the inscription plate 216 is used in the seventh to tenth preferred embodiments, the inscription plate 216 may be removed and the information can be transmitted by turning on and off or blinking the indicator lamp 10*a*.

Though the prisms 213*c* on the light-outgoing surface 213*b* of the prism sheet 213 are exposed in the surface in the seventh to tenth preferred embodiments, the prisms 213*c* may be covered with a transparent resin with an index of refraction lower than that of the prism sheet 213.

Further, the indicator device of the present invention is applied to the indicator lamp in the seventh to tenth preferred embodiments, it can be applied to the illuminated push-button switch in which a pushing operation unit is turned on in response to the on/off state.

The Eleventh Preferred Embodiment

As the eleventh preferred embodiment, the indicator lamp 10*a* of the seventh to tenth preferred embodiments is used as an illuminating device. In the illuminating device, an illumination is made by using a light projected two-dimensionally from the whole indicating surface 218 (light-projected surface) and the light projected from the indicating surface 218 with no variation can make an excellent illumination. In this case, the inscription plate 216 is removed.

Principle of The Twelfth to Fourteenth Preferred Embodiments

This prevention pays an attention to a wavelength changing function of the fluorescent plate. In general, while the fluorescent plate has a characteristic feature of changing part of received light (the light of the first wavelength) having a wavelength shorter than its intrinsic fluorescent wavelength to the light having the fluorescent wavelength (the light of the second wavelength), it has a property of transmitting a received light having a wavelength longer than the fluorescent wavelength without substantially changing its wavelength.

If a constitution where the light of shorter wavelength and the light of longer wavelength as compared with the fluorescent wavelength are selectively projected onto the fluorescent plate is used, an additively-mixed color of the light of shorter wavelength and the fluorescent wavelength serves as the indication light when the light of shorter wavelength enters the fluorescent plate and the light of longer wavelength itself serves as the indication light when the light of longer wavelength enters the fluorescent plate. Further, when both the light of shorter wavelength and the light of longer wavelength enter the fluorescent plate, the mixed color of the light of shorter wavelength, the light of fluorescent wavelength and the light of longer wavelength.

Therefore, switching these lights allows switching of the indication light among a plurality of colors.

In this case, it is important that a color corresponding to the additively-mixed color of the light of shorter wavelength and the light of the fluorescent wavelength is not an original color of a light emitted from the emitter. Therefore, it is possible to include a color which the emitter can not emit by itself in a plurality of colors which can be switched to one another.

Especially, when a blue light is used as the light of the first wavelength and the yellow fluorescent body is used as the fluorescent body, a yellow light is obtained as the light of the second wavelength and an almost pure white is also obtained as the additively-mixed color of them. Different from one generated by using the emitters of the three primary colors, i.e., "blue", "red" and "green", the white light has no variation from pure white caused by time-varying deterioration of the emitter of specific color and a time-varying deterioration of the blue emitter would cause a deterioration only in luminance. Therefore, including the pure white as one of a plurality of indication lights which can be switched in the present invention has a special significance.

Further, expanding the above principle, there may be a constitution where a plurality of lights having wavelengths shorter than the fluorescent wavelength and different from one another are selectively or simultaneously projected to the fluorescent plate. In this case, a plurality of colors other than colors which can be generated by the emitter itself can be included in a plurality of colors which can be switched.

The Twelfth Preferred Embodiment

Figure 32:
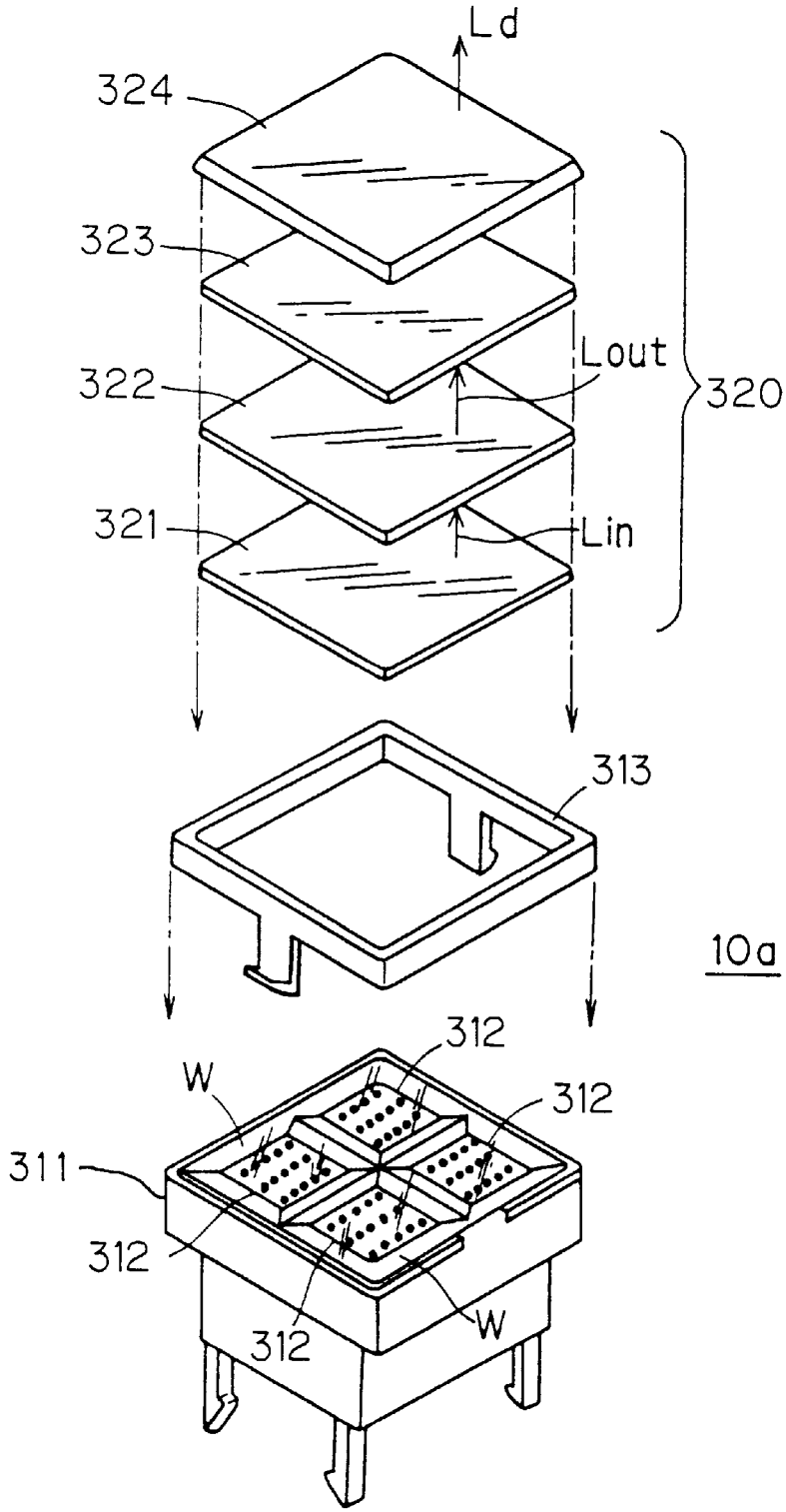
FIG. 32 is an explored perspective view of a unit indicator lamp to which a twelfth preferred embodiment of the indicator device in accordance with the present invention is applied.
Figure 33:
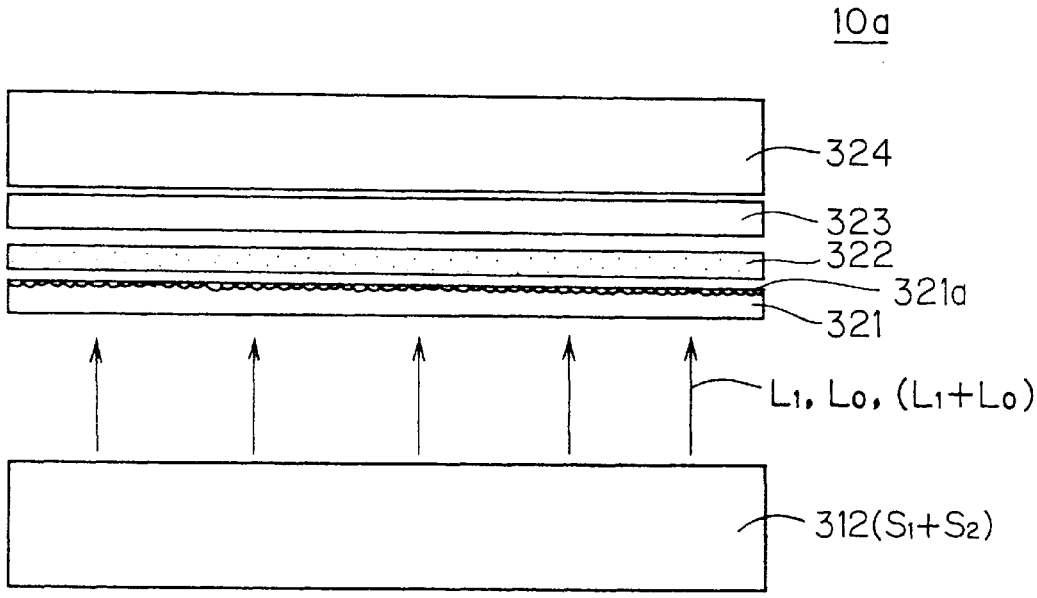
FIG. 33 is a schematic cross section of the unit indicator lamp of FIG. 32.

FIG. 32 is an explored perspective view of the unit indicator lamp 10*a* to which the twelfth preferred embodiment of the indicator device (surface-illuminated indicator device) in accordance with the present invention is applied. FIG. 33 is a schematic cross section of the unit indicator lamp 10*a* of FIG. 32. In the unit indicator lamp 10*a*, a plurality of light sources 312 (four LED units in this figure) are arranged in a matrix inside a resin case 311 having the window W. Each of the light sources 312 is mounted on a major surface of the print board and accommodated in the case 311 of FIG. 32, and its light-emitting part is exposed towards the upper surface of the case 311.

Figure 34:
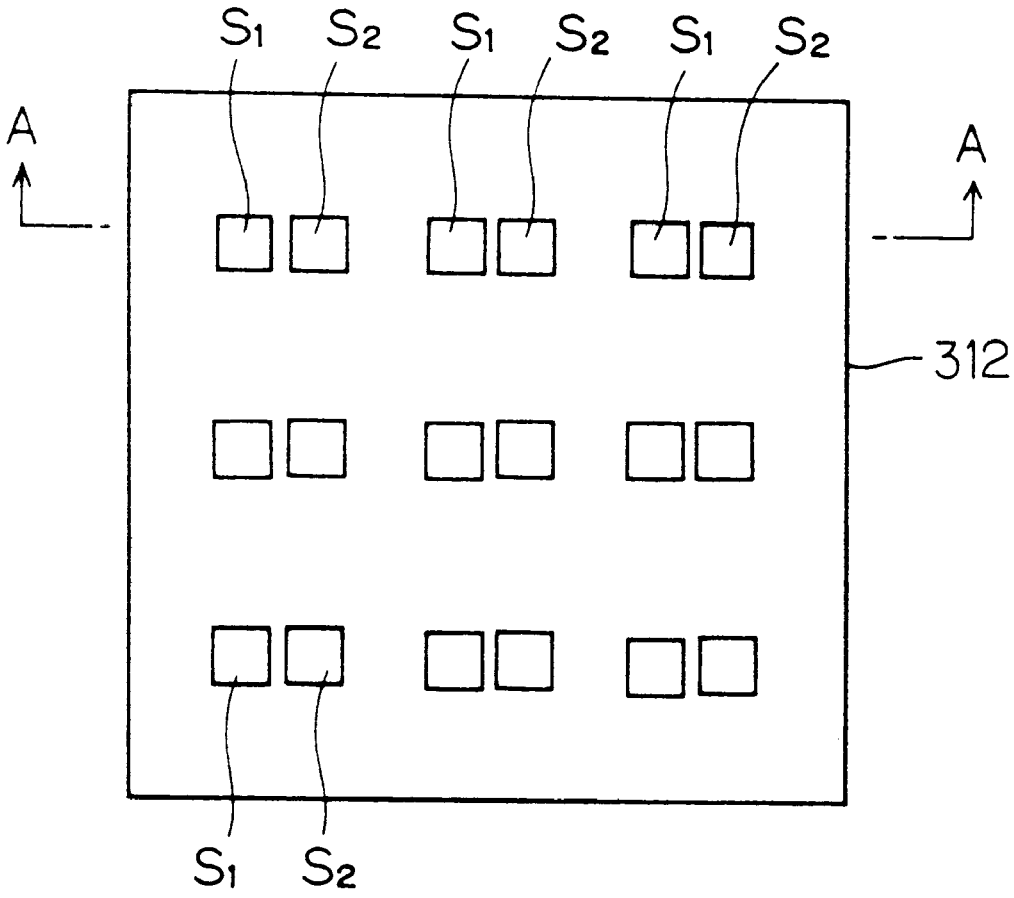
FIG. 34 is a plan view showing a light source provided in the unit indicator lamp of FIG. 32.

Each of the light sources 312 is constituted of a plurality of kinds of emitters S1 and S2 (a plurality of kinds of LED elements) having different emission colors which are alternately arranged in a matrix as shown in FIG. 34. As a typical example, the first emitter S1 is a blue LED which generates a light of blue wavelength as the first wavelength. The second emitter S2 is a red LED which generates a light of red wavelength as a light of a wavelength different from the first wavelength.

Figure 35:
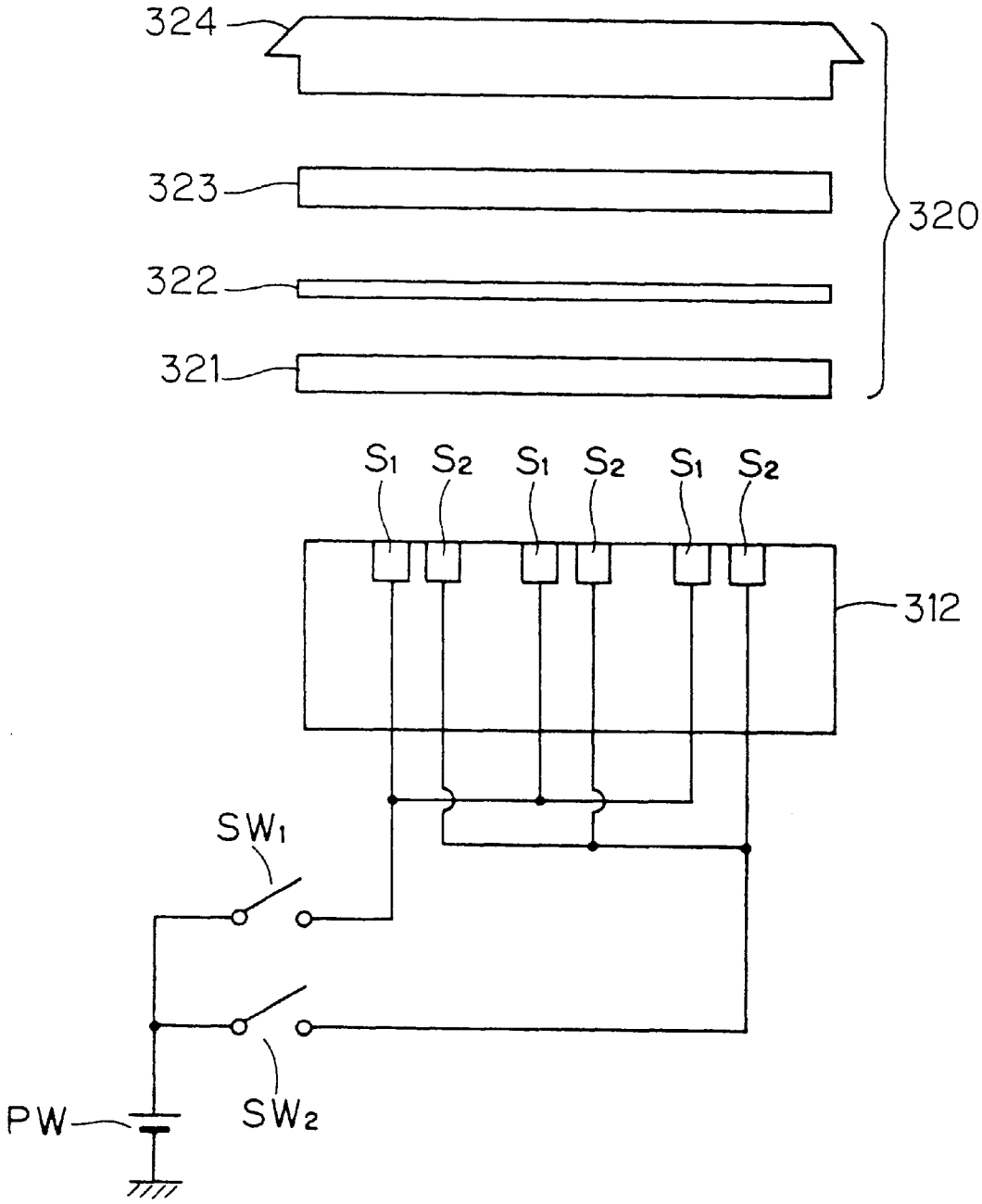
FIG. 35 is a view showing a structure of the unit indicator lamp of FIG. 32 concentrating on the light source and its power-supply circuit.

FIG. 35 is a schematic view including the A-A section of the light source 312 (LED unit) of FIG. 34. Switches S1 and S2 are supplied in parallel with the power from a power supply PW. To the first switch SW1, each of the first emitters S1 among the two kinds of emitters S1 and S2 constituting the light source 312 is electrically connected. To the second switch SW2, each of the second emitter S2 is electrically connected.

Therefore, when only the first switch SW1 is turned on, a plurality of first emitters S1 are turned on and the light L1 of the first wavelength (see FIG. 33) is projected from the light source 312, and when only the second switch SW2 is turned on, a plurality of second emitters S2 are turned on and the light L0 of the another wavelength is projected from the light source 312. When both the first and second switches SW1 and SW2 are turned on, a mixed light of the light L1 of the first wavelength and the light L0 of the another wavelength is projected from the light source 312. When both the first and second switches SW1 and SW2 are turned off, no light is substantially projected from the light source 312. FIG. 33 shows this, schematically representing the selective projection of only the light L1 of the first wavelength, only the light L0 of the another wavelength or the mixed light (L1+L0) of the light L1 of the first wavelength and the light L0 of the another wavelength from the light source 312.

On the other hand, a frame 313 is disposed in an upper periphery of the window W shown in FIG. 32. The frame 313 is fit in the housing 2 of FIG. 1 with the case 311 therebetween, and a compound plate 320 is fit into the frame 313. The compound plate 320 is constituted of superposed four plates:

① a hologram diffusion plate 321 having a hologram surface 321*a;*

② a fluorescent plate 322;

③ an inscription plate 323 made of transparent resin; and

④ a cover plate 324 made of transparent resin, from the side of the light source 312. On the inscription plate 323, characters and signs to be represented are inscribed.

Among them, the fluorescent plate 322 has the same structure as the fluorescent plate 22 of the first preferred embodiment. When the fluorescent plate 322 receives the light L1 of the first wavelength from the first emitter S1 of the light source 312, it transmits part of the received light towards the indicating surface (upper side of this figure) and emits the light L2 of the second wavelength longer than the first wavelength from the rest of the received light and projects the light L2 of the second wavelength towards the indicating surface (see FIG. 36).

Figure 36:
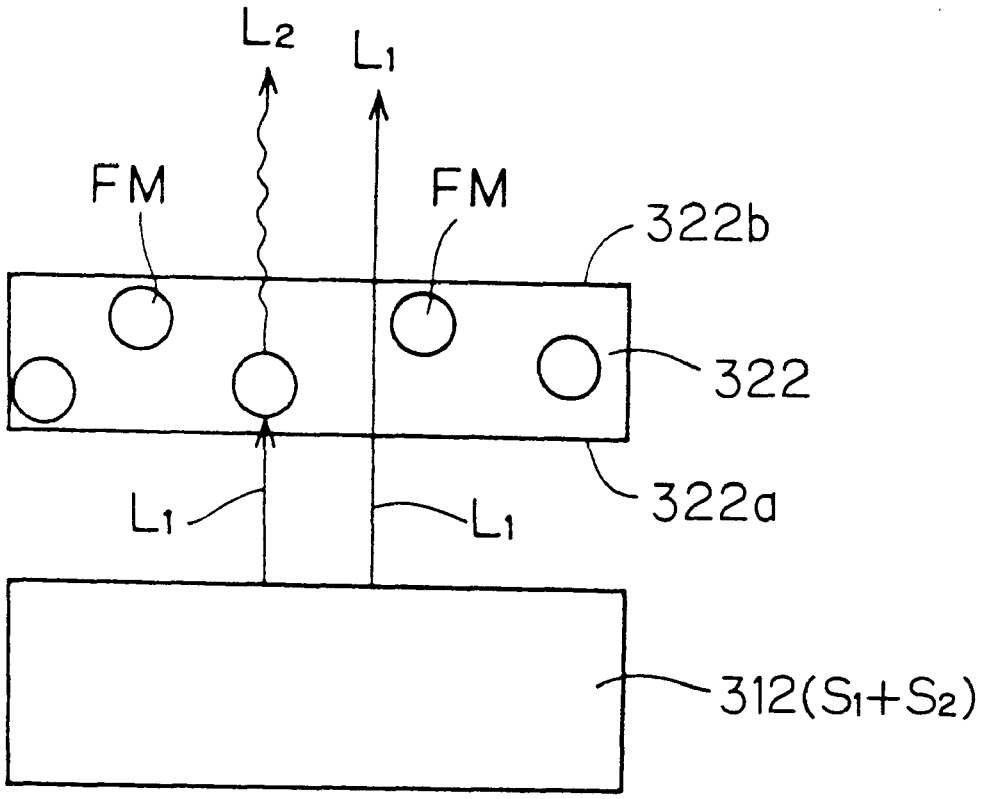
FIG. 36 is a schematic diagram showing optical characteristics of a fluorescent plate provided in the unit indicator lamp of FIG. 32 when a light of the first wavelength is projected thereon.

In the fluorescent plate 322 having the fluorescent characteristics as a whole, when the light L1 of the first wavelength from the light source 312 is projected to a light-incident surface 322*a* through the hologram diffusion plate 321, part of the incident light L1 is projected from the light-outgoing surface 322*b* towards the indication side, and the rest of the incident light L1 is absorbed in the fluorescent material FM and the light L2 (fluorescence) of the second wavelength longer than the first wavelength is emitted from the light-outgoing surface 322*b* as shown in FIG. 36.

Figure 37:
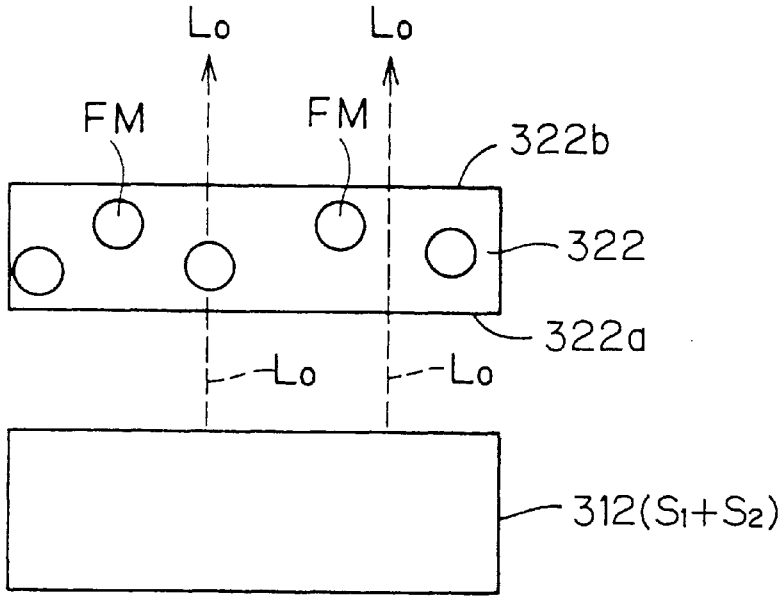
FIG. 37 is a schematic diagram showing optical characteristics of the fluorescent plate provided in the unit indicator lamp of FIG. 32 when a light of another wavelength different from the first wavelength is projected thereon.

On the other hand, the fluorescent plate 322 has no substantial wavelength changing function for the light having a wavelength longer than its intrinsic fluorescent wavelength. Hence, if a wavelength longer than both the first wavelength and the intrinsic fluorescent wavelength (the second wavelength) of the fluorescent plate 322 is selected as another wavelength, when only the light L0 of another wavelength is projected from the light source 312 as shown in FIG. 37, the light L0 of another wavelength substantially goes through the fluorescent plate 322. Therefore, in this case, there arises no color change with wavelength change.

Figure 38:
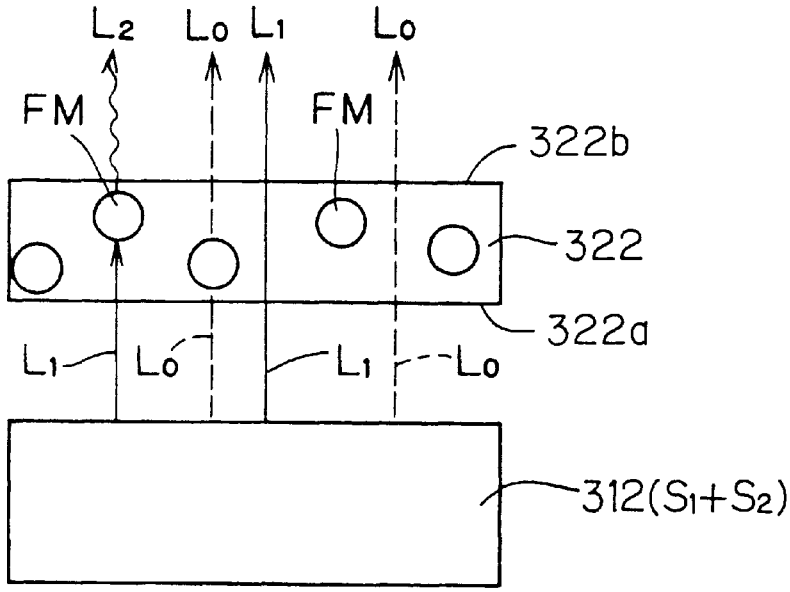
FIG. 38 is a schematic diagram showing optical characteristics of the fluorescent plate provided in the unit indicator lamp of FIG. 32 when both the lights of the first wavelength and another wavelength are projected thereon.

Further, as shown in FIG. 38, when the light L1 of the first wavelength and the light L0 of another wavelength are projected from the light source 312 to the fluorescent plate 322, part of the light L1 of the first wavelength is changed into the light L2 of the second wavelength and the light L0 of another wavelength goes through the fluorescent plate 322. Therefore, a mixed light of the light L1 of the first wavelength, the light L2 of the second wavelength and the light L0 of another wavelength is projected from the fluorescent plate 322.

Though the condition of light projected from the fluorescent plate 322 varies depending on the condition of the light projected from the light source 312, hereinafter, a light projected to the fluorescent plate 322 is referred to as "an input light Lin" and a light projected from the fluorescent plate 322 is referred to as "an output light Lout" as shown in FIG. 32. Further, a light actually recognized on the indicating surface is referred to as "indication light Ld".

Referring back to FIG. 32, the output light Lin projected from the fluorescent plate 322 is guided through the inscription plate 323 and the cover plate 324 towards the indicating surface, serving as the indication light Ld to make an optical indication. When no color filter is used and neither the inscription plate 323 nor the cover plate 324 is not colored, the indication light Ld has substantially the same wavelength component (color) as the output light Lout.

Thus, by using the indicator lamp 10*a* (surface-illuminated indicator device) of this preferred embodiment, the color (indication color) of the indication light Ld for optical indication on the indicating surface side can be switched among the following three colors:

① a color corresponding to combination of the first and second wavelengths;

② a color corresponding to another wavelength; and

③ a color corresponding to the mixed color of the combination of the first and second wavelengths and another wavelength.

Since the color obtained by combination of the first and second wavelengths is specified by combination of the first emitter S1 and the fluorescent plate 322, controlling the combination allows the optical indication with any color.

Especially, the indicator lamp of this preferred embodiment has a great advantage of generating colors which can not be achieved only by the first emitter S1 by utilizing the selective wavelength changing function of the fluorescent plate 322 without exerting a substantial influence on the indication color obtained by the second emitter S2. The combination of the first emitter S1 and the fluorescent plate 322 utilizing the selective wavelength changing function will be discussed in the exemplary experiments, taking specific examples.

Further, in this preferred embodiment, the hologram diffusion plate 321 is provided to diffuse the light from the light source 312 at a predetermined angle and then the diffused light is projected to the fluorescent plate 322. The hologram diffusion plate 321, which has the diffusion surface (hologram surface) 321*a* utilizing light diffraction on one side of the transparent member, can make a diffusion of light without attenuating the light. Therefore, the unit indicator lamp 10*a* can prevent external recognition of the shape of the light source 312 without providing any element for substantially absorbing or attenuating light like a milky-white inscription plate. In short, this preferred embodiment can achieve "highly-intensified indication" and "uniform diffusibility of light" at the same time.

One of the most required colors is "pure white". In order to obtain the pure white, the unit indicator lamp 10*a* of this preferred embodiment has only to use the LED element which emits a blue light as the first emitter and the fluorescent plate 322 having the fluorescent characteristics of emitting a yellow light (the light of the second wavelength) from part of the blue light (the light of the first wavelength) emitted from the first emitter S1. In this case, it is not necessary to use a light source packaging the LED elements for emitting red, green and blue lights in order to obtain white.

Further, since the light source 312 has little amount of heating values, it is possible to ensure longer lifetime of the indicator lamp for making an optical indication of white color without any problem on heating of the light source that would arise when the halogen lamp is used as the light source. Further, the time-varying deterioration of the first emitter S1 would cause only deterioration of luminance and would not cause the color of the indication light Ld to vary from the pure white.

In particular, there is a possibility that the pure white which loses its purity can not be distinguished from other indication colors in switching the indication color among a plurality of colors, but the present invention can solve this problem.

When white is adopted as the mixed light of the lights of the first and second wavelengths, red light can be used, for example, as the light of another wavelength. In this case, by changing the emitting condition of the first and second emitters S1 and S2, a switching of the indication color can be made among three colors, i.e., pure white, red and pink.

By appropriately changing the ratio of numbers of the first and second emitters S1 and S2, various pink colors can be achieved from relatively deep pink to relatively light pink.

Though it is possible to switch among three kinds of colors by the first and second emitters S1 and S2, it is not necessary to make the switching among all the three colors. For example, a switching between two colors may be used, using the first indication color by lighting of only the first emitter S1 and the second indication color by lighting of only the second emitter S2.

Also used may be a switching between the first indication color by lighting of only the first emitter S1 and the third indication color by lighting of both the first and second emitters S1 and S2. Further used may be a switching between the second indication color by lighting of only the second emitter S2 and the third indication color by lighting of both the first and second emitters S1 and S2.

Figure 39:
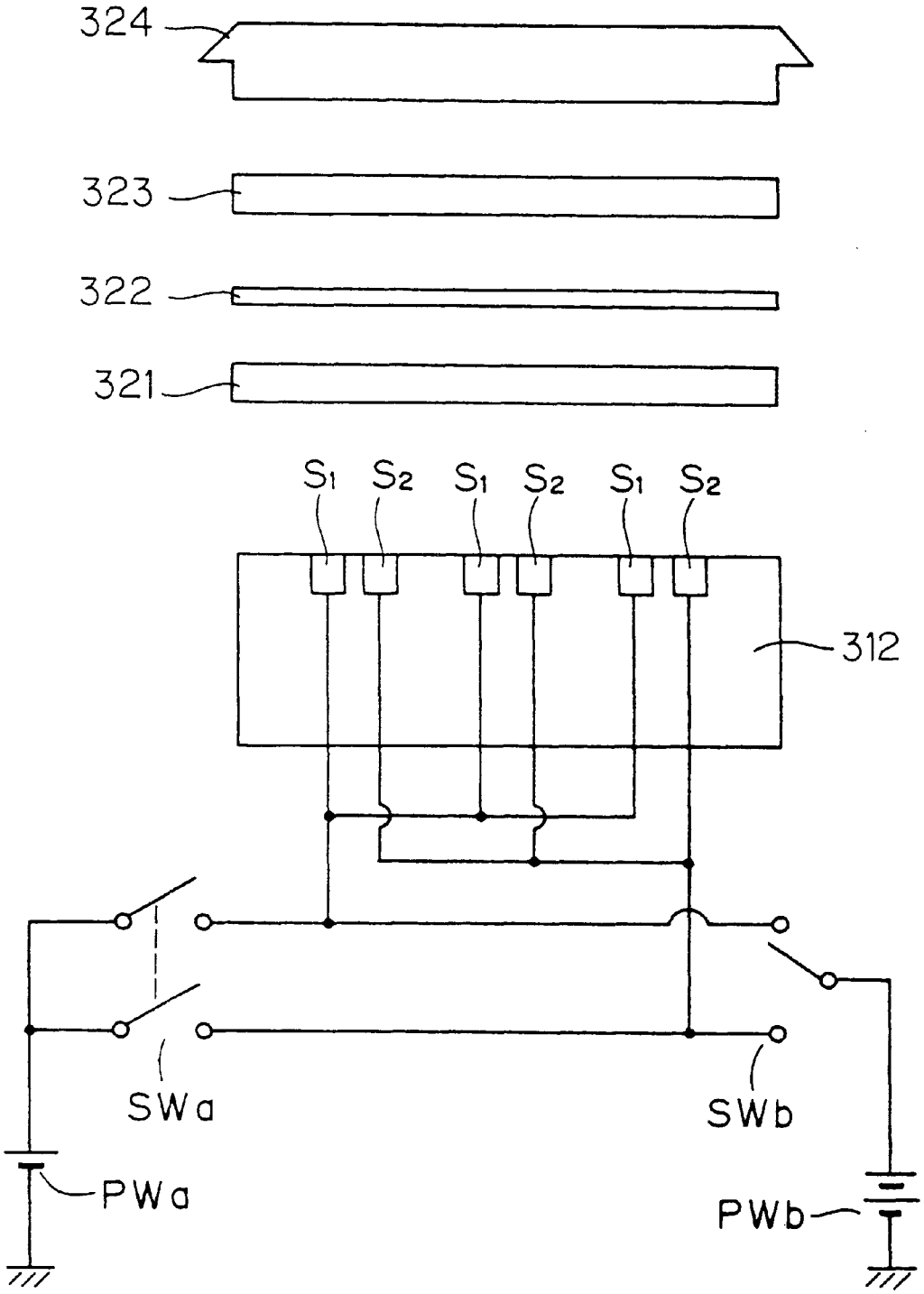
FIG. 39 is a view showing a variation of the power-supply circuit of the light source in the unit indicator lamp of FIG. 32.

There is a difference in the amount of heating values (luminance) of the light source 312 on the whole between the lighting of only the first or second emitter S1 or S2 and the lighting of both the first and second emitters S1 and S2. In order to reduce the difference in the amount of heating values, it is necessary only to provide the first circuit part for supplying both the first and second emitters S1 and S2 in parallel with electric power through a switch SWa from a power supply PWa having a relatively low voltage and the second circuit part for supplying either the first or second emitter S1 or S2 with electric power through a switch SWb from a power supply PWb having a relatively high voltage as shown in FIG. 39. These circuits serve as luminance changing part for changing the luminances of the first and second emitters S1 and S2 depending on their emitting condition. Though the supply voltage is lowered in the lighting of both the emitters in the circuit of FIG. 39, it should be appropriately determined, in consideration of visual effect of the indication color, whether in the lighting of one emitter or in the lighting of both emitters the respective luminances of the emitters are increased.

The present invention can be applied to a switching of the indication color among a plurality of kinds of chromatic colors as well as the switching among a plurality of colors including white. Specifically, a combination of the first emitter S1 and the fluorescent plate 22 is selected so that the mixed color of the fist and second wavelengths may be the first chromatic color. The light of another wavelength emitted from the second emitter S2 is determined to be a light of the second chromatic color. When both the first and second emitters S1 and S2 are turned on, the light of the first chromatic color and the light of the second chromatic color are additively mixed to obtain a light of the third chromatic color as the indication color light. Specific examples of switchings between chromatic colors will be discussed in detail later, and such a constitution can be applied to the thirteenth and fourteenth preferred embodiments as well as the twelfth preferred embodiment.

The Thirteenth Preferred Embodiment

Figure 40:
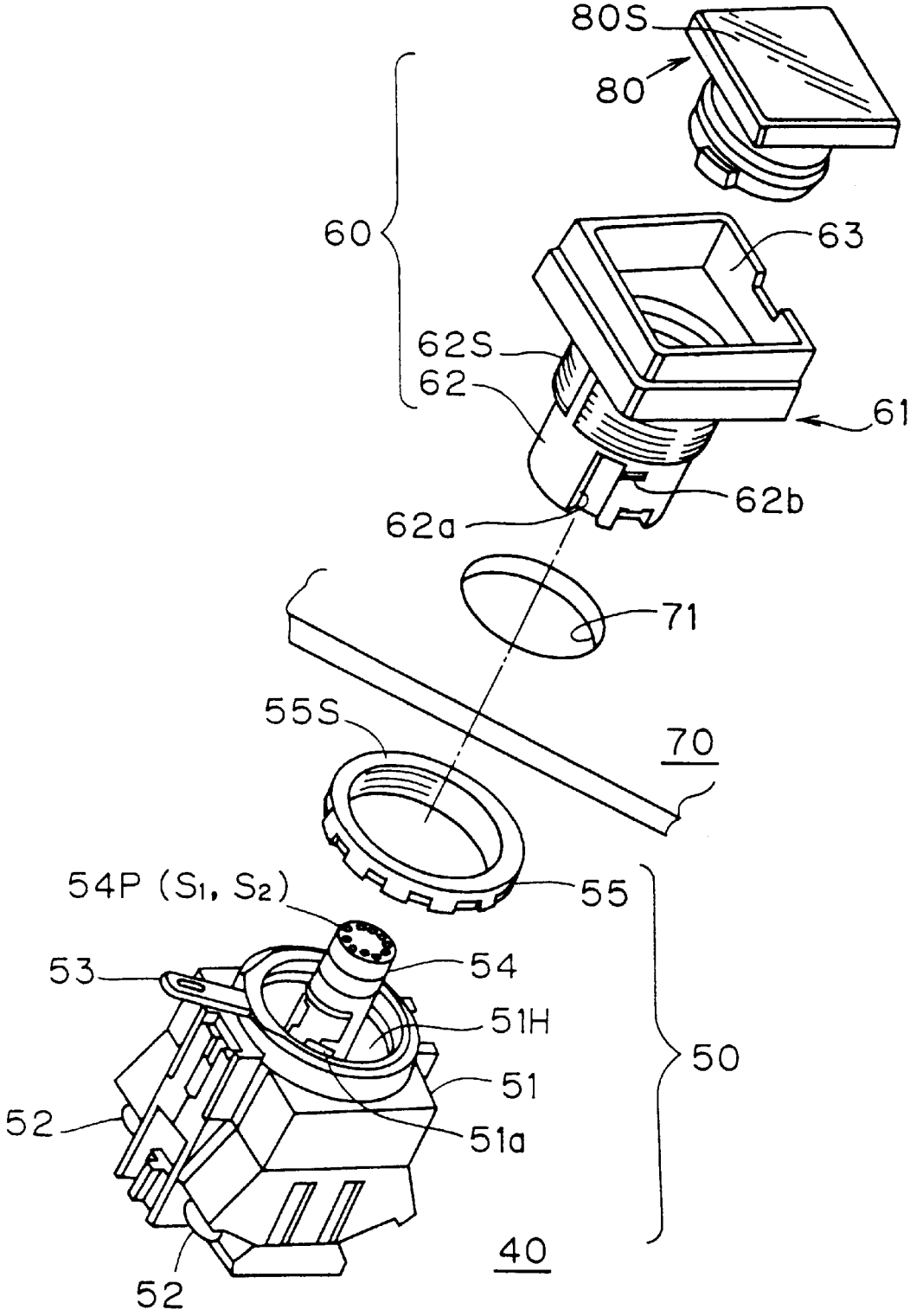
FIG. 40 is a perspective view showing an illuminated push-button switch to which a thirteenth preferred embodiment of the indicator device in accordance with the present invention is applied.
Figure 41:
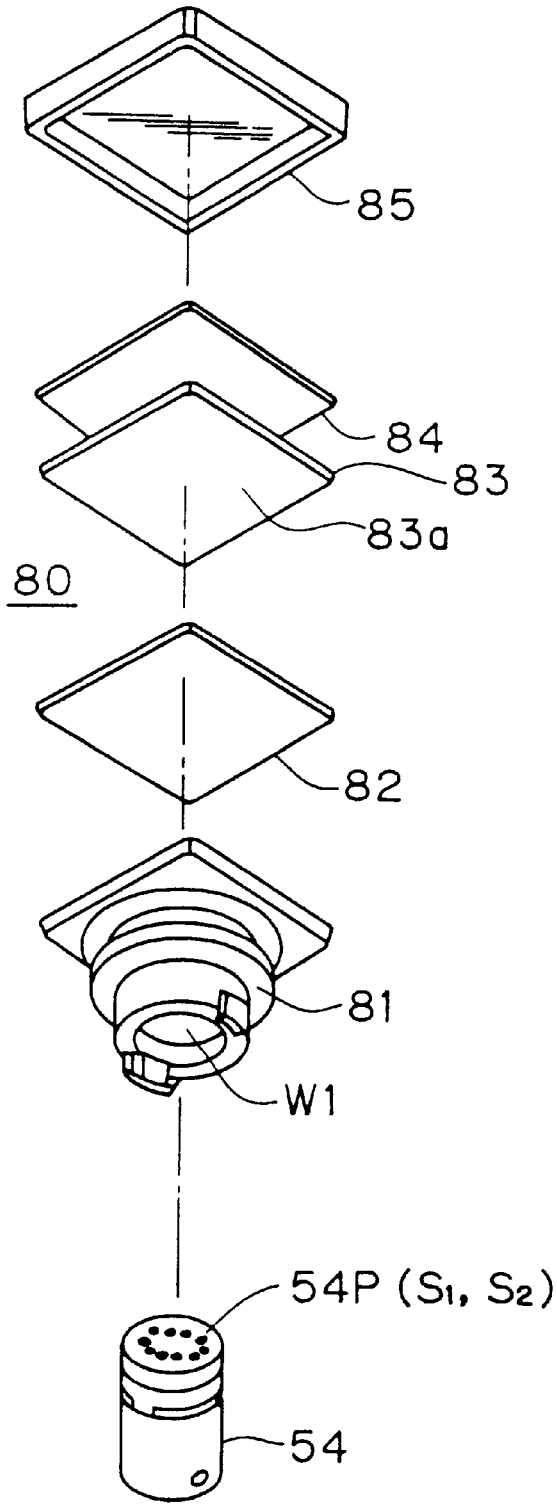
FIG. 41 is a partly-exploded perspective view of FIG. 40.

FIG. 40 is a perspective view showing an illuminated push-button switch to which the thirteenth preferred embodiment of the indicator device in accordance with the present invention is applied, and FIG. 41 is a partly-exploded perspective view of FIG. 40. The illuminated push-button switch of this preferred embodiment has substantially the same constitution as the illuminated push-button switch of the second preferred embodiment except that it uses an LED unit light source 54 having a different constitution, and corresponding elements are given the same reference signs and will not be discussed.

In this preferred embodiment, a group of emitters 54P provided on a top portion of the LED unit light source 54 are constituted of the first emitters S1 (LED elements of the first wavelength) and the second emitters S2 (LED elements of another wavelength) which are alternately disposed.

The LED unit light source 54 is inserted so as to be opposed to the diffusion plate 82 with the transmission hole W1 therebetween. Hence, when only the first emitter S1 of the LED unit light source 54 is turned on, the light of the first wavelength from the LED element 54P is projected onto the light-incident surface 83*a* of the fluorescent plate 83 through the hologram diffusion plate 82. Part of the incident light goes towards the indicating surface (the upper side of this figure) while the rest of the incident light is projected to the fluorescent material (not shown) of the fluorescent plate 83 and changed in wavelength to the light of the second wavelength longer than the first wavelength. Then, from the light-outgoing surface, the lights of the first and second wavelengths are projected out. The outgoing lights of the first and second wavelengths go through the inscription plate 84 and the front plate 85 and make a surface-illuminated indication with indication colors defined by the first and second wavelengths on the indicating surface side.

When only the second emitter S2 is turned on, the light of another wavelength serves as the indication light to make a surface-illuminated indication on the indicating surface side. When both the first and second emitters S1 and S2 are turned on, the mixed light of the light of the first wavelength, the light of the second wavelength and the light of another wavelength is projected out from the indicating surface side.

Thus, in the thirteenth preferred embodiment like the twelfth preferred embodiment, by utilizing the selective wavelength changing function of the fluorescent plate 83, it is possible to generate colors which can not be achieved only by the first emitter S1 without exerting a substantial influence on the indication color of the second emitter S2.

Further, providing the hologram diffusion plate 82 allows achievement of "highly-intensified indication" and "uniform diffusibility of light" at the same time, like the twelfth preferred embodiment, as compared with use of the prior-art well-known light diffusion plate.

Especially, when the LED element which emits a blue light is used as the first emitter S1 and the fluorescent plate having the fluorescent characteristics of emitting a yellow light from part of the blue light emitted from the first emitter S1 is used as the fluorescent plate 83, like the twelfth preferred embodiment, it is possible to set the indication color of the indicator lamp in the surface-illuminated push-button to white with less amount of heating values.

The Fourteenth Preferred Embodiment

Figure 42:
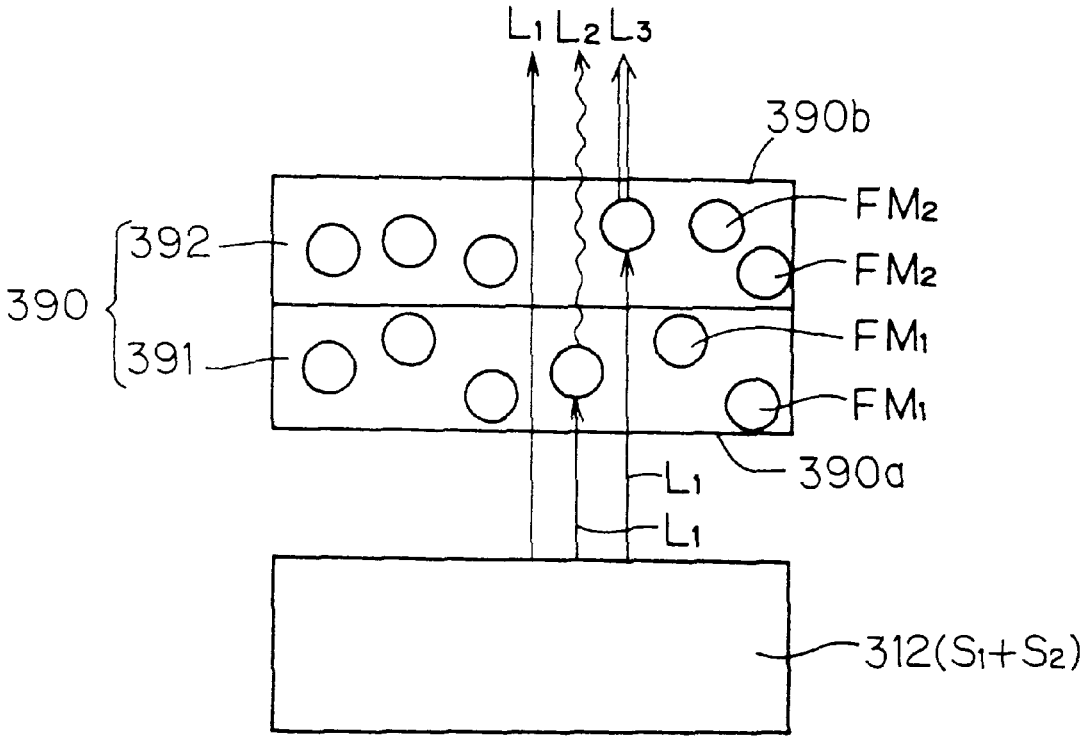
FIG. 42 is a schematic cross section showing a fourteenth preferred embodiment of the indicator device in accordance with the present invention.

FIG. 42 is a schematic cross section showing the fourteenth preferred embodiment of the indicator device (surface-illuminated indicator device) in accordance with the present invention. The surface-illuminated indicator device of this preferred embodiment is different from that of the twelfth preferred embodiment of FIG. 36 largely in that a fluorescent body 390 (wavelength changing member) constituted of two layered plates, i.e., fluorescent plates 391 and 392, is provided to emit the light of third wavelength as well as the second wavelength, instead of providing the single fluorescent plate 322 to emit the light of the second wavelength. Other basic constitution of the fourteenth preferred embodiment is the same as that of the twelfth preferred embodiment.

The fluorescent body 390 has the following two layered plates:

① the fluorescent plate 391 for transmitting part of the light L1 of the first wavelength from the light source 312 towards the light-outgoing surface (the upper side of this figure) and emitting the light L2 of the second wavelength longer than the first wavelength from the rest of the incident light L1 towards the light-outgoing surface; and ② the fluorescent plate 392 for transmitting the part of the light L1 and the light L2 from the fluorescent plate 391 towards the light-outgoing surface and emitting a light L3 of the third wavelength longer than the first wavelength from the rest of the light L1 towards the light-outgoing surface.

With this constitution, when the light L1 of the first wavelength from the light source 312 is projected to a light-incident surface 390*a* of the fluorescent body 390, in the fluorescent plate 391, part of the light L1 of the first wavelength goes towards the fluorescent plate 392, and the rest of the incident light L1 is absorbed in the fluorescent materials FM1 and the light L2 of the second wavelength longer than the first wavelength is emitted from each of the fluorescent materials FM1 towards the fluorescent plate 392. In the fluorescent plate 392 receiving the light L1 of the first wavelength and the light 12 of the second wavelength, part of the light L1 of the first wavelength and the light L2 of the second wavelength are projected from a light-outgoing surface 390*b* of the fluorescent body 390 towards the indicating surface (the upper side of this figure), and the rest of the light L1 of the first wavelength is absorbed in the fluorescent materials FM2 and the light L3 of the third wavelength longer than the first wavelength is emitted from each of the fluorescent materials FM2 and projected from the light-outgoing surface 90*b* towards the indicating surface. Thus, an optical indication with the lights L1 to L3 of the first to third wavelengths is made entirely on the indicating surface.

Further, part of the light L2 of the second wavelength is absorbed in the fluorescent materials FM2, and a light of the fourth wavelength (not shown) longer than the second wavelength is emitted from the fluorescent materials FM2 and projected from the light-outgoing surface 90*b* towards the indicating surface.

Thus, since the indication color on the indicating surface is defined by the lights L1 to L3 of the first to third wavelengths when the first emitter S1 in the light source 312 is turned on, the fourteenth preferred embodiment can make a finer control of the indication color than the twelfth preferred embodiment in which the indication color is defined by the lights L1 and L2 of two wavelengths.

Figure 43:
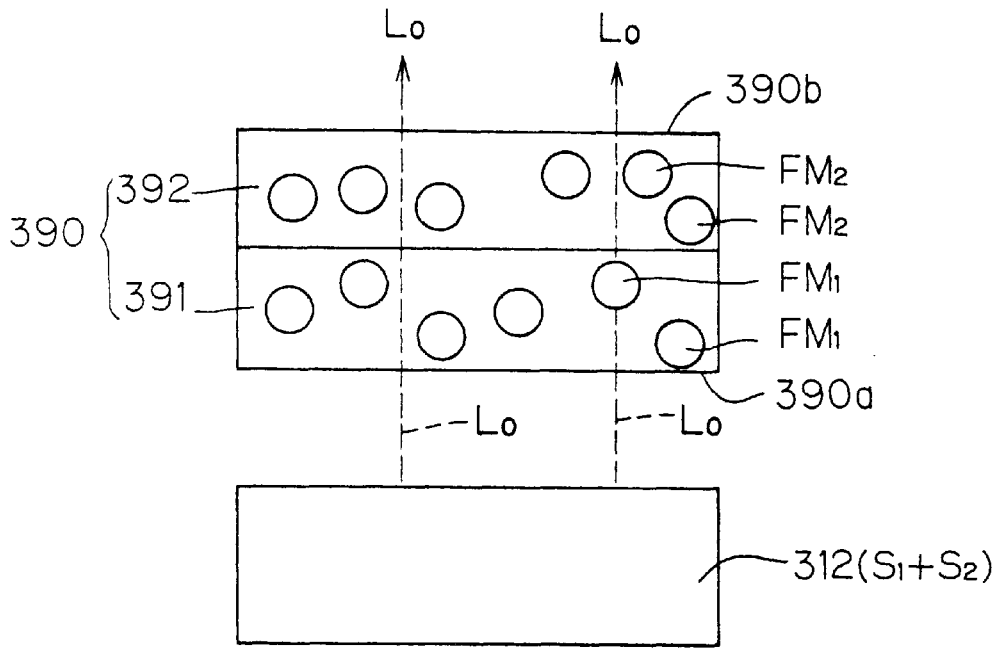
FIG. 43 is a schematic diagram showing optical characteristics of a fluorescent plate-layered body of FIG. 42 when the light of another wavelength different from the first wavelength is projected thereon.
Figure 44:
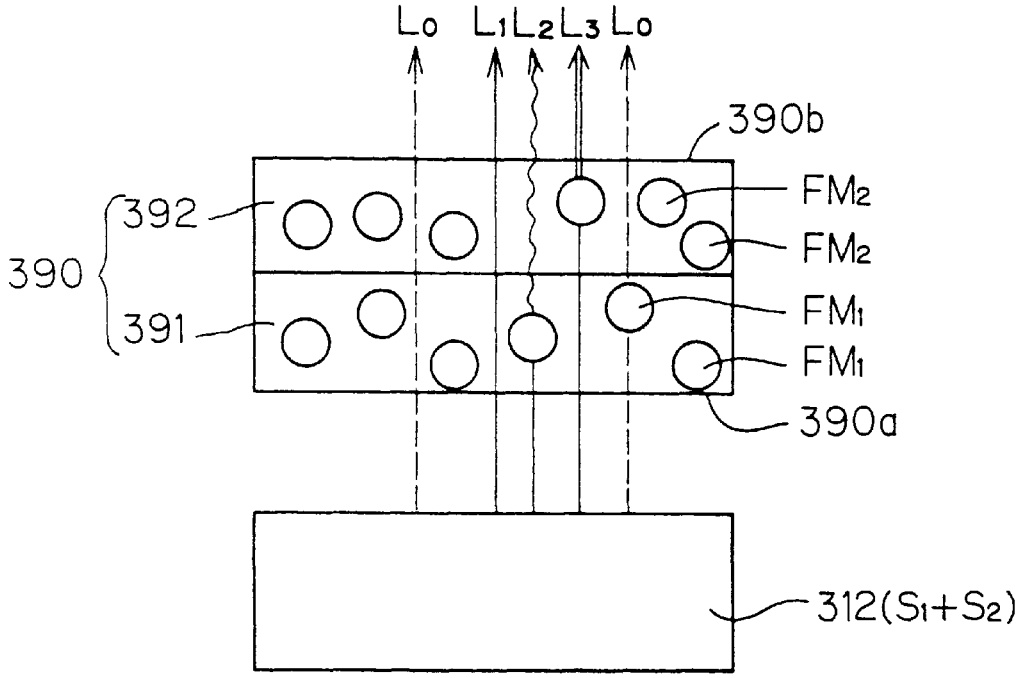
FIG. 44 is a schematic diagram showing optical characteristics of the fluorescent plate-layered body of FIG. 42 when both the lights of the first wavelength and another wavelength are projected thereon.

On the other hand, when only the second emitter S2 is turned on, the indication color is the color of another wavelength emitted from the second emitter S2 (FIG. 43), and when both the first and second emitters S1 and S2 are simultaneously turned on, the indication color is the mixed color of the colors of the lights L1 to L3 of the first to third wavelengths and the color of another wavelength (FIG. 44).

Though two fluorescent plates 391 and 392 are layered to constitute the fluorescent body 390, three or more fluorescent plates can be layered to constitute the fluorescent body 390. Further, the fluorescent plates can be layered in any order.

Variation of The Twelfth to Fourteenth Preferred Embodiment

Though the hologram diffusion plate 321 is disposed between the light source 312 and the fluorescent plate 322 in the twelfth preferred embodiment and the hologram diffusion plate 382 is disposed between the LED unit light source 54 and the fluorescent plate 83 in the thirteenth preferred embodiment, the position of the hologram diffusion plate is not limited to these, and the hologram diffusion plate may be disposed anywhere on the optical path of the light going from the light source towards the indicating surface. It is desirable, however, that the hologram diffusion plate should be placed on a side of the light source relative to the fluorescent plate in consideration of viewability. When the hologram diffusion plate is disposed thus, the light going through the hologram diffusion plate is projected into the fluorescent plate as a disperse light which is diffused at a predetermined angle and goes in various directions, to impinge on the fluorescent material with higher probability, and therefore an emission using the whole fluorescent plate is achieved to improve the viewability.

Though the hologram diffusion plate is used as a light diffusion member for diffusing the light going from the light source towards the indicating surface in the above, the conventional well-known light diffusion plate or the prism sheet 213 used in the seventh preferred embodiment may be used, instead of the hologram diffusion plate.

Though the light diffusion member such as the hologram diffusion plate is provided in the above preferred embodiments, the light diffusion member is not an indispensable element to control the indication color since the light diffusion member has no effect on the indication color. In order that an operator can easily recognize indication such as characters, however, it is desirable to provide the light diffusion member.

Further, additional provision of a filter near the light-outgoing surface of the fluorescent plate allows a change of the light color for optical indication. For example, in the indicator lamp or the illuminated push-button switch capable of making an optical indication of pure white as one of the indication colors, when a filter is additionally provided near the light-outgoing surface of the fluorescent plate 322 or 83, the indication color is changed into one using the light spectrum extracted through the filter among the light spectra projected from the fluorescent plate.

In this case, the indication color corresponding to another wavelength is changed depending on the color of the filter. For example, when a red light is used as the light of another wavelength and a yellow filter is used as a filter, a switching among three colors, i.e., yellow, a mixed color of yellow and red and a mixed color of yellow and pink.

As the first and second emitters S1 and S2, emitters which generate two lights having wavelengths shorter than the fluorescent wavelength of the fluorescent plate and different from each other may be used. For example, when a yellow fluorescent plate is used, a blue emitter and a green emitter which have wavelengths shorter than that of yellow. When any one of the emitters is turned on, part of the light is changed in wavelength to obtain an indication color different from the emission color of the emitter.

The number of kinds of emitters incorporated in the light source is not limited to two, and three or more kinds of emitters may be incorporated. In this case, one or more kinds of emitters are used as emitters for generating a light to be changed in wavelength by the fluorescent plate.

Further, though the twelfth to fourteenth preferred embodiments show the constitution where the second emitter S2 for emitting a light of another wavelength is additionally provided in the light source of the first to third preferred embodiments, there may be a constitution where the second emitter S2 is additionally provided in the light source of the fourth to sixth preferred embodiments.

Exemplary Experiments of The Twelfth to Fourteenth Preferred Embodiments

Since the kinds of colors of the indication lights obtained by the combination of the light of the first wavelength emitted by the first emitter S1 and the light of the second wavelength emitted by the fluorescent plate 322 which receives the light of the first wavelength when only the first emitter S1 is turned on among the first and second emitters S1 and S2 in the light source are the same as those of the first to sixth preferred embodiments, and no discussion will be made thereon.

Discussion will be made herein on a case where the first and second emitters S1 and S2 are turned on and off to obtain a plurality of kinds of indication colors. Further, the discussion will be made on a case where a plurality of kinds of indication colors include white and a case where all the indication colors are chromatic and respective spectra of the indication lights are shown in FIGS. 45 and 46.

Figure 45:
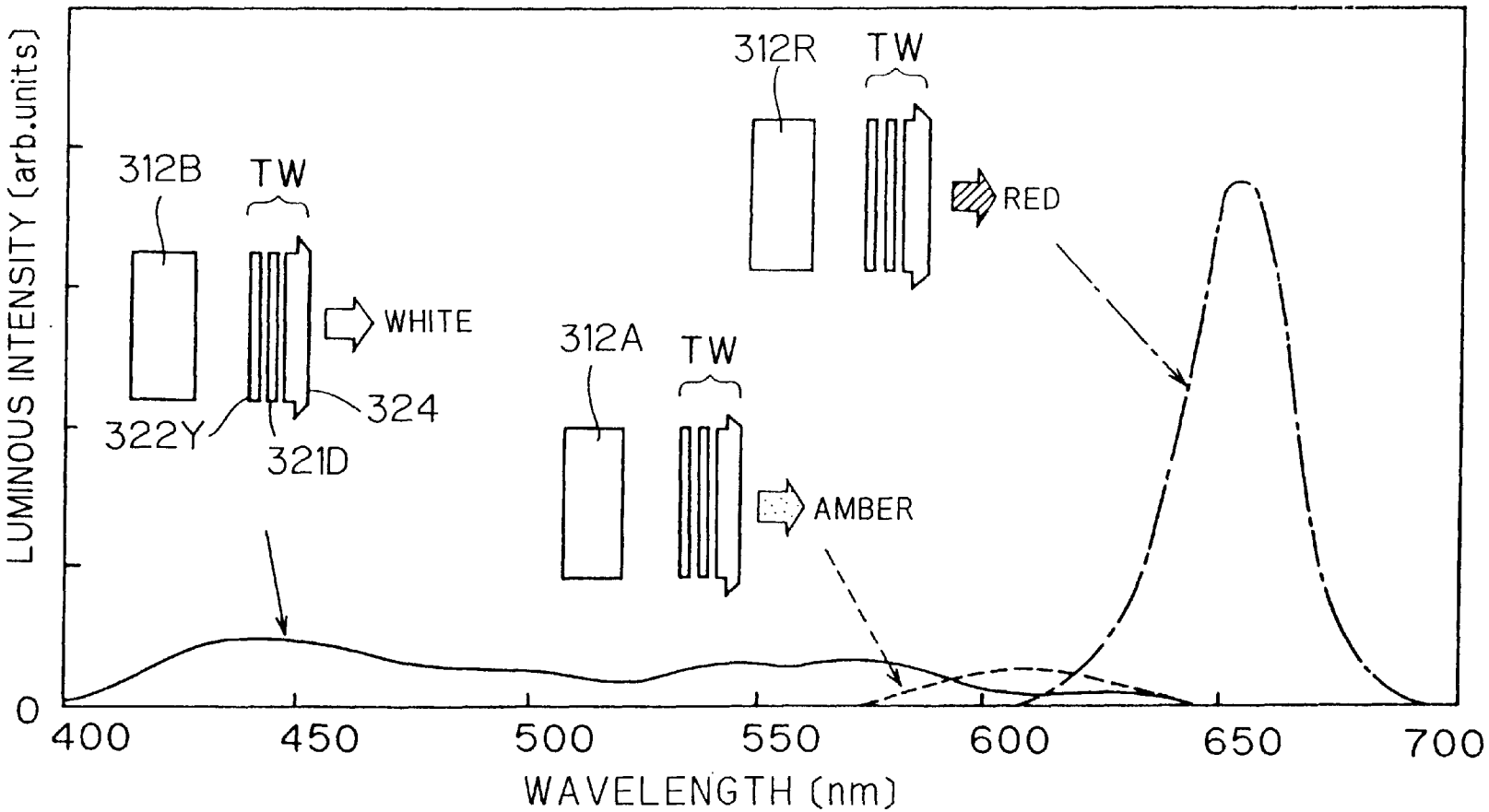
FIG. 45 is a graph showing fluorescence spectra from a yellow fluorescent plate when lights of various wavelengths enter the yellow fluorescent plate in an exemplary experiment of the twelfth to fourteenth preferred embodiments.
Figure 46:
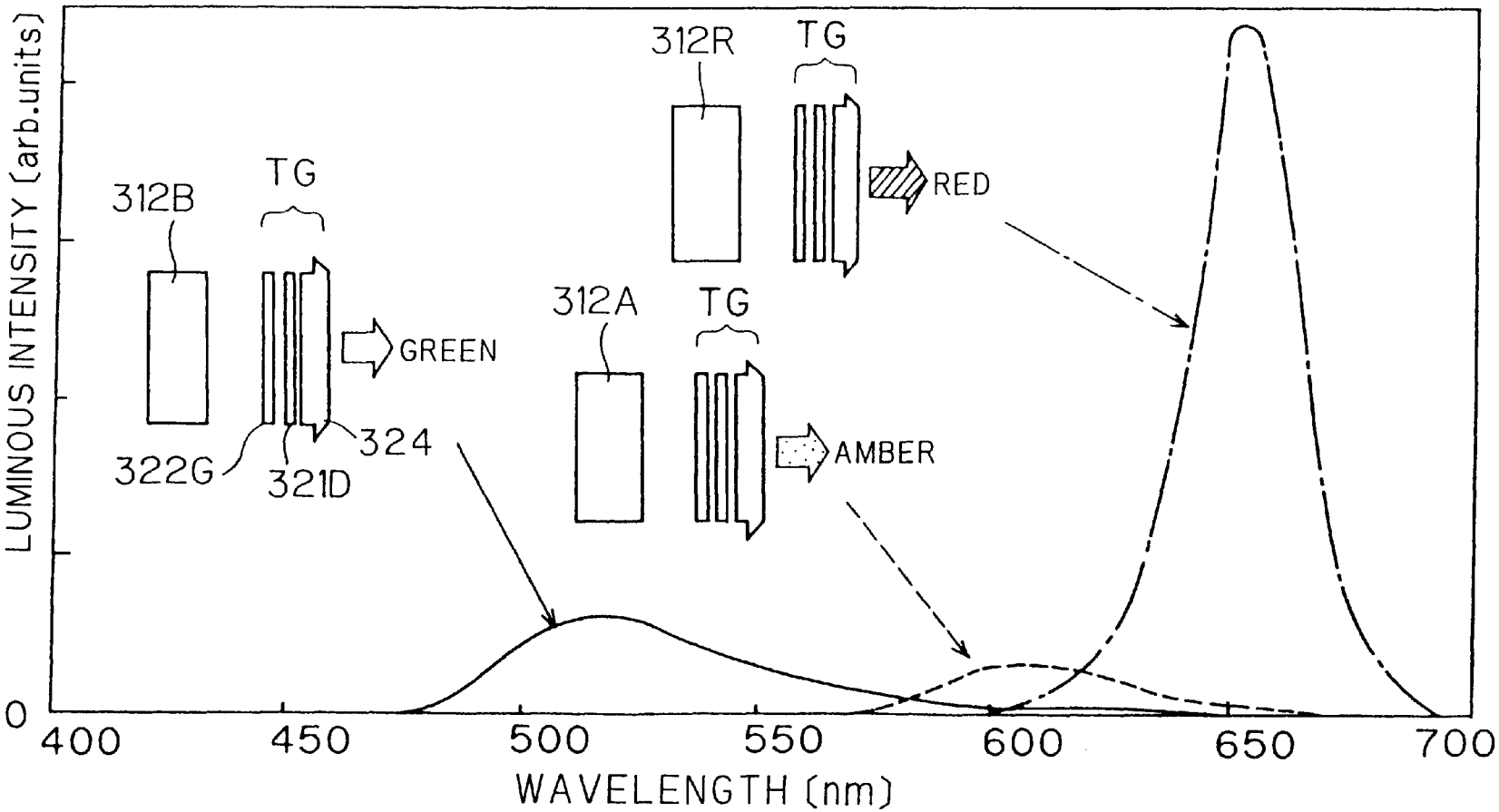
FIG. 46 is a graph showing fluorescence spectra from a green fluorescent plate when lights of various wavelengths enter the green fluorescent plate in the exemplary experiment of the twelfth to fourteenth preferred embodiments.

Among the wavelength changing units TW and TG used for the measurement, the wavelength changing unit TW of FIG. 45 is constituted of a yellow fluorescent plate 322Y like the yellow fluorescent plate 22 of Table 1, a milky-white diffusion plate 321D and a transparent cover plate 324, and the wavelength changing unit TG of FIG. 46 is constituted of a green fluorescent plate 322G like the green fluorescent plate of Table 2, the milky-white diffusion plate 321D and the transparent cover plate 324. Though these wavelength changing units TW and TG are not altogether the same as the constitution of FIG. 32, a color changing function by combination of the blue emitter S1 and the fluorescent plate 322Y or 322G can be sufficiently understood from a measurement result using the wavelength changing unit TW or TG.

Referring first to FIG. 45, this graph shows respective indication color spectra of three cases, i.e., use of a blue LED element 312B as the light source, use of a red LED element 312R and use of an amber LED element 312A. Among these, the blue LED element 312B has the same emitting spectrum as the blue LED elements of Tables 1 an d 2.

As can be seen from FIG. 45, when the blue LED element 312B is turned on, an almost flat spectrum is obtained in a wide range of 400 nm to 650 nm and an almost pure white indication color is achieved. Specifically, the fluorescent plate 322Y has a yellow fluorescent color, and the yellow fluorescent color has such a wide spectrum range that it becomes almost pure white when mixed with a blue light.

By contrast, when the amber LED element 312*a* is turned on, a spectrum having a peak near 600 nm is obtained and an amber indication color which is almost the same as the input light. When the red LED element 312R is turned on, a spectrum having a peak near 650 nm is obtained and a red indication color which is almost the same as the input light.

Therefore, when the blue LED element 312B is used as the first emitter S1 and the amber LED element 312A is used as the second emitter S2, a switching can be made among the three kinds of colors, i.e., pure white, amber and whity-amber. When the blue LED element 312B is used as the first emitter S1 and the red LED element 312R is used as the second emitter S2, a switching can be made among the three kinds of colors, i.e., pure white, red and whity-red (that is, pink).

Referring next to FIG. 46, this graph shows indication color spectra by the green fluorescent plate 322G in respective cases where the three kinds of emitters like in FIG. 45 are turned on. When the blue LED element 312B is turned on, a pure green indication color having a peak near 510 nm is a chieved. This green is purer than the green generated by the green LED element. By contrast, when the amber LED element 312A is turned on, a spectrum having a peak near 600 nm is obtained and an amber indication color which is almost the same as the input light is achieved. When the red LED element 312R is turned on, a spectrum having a peak near 650 nm is obtained and a red indication color which is almost the same as the input light is achieved.

Therefore, when the blue LED element 312B is used as the first emitter S1 and the amber LED element 312A is used as the second emitter S2, a switching can be made among the three kinds of colors, i.e., pure green, amber and additively-mixed color of green and amber. When the blue LED element 312B is used as the first emitter S1 and the red LED element 312R is used as the second emitter S2, a switching can be made among the three kinds of chromatic colors, i.e., pure green, red and additively-mixed color of red and green (broadly, a color ranging from a yellow region to an orange region).

Thus, with the optical characteristics of the fluorescent plate to change part of the light of the first wavelength into the light of the second wavelength longer than the first wavelength while substantially transmitting the light having a wavelength longer than the intrinsic fluorescent color, it is possible to switch the indication color among a plurality of colors.

Further, when a plurality of kinds of emitters each of which can emit a plurality of lights having wavelengths shorter than the fluorescent wavelength are placed in the light source and the emitters are selectively turned on, it becomes possible to switch the indication color among a plurality of colors which the LED element can not achieve by itself.

For example, a light source having two kinds of LED elements, i.e., the LED element emitting an ultraviolet light and that emitting a blue light, is used and a light generated by selectively turning these LED elements is projected through a yellow fluorescent plate. When only the LED element emitting the ultraviolet light is turned on, part of the generated ultraviolet light is changed into a yellow light through the fluorescent plate and the rest of the light goes through the fluorescent plate as the unchanged ultraviolet light. Since the ultraviolet light is invisible as well known, an externally observable color is yellow when only the LED element emitting the ultraviolet light is turned on.

On the other hand, when only the LED element emitting the blue light is turned on, part of the generated blue light is changed into a yellow light through the fluorescent plate and the rest of the light goes through the fluorescent plate as the unchanged blue light. A white indication color is thereby externally observed.

Therefore, in this example, by selectively turning on the two kinds of LED elements, a switching of the indication light can be made between yellow and blue.

The Fifteenth Preferred Embodiment

Figure 47:
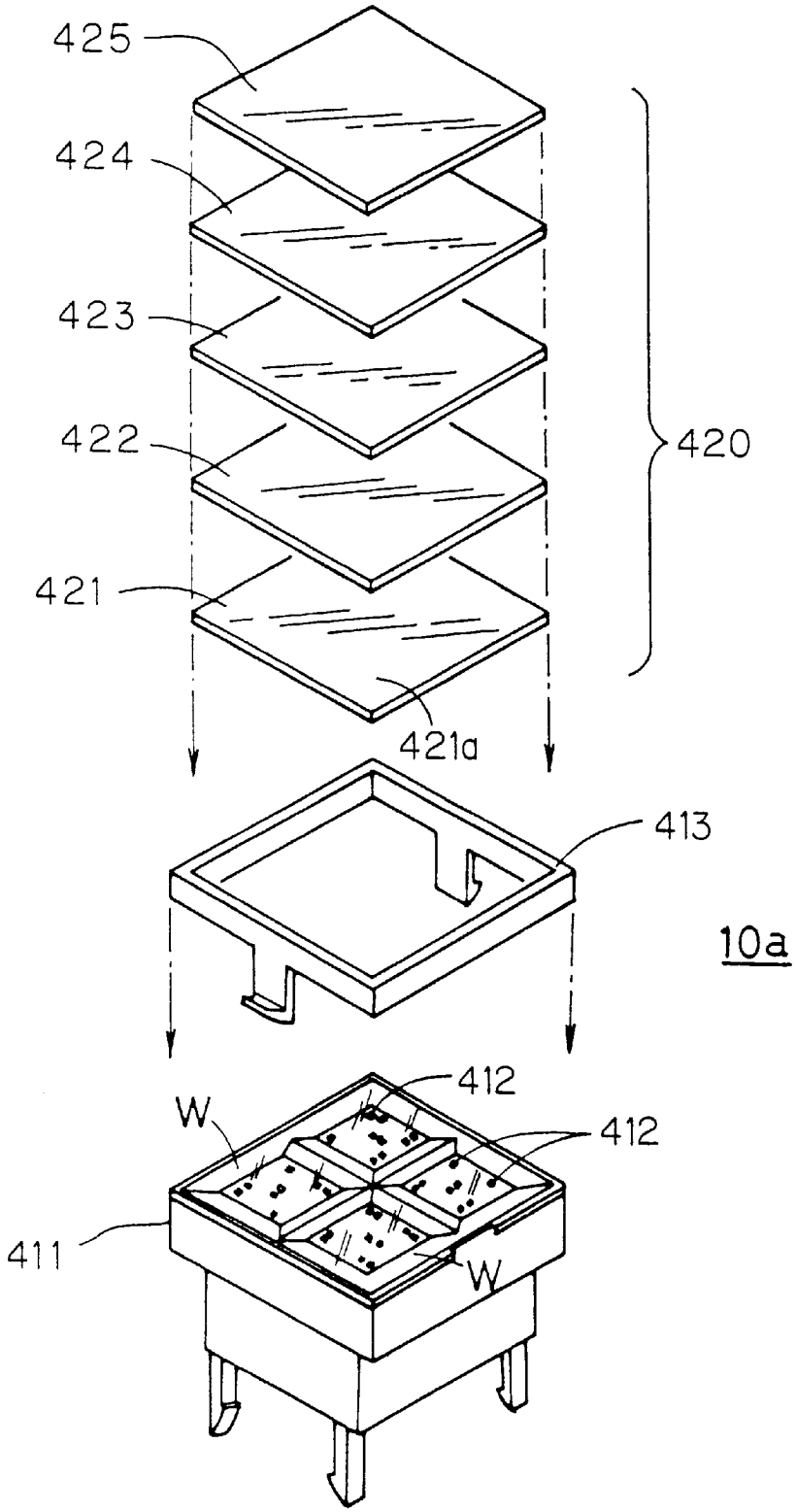
FIG. 47 is an explored perspective view of a unit indicator lamp to which a fifteenth preferred embodiment of the indicator device in accordance with the present invention is applied.
Figure 48:
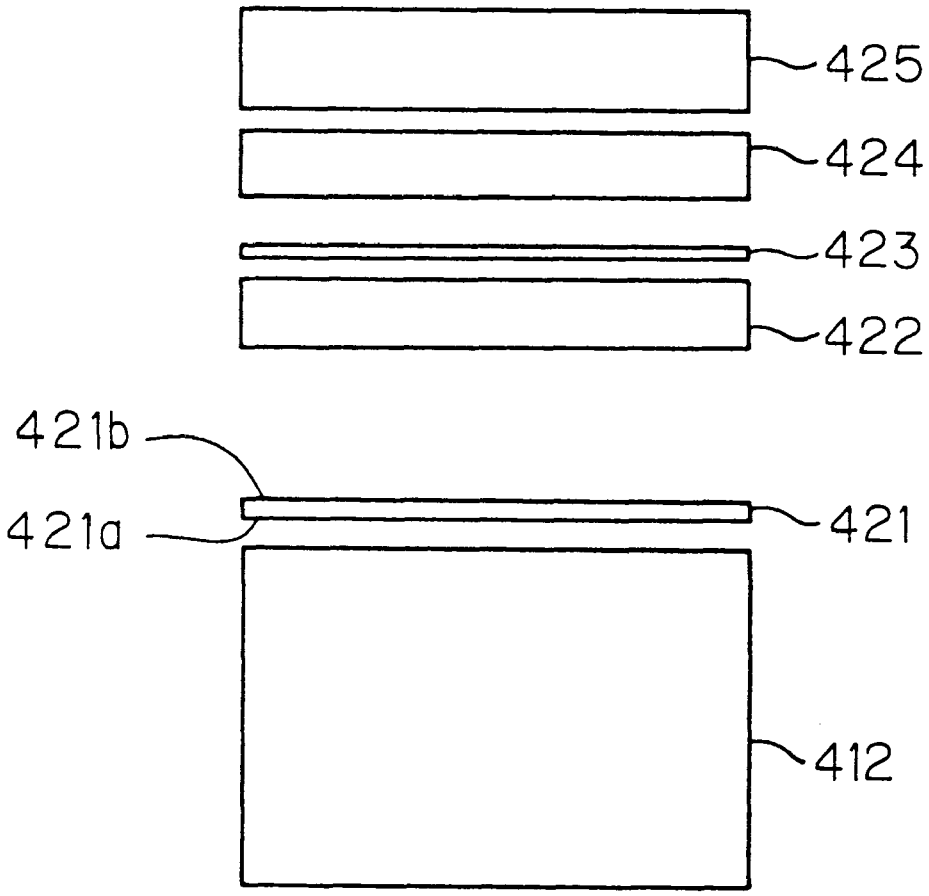
FIG. 48 is a schematic cross section of the unit indicator lamp of FIG. 47.

FIG. 47 is an explored perspective view of the unit indicator lamp 10*a* to which the fifteenth preferred embodiment of the indicator device (surface-illuminated indicator device) in accordance with the present invention is applied. FIG. 48 is a schematic cross section of the unit indicator lamp lea of FIG. 47. In the unit indicator lamp 10*a*, a plurality of light sources 412 (LED elements) are arranged in a matrix inside a resin case 411 having the window W. Each of the light sources 412 is mounted on the major surface of the print board and accommodated in the case 411, and its light-emitting part is exposed towards the upper surface of the case 411. The LED elements constituting the light source 412 each emit a light of any one of wavelengths ranging from the ultraviolet region to blue (the first wavelength), herein a light of blue wavelength.

On the other hand, a frame 413 is disposed in an upper periphery of the window W. The frame 413 is fit in the housing 2 of FIG. 1 with the case 411 therebetween, and a compound plate 420 is fit into the frame 413. The compound plate 420 is constituted of five layered plates:

① a fluorescent plate 421 (wavelength changing member);

② an inscription plate 422 made of transparent resin;

③ a filter 423;

④ a milky-white diffusion plate 424 (light diffusion member); and

⑤ a cover plate 425 made of transparent resin, from the side of the light source 412. On the inscription plate 422, characters and signs to be represented are inscribed.

Among them, the fluorescent plate 421 and the filter 423 are provided in accordance with a main characteristic feature of the present invention. The fluorescent plate 421 has a light-incident surface 421*a* receiving a light from the light source 412 and a light-outgoing surface 421*b* facing the indicating surface (the upper side of this figure). The fluorescent plate 421 receives a light of the first wavelength incident through the light-incident surface 421*a* and emits a light of the second wavelength longer than the first wavelength to be projected from the light-outgoing surface 421*b*. The filter 423 removes the light of the first wavelength which goes through the fluorescent plate 421 among the light projected from the light-outgoing surface 421*b* of the fluorescent plate 421 and substantially transmits only the light of the second wavelength. This optical phenomenon is schematically shown in FIG. 49.

Figure 49:
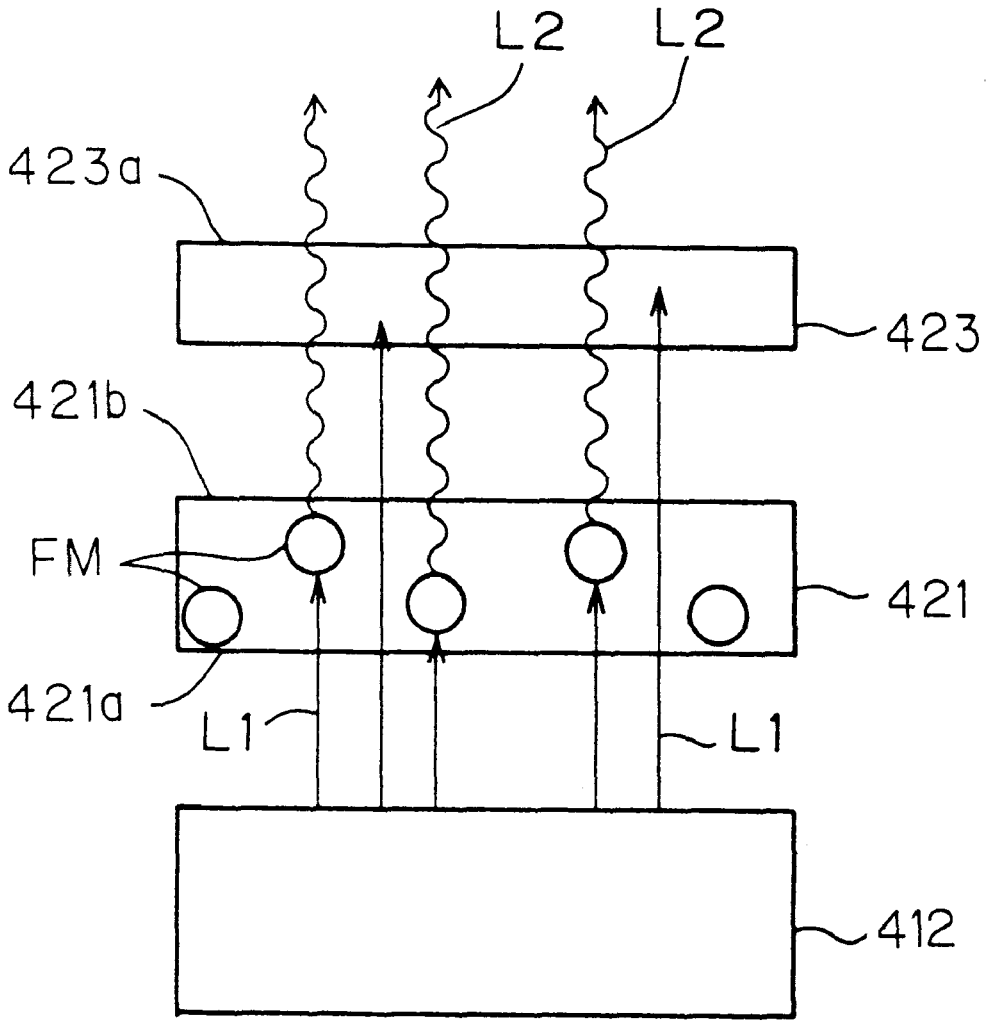
FIG. 49 is a schematic diagram showing optical characteristics of a fluorescent plate provided in the indicator device of FIG. 47.

FIG. 49 is a schematic diagram showing optical characteristics of the fluorescent plate 421 and the filter 423. The fluorescent plate 421 has the same structure as the fluorescent plate 22 of the first preferred embodiment, and corresponding elements are given the same reference signs and discussion will be omitted thereon. The filter 423 removes the light L1 of the first wavelength which goes through the fluorescent plate 421 and transmits only the light L2 of the second wavelength towards the indicating surface as the indication light.

The light L1 of the first wavelength projected to the filter 423 is sufficiently attenuated until it reaches a surface 423*a* of the filter 423 on the side of the indicating surface, not going through the filter 423 while the light L2 of the second wavelength is hardly attenuated to go through the filter 423. Therefore, a light made of the light L2 of the second wavelength is projected from the surface 423*a* of the filter 423.

Referring next back to FIG. 47, when the light emitted from the light source 412 enters the fluorescent plate 421, the fluorescent plate 421 receiving the light of the first wavelength emits the light of the second wavelength. The light of the second wavelength and the light of the first wavelength which goes through the fluorescent plate 421 are projected into the filter 423 through the inscription plate 422. The filter 423 removes the light of the first wavelength among the lights of the first and second wavelengths and only the light of the second wavelength is substantially projected from the surface 423*a* of the filter 423. The light of the second wavelength which goes through the filter 423 is guided towards the indicating surface through the milky-diffusion plate 424 and the cover plate 425, to make an optical indication.

Thus, since the light for optical indication on the indicating surface is substantially made of the light of the second wavelength, not including the light of the first wavelength, the indicator lamp 10*a* (surface-illuminated indicator device) of this preferred embodiment can purely take the color of the light of the second wavelength emitted by the fluorescent plate 421 as the color of the light for optical indication. As a result, a color of light with higher chroma can be obtained as compared with, for example, a method of obtaining a desired color light by superposing a plurality of kinds of lights having different wavelengths.

Further, by providing a plurality of kinds of fluorescent plates 421 receiving the light of the first wavelength, herein a blue light, to emit various-color lights of the second wavelengths (e.g., red, yellow, orange, green and the like) and a plurality of kinds of filters 423 according to the kinds of fluorescent plate 421 and selecting the fluorescent plate 421 and the filter 423 to be used among them according to the color of the desired indication light, it is possible to obtain the various-color lights which can not be achieved by a single kind of LED element from the light of the first wavelength, herein the blue light, emitted by the light source 412. As a result, since the indication light of desired color can be obtained from the light of the first wavelength (blue light) simply by changing the fluorescent plate 421 and the filter 423, it is possible to ensure higher productivity and lower cost as compared with, for example, a method of changing the combination of the kinds of LED elements to be used according to the color of the indication light. The combination of the fluorescent plate 421 and the filter 423 will be discussed later, taking specific examples of experiment.

Further, in this preferred embodiment, the light from the filter 423 is diffused by the milky-white diffusion plate 424 and thereafter projected towards the indicating surface through the cover plate 425 and that can reduce variation in the amount of light on the indicating surface.

Moreover, this preferred embodiment can produce lights of various colors from the light of the first wavelength since the light of the first wavelength is a light of short wavelength which has any one of wavelengths ranging from ultraviolet region to blue, herein the blue light.

Though the milky-white diffusion plate 424 is used as a diffusion plate in this preferred embodiment, the hologram diffusion plate 21 as discussed earlier may be used instead of or in addition to the milky-white diffusion plate 424. Further, though the milky-white diffusion plate 424 is provided on a side of the indicating surface relative to the fluorescent plate 421, the inscription plate 422 and the filter 423, the position thereof is not limited to this and the diffusion plate 424 may be provided anywhere on the optical path from the light source 412 to the cover plate 425.

The Sixteenth Preferred Embodiment

Figure 50:
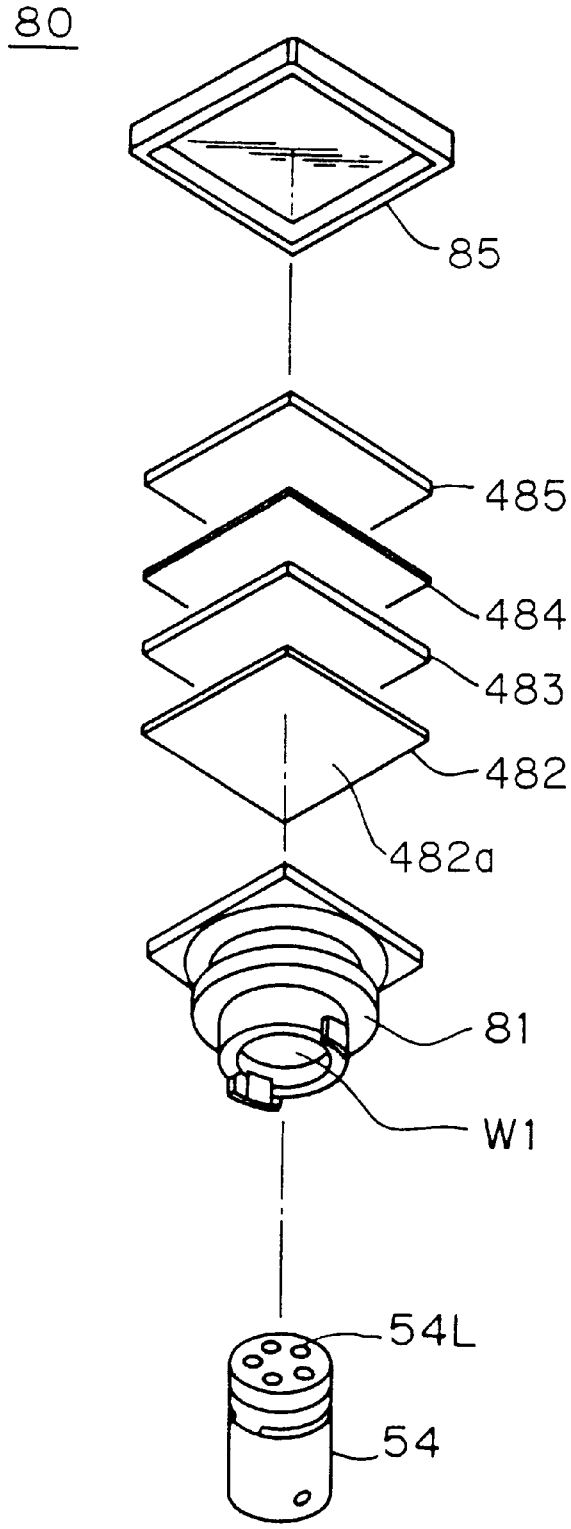
FIG. 50 is a partly-explored perspective view showing an illuminated push-button switch to which a sixteenth preferred embodiment of the indicator device in accordance with the present invention is applied.

FIG. 50 is a partly-explored perspective view showing an illuminated push-button switch to which the sixteenth preferred embodiment of the indicator device (surface-illuminated indicator device) in accordance with the present invention is applied. The illuminated push-button switch of this preferred embodiment has the same constitution as that of the second preferred embodiment shown in FIGS. 5 and 6 except that a compound plate fit in a front portion of the push unit 80 has a different structure, and corresponding elements are given the same reference signs and will not be discussed.

As shown in FIG. 50, the push unit 80 has a hollow base 81 having the transmission hole W1 at its lower portion and is provided thereon with a compound plate constituted of layered plates:

① a fluorescent plate 482 having the same fluorescent characteristics as the fluorescent plate 421 of the fifteenth preferred embodiment;

② a colorless and transparent inscription plate 483 made of a resin such as an acrylic resin; and ③ a filter 484; and ④ a hologram diffusion plate 485.

Further, a colorless and transparent front plate 85 made of e.g., an acrylic resin is provided as a member to define the operation surface 80S of FIG. 50. On the inscription plate 483, desired characters and the like are inscribed.

The LED unit light source 54 is inserted so as to be opposed to the fluorescent plate 482 with the transmission hole W1 therebetween. Therefore, when the LED unit light source 54 is turned on, the light of the first wavelength from the LED elements 54L is projected onto a light-incident surface 482*a* of the fluorescent plate 482. The incident light is changed in wavelength into the light of the second wavelength longer than the first wavelength by the fluorescent material (not shown) of the fluorescent plate 482 and projected from a light-outgoing surface, sequentially going through the inscription plate 483, the filter 484 and the diffusion plate 485, to make a surface-illuminated indication on the indicating surface side with an indication color defined by the second wavelength. The filter 484 has the same optical characteristics as the filter 423 of the fifteenth preferred embodiment, to transmit only the light of the second wavelength. The light of the first wavelength going through the fluorescent plate 482 without being changed in wavelength is removed by the filter 484 and substantially only the light of the second wavelength is projected from the light-outgoing surface of the filter 484.

Thus, the sixteenth preferred embodiment produces the same effect as the fifteenth preferred embodiment, of obtaining an indication light of any color with higher chroma from the light (the light of the first wavelength) from a single-colored light source and ensuring higher productivity and lower cost and the like.

The Seventeenth Preferred Embodiment

Figure 51:
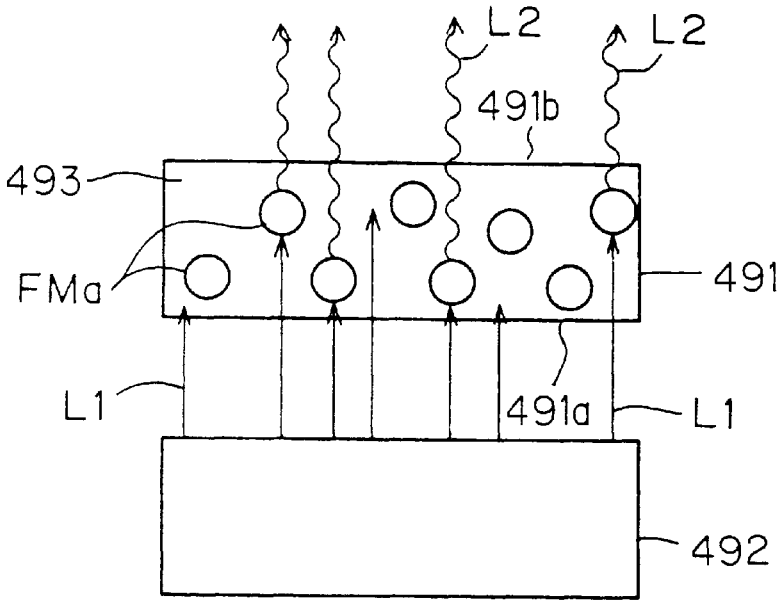
FIG. 51 is a schematic cross section showing a seventeenth preferred embodiment of the indicator device in accordance with the present invention.

FIG. 51 is a schematic cross section showing the seventeenth preferred embodiment of the indicator device (surface-illuminated indicator device) in accordance with the present invention. This surface-illuminated indicator device uses a wavelength changing plate 491 (wavelength changing member), instead of the fluorescent plates 421 and 482 and the filters 423 and 484 of the fifteenth and sixteenth preferred embodiments, and the LED element emitting the light of blue wavelength (the first wavelength) in a light source 492 like these preferred embodiments.

The wavelength changing plate 491 includes a base 493 and a fluorescent material FMa mixed in the base 493, which has the same fluorescent characteristics as the fluorescent material FM of the fifteenth petered embodiment. The base 493 of the wavelength changing plate 491 is colored into a predetermined color by mixing a colorant in a transparent resin such as an acrylic resin. The light of the predetermined color (the light of the second wavelength) among the lights projected to the base 493 goes through the base 493 almost without being attenuated and the light other than that of the predetermined color is attenuated in the base 493 to hardly go through the base 493. Further, since the fluorescent material FMa is mixed in the base 493, when the light L1 of the first wavelength enters the wavelength changing plate 491 through a light-incident surface 491*a*, the fluorescent material FMa receives the light L1 of the first wavelength and emits the light L2 of the second wavelength longer than the first wavelength, and substantially only the light L2 of the second wavelength is projected from the light-outgoing surface 491*b*.

Figure 52:
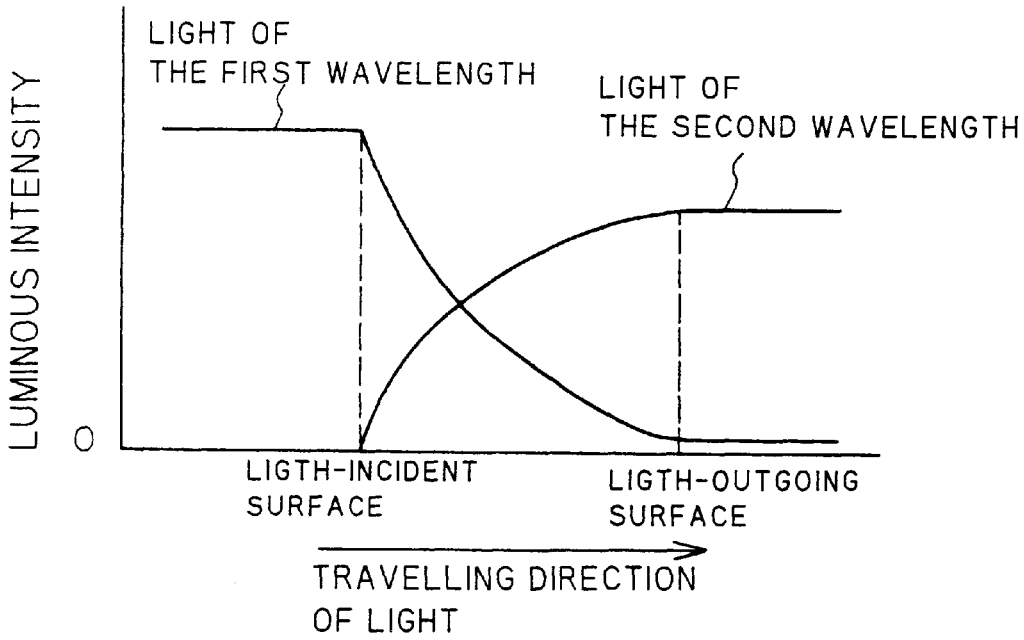
FIG. 52 is a view showing a change of the light of the first wavelength into a light of the second wavelength by a wavelength changing plate of the seventeenth preferred embodiment.

FIG. 52 is a view showing a change of the light of the first wavelength into a light of the second wavelength. In this figure, the horizontal axis indicates a travelling direction of a light and the vertical axis indicates a luminous intensity. As shown in this figure, the light of the first wavelength projected to the wavelength changing plate 491 is attenuated by the base 493 and at the same time goes through the base 493 while being changed into the light of the second wavelength by the fluorescent material FMa. As a result, the incident light of the first wavelength has an luminous intensity of almost zero at the point of time when it reaches the light-outgoing surface 491*b*. On the other hand, the light of the second wavelength increases in luminous intensity from the side of the light-incident surface 491*a* towards the side of the light-outgoing surface 491*b*. As a result, substantially only the light of the second wavelength is projected from the light-outgoing surface 491*b*.

The seventeenth preferred embodiment also produces the same effect as the fifteenth preferred embodiment, of obtaining an indication light of any color with higher chroma from the light (the light of the first wavelength) from a single-colored light source and ensuring higher productivity and lower cost and the like, and a further effect of ensuring size reduction and lower cost resulting from reduction in the number of parts since the change of the light of the first wavelength into the light of the second wavelength can be made by only one wavelength changing plate 491.

The Eighteenth Preferred Embodiment

Figure 53:
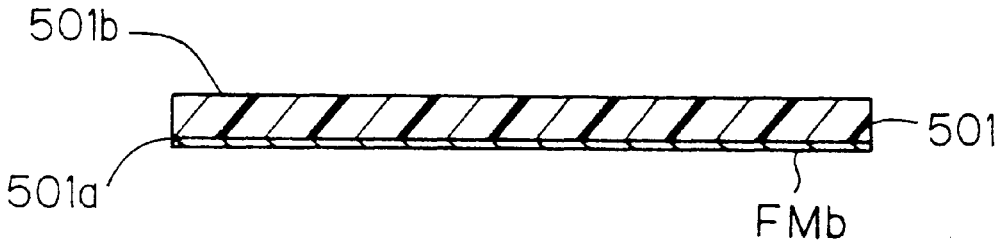
FIG. 53 is a cross section showing a structure of a filter of an eighteenth preferred embodiment of the indicator device in accordance with the present invention.

FIG. 53 is a cross section showing a structure of a filter of the eighteenth preferred embodiment of the indicator device (surface-illuminated indicator device) in accordance with the present invention. This surface-illuminated indicator device uses a fluorescent material FMb coating a light-incident surface 501*a* of a filter 501, instead of using the fluorescent plates 421 and 482 of the fifteenth and sixteenth preferred embodiments, and the LED element emitting the light of blue wavelength (the first wavelength) in a light source (not shown) like these preferred embodiments.

The fluorescent material FMb has the same fluorescent characteristics as the fluorescent materials FM and MFa as discussed above, to receive the light of the first wavelength from the light source and emit the light of the second wavelength longer than the first wavelength. The filter 501 substantially transmits only the light of the second wavelength. As a result, the light of the first wavelength going through the fluorescent material FMb coating the light-incident surface 501*a* is sufficiently attenuated while going through the filter 501 and is hardly projected from a light-outgoing surface 501*b* of the filter 501. By contrast, the light of the second wavelength emitted by the fluorescent material FMb is hardly attenuated while going through the filter 501. Therefore, substantially only the light of the second wavelength is projected from the light-outgoing surface 501*b* of the filter 501.

The surface-illuminated indicator device of the eighteenth preferred embodiment also produces the same effect as the fifteenth preferred embodiment, of obtaining an indication light of any color with higher chroma from the light (the light of the first wavelength) from a single-colored light source and ensuring higher productivity and lower cost and the like, and a further effect of ensuring size reduction and lower cost resulting from reduction in the number of parts since the change of the light of the first wavelength into the light of the second wavelength can be made by only one filter 501 coated with the fluorescent material FMb.

The Nineteenth Preferred Embodiment

Figure 54:
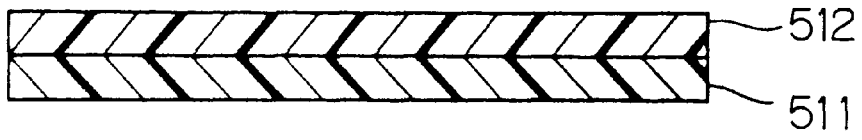
FIG. 54 is a cross section showing a structure of a fluorescent plate and a filter of a nineteenth preferred embodiment of the indicator device in accordance with the present invention.

FIG. 54 is a cross section showing a fluorescent plate and a filter used in the indicator device (surface-illuminated indicator device) in accordance with the nineteenth preferred embodiment of the present invention. In this surface-illuminated indicator device, a fluorescent plate 511 having the same fluorescent characteristics as the fluorescent plates 421 and 482 and a filter 512 having the same characteristics as the filters 423 and 484 are layered, being formed as a unity, and the LED element emitting the light of blue wavelength (the first wavelength) is used as the light source (not shown) like the above preferred embodiments.

The filter 512 is disposed on the side of a light-outgoing surface of the fluorescent plate 511 and only the light of the second wavelength longer than the first wavelength emitted by the fluorescent plate 511 which receives the light of the first wavelength from the light source is substantially projected from a light-outgoing surface of the filter 512.

The surface-illuminated indicator device of nineteenth preferred embodiment also produces the same effect as the fifteenth preferred embodiment, of obtaining an indication light of any color with higher chroma from the light (the light of the first wavelength) from a single-colored light source and ensuring higher productivity and lower cost and the like, and a further effect of reducing the number of parts and simplifying a fabrication process since the fluorescent plate and the filter are formed as a unity.

Exemplary Experiments of The Fifteenth to Nineteenth Preferred Embodiments

In the following exemplary experiments, using five kinds of fluorescent plates and filters, a study is made on what kind of light (the light of the second wavelength) is obtained by changing the light of the first wavelength when the light of the first wavelength is actually projected into each of the fluorescent plates and filters.

Figure 55:
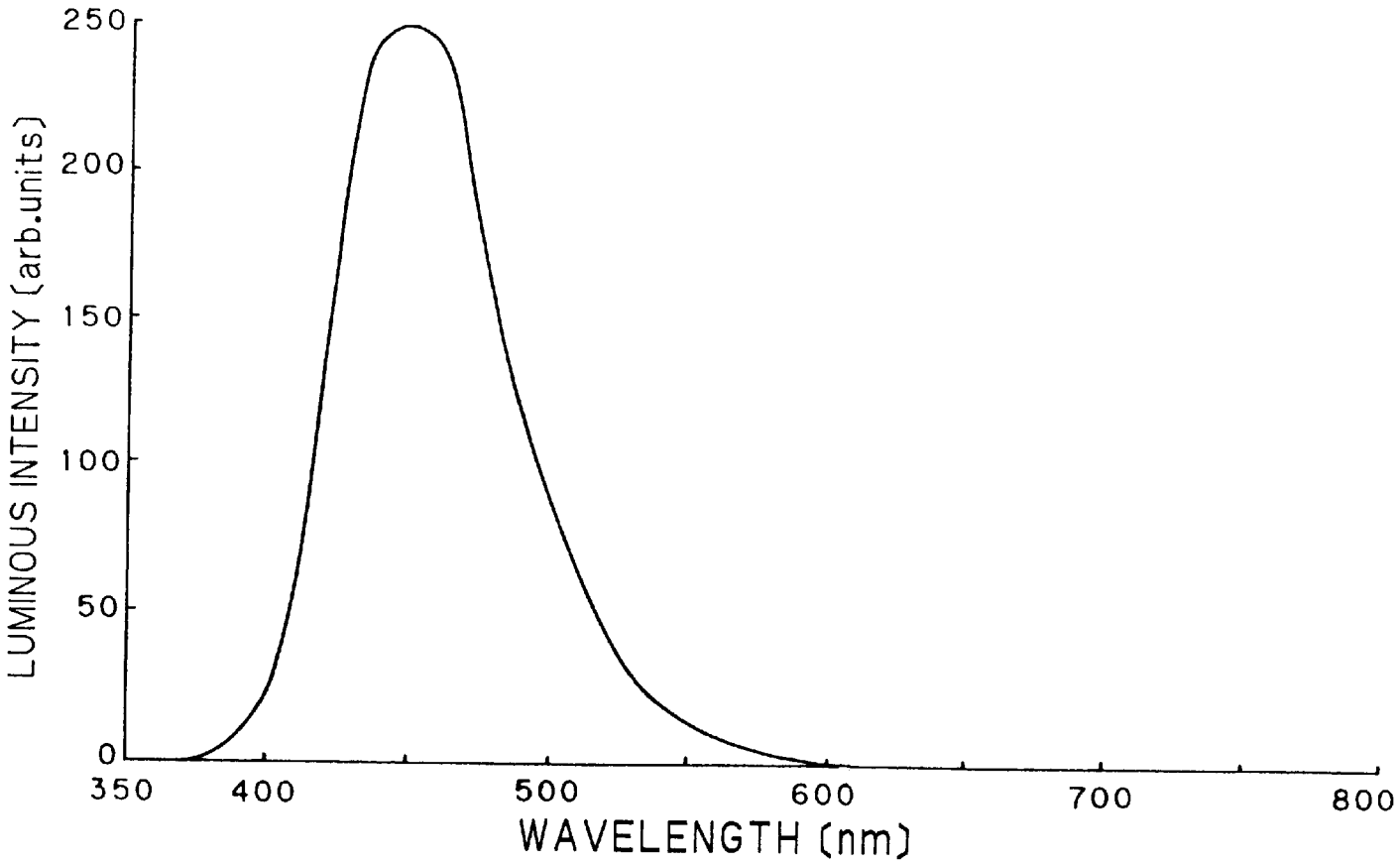
FIG. 55 is a graph showing a light spectrum emitted from the blue LED element in an exemplary experiment of the fifteenth to nineteenth preferred embodiments.
Figure 56:
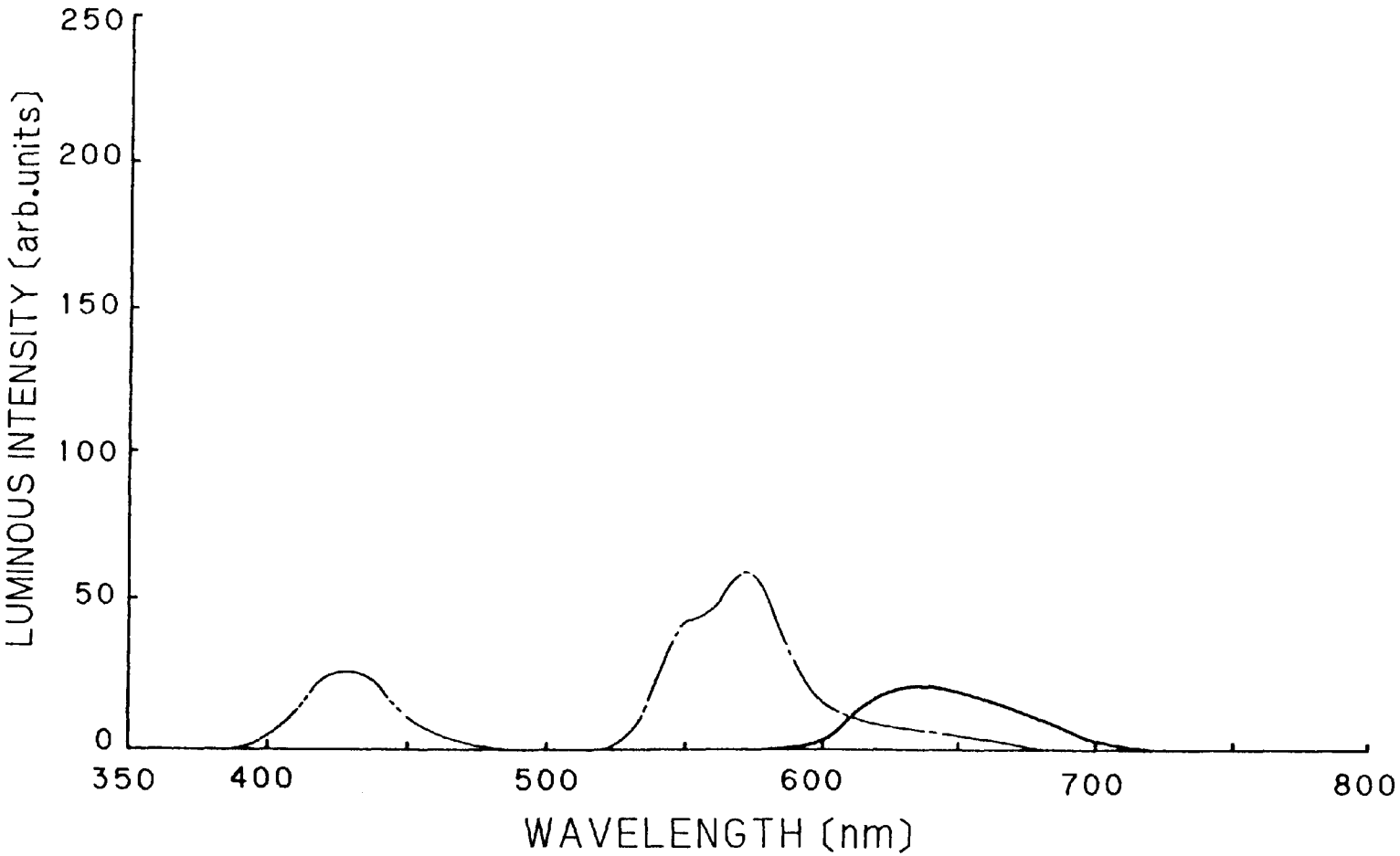
FIGS. 56 and 57 are graphs each showing fluorescence spectra (spectra of the light of the second wavelength) obtained from the light (of the first wavelength) from the blue LED element in the exemplary experiment of the fifteenth to nineteenth preferred embodiments.
Figure 57:
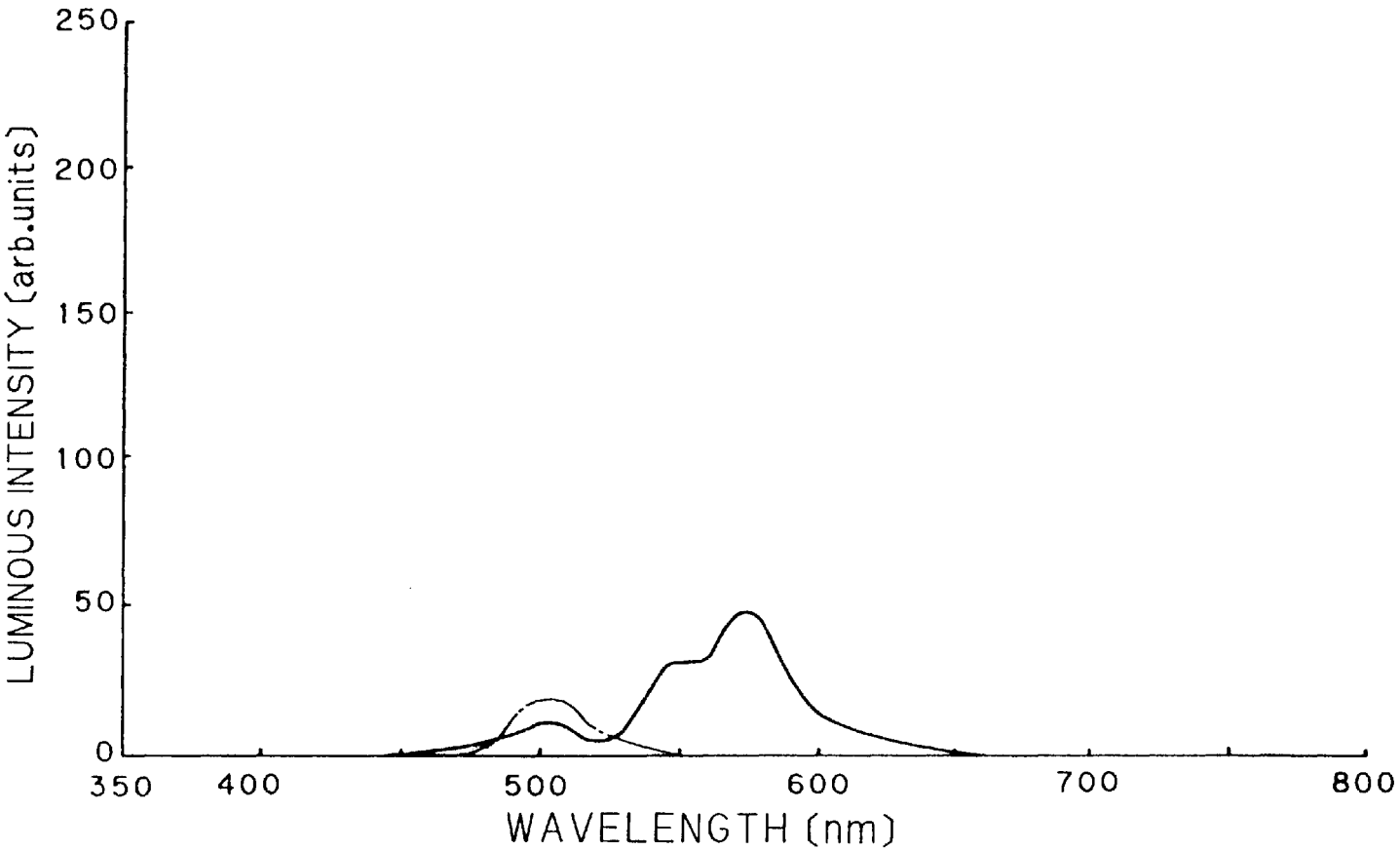

In each of the exemplary experiments, the LED element emitting the light of blue wavelength is used in the light source. The light of blue wavelength emitted from the LED element has a spectrum indicated by a solid line of FIG. 55 and its color is represented using a chromaticity coordinate of the CIEXYZ calorimetric system of color representation as x=0.131 and y=0.120. In each of the exemplary experiments, the light emitted from the light source is guided to a compound plate having the same constitution as the compound plate 420 of the fifteenth preferred embodiment constituted of a fluorescent plate, an inscription plate made of a transparent resin, a filter, a milky-white diffusion plate and a cover plate, and the light of the second wavelength projected from the cover plate is studied. In FIGS. 55 to 57, the vertical axis indicates a luminous intensity and the horizontal axis indicates a wavelength of light.

In the first exemplary experiment, a sample A is used as the fluorescent plate and a red filter is used as the filter. As a result, a red light having a spectrum indicated by a solid line of FIG. 56 and represented as x=0.692 and y=0.280 in the chromaticity coordinate is obtained.

In the second exemplary experiment, a sample B is used as the fluorescent plate and a yellow filter is used as the filter. As a result, a yellow light having a spectrum indicated by a one-dot chain line of FIG. 56 and represented as x=0.476 and y=0.516 in the chromaticity coordinate is obtained.

In the third exemplary experiment, a sample C is used as the fluorescent plate and a red filter is used as the filter. As a result, a red light having a spectrum indicated by a two-dot chain line of FIG. 56 and represented as x=0.386 and y=0.133 in the chromaticity coordinate is obtained.

In the fourth exemplary experiment, a sample D is used as the fluorescent plate and a yellow filter is used as the filter. As a result, a yellow light having a spectrum indicated by a solid line of FIG. 57 and represented as x=0.473 and y=0.491 in the chromaticity coordinate is obtained.

In the fifth exemplary experiment, a sample E is used as the fluorescent plate and a green filter is used as the filter. As a result, a green light having a spectrum indicated by a one-dot chain line of FIG. 57 and represented as x=0.131 and y=0.630 in the chromaticity coordinate is obtained.

As can be seen from the above experiment results, it is possible to obtain a light of various colors from the blue light of the light source by changing the kinds of fluorescent plate and filter to be used.

The Twentieth Preferred Embodiment

Figure 58:
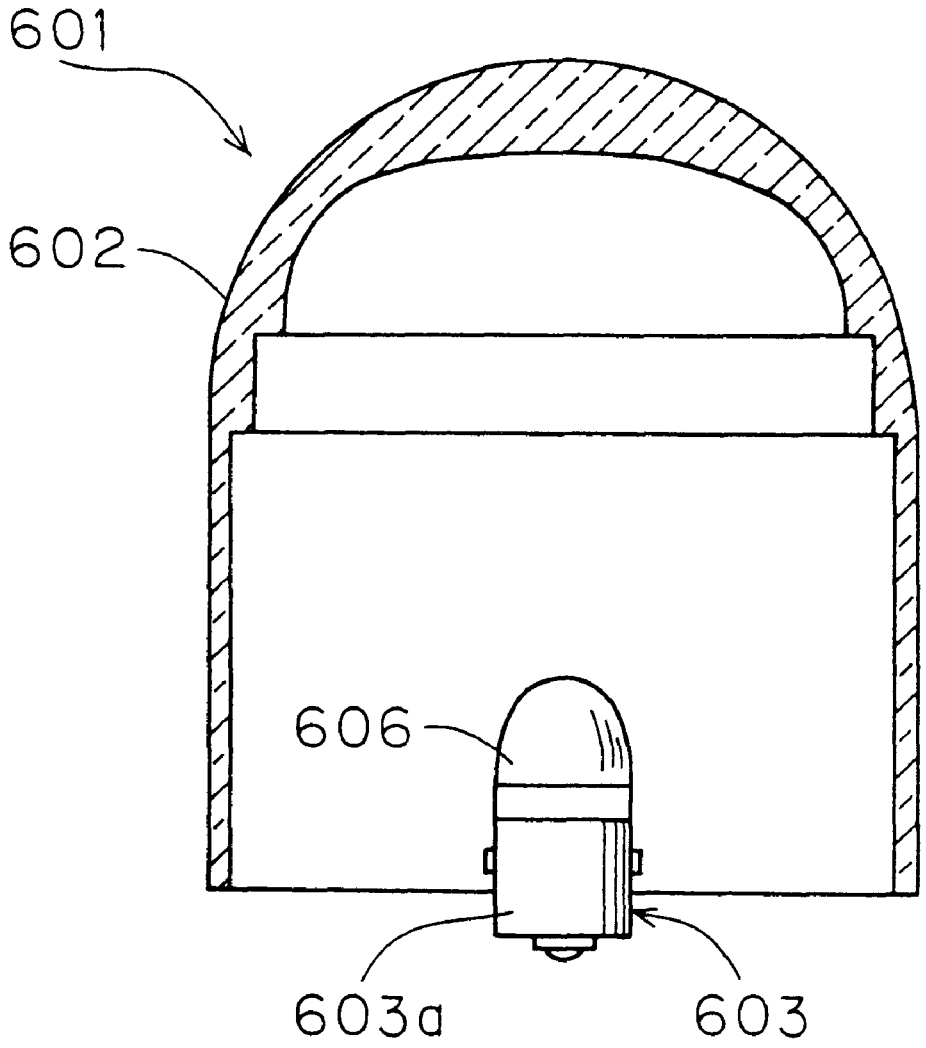
FIG. 58 is a cross section showing an indicator to which an LED bulb in accordance with a twentieth preferred embodiment of the present invention is applied.
Figure 59:
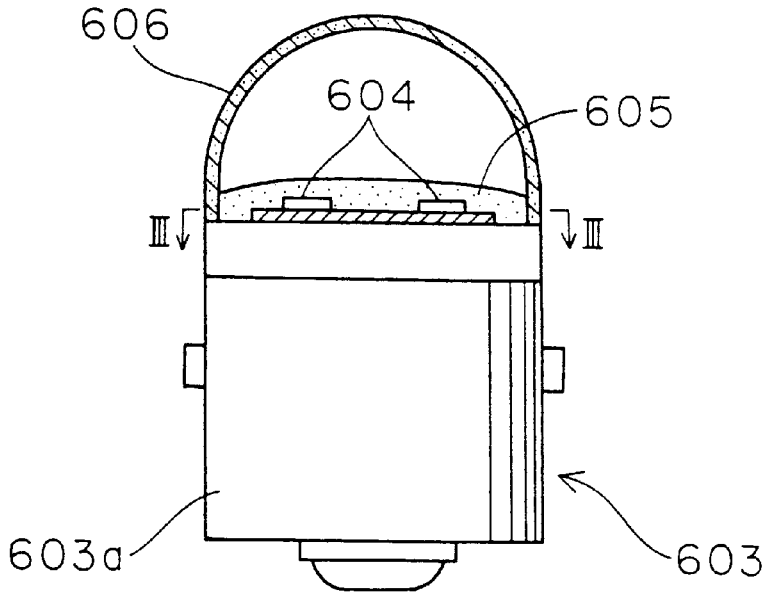
FIG. 59 is an enlarged cross section showing the LED bulb in accordance with the twentieth preferred embodiment of the present invention.
Figure 60:
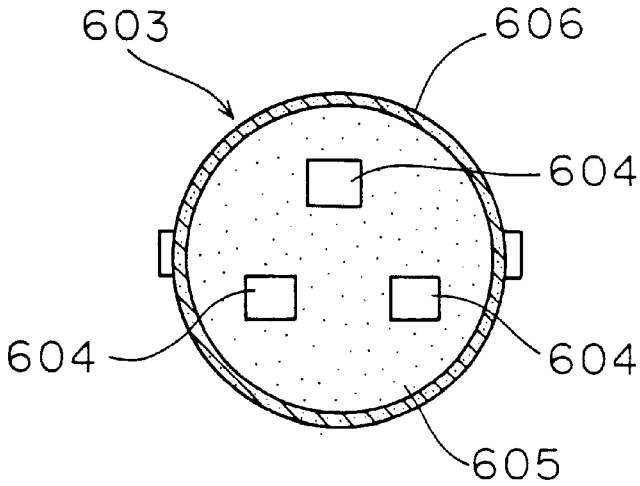
FIG. 60 is a cross section taken along the line III—III of FIG. 59.
Figure 61:
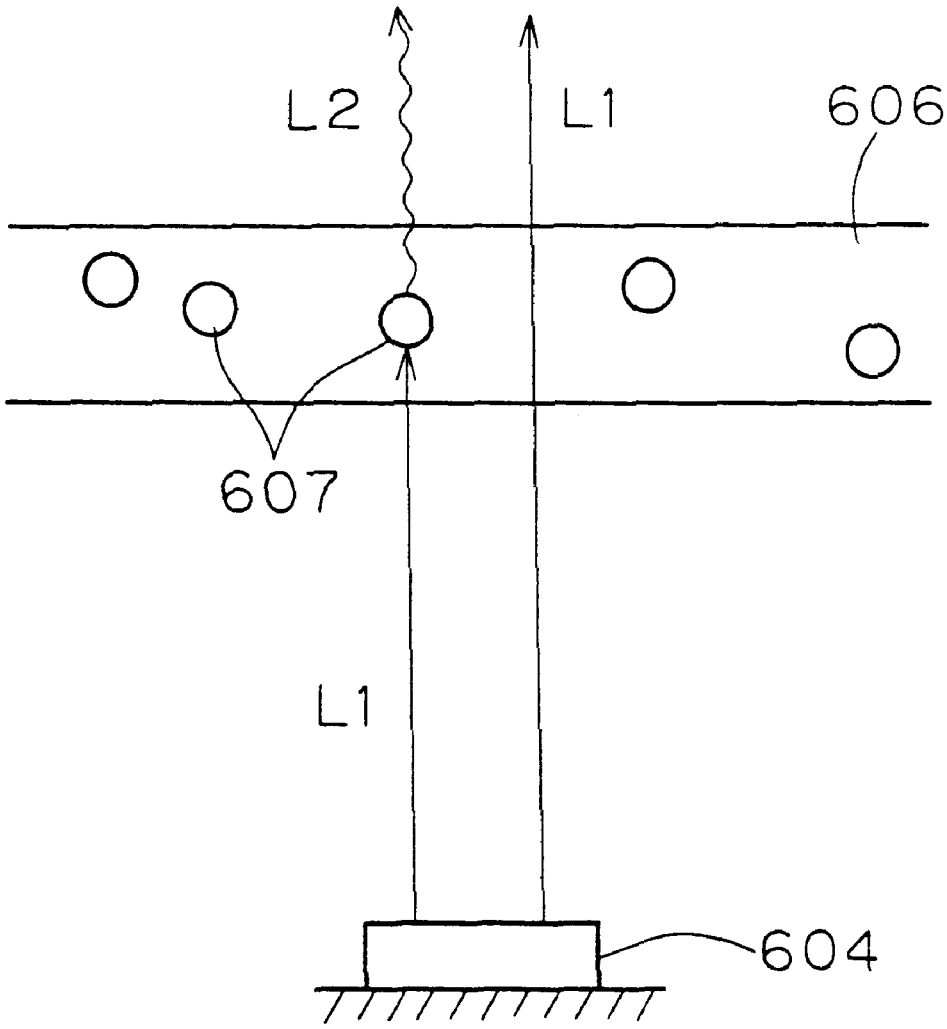
FIG. 61 is a view illustrating the action and effect of the twentieth preferred embodiment.

FIG. 58 is a cross section showing an indicator to which an indicator device (LED bulb) in accordance with the twentieth preferred embodiment of the present invention is applied, FIG. 59 is an enlarged cross section showing the LED bulb, FIG. 60 is a cross section taken along the line III—III of FIG. 59 and FIG. 61 is a view illustrating the action and effect of this preferred embodiment.

As shown in FIG. 58, the indicator 601 comprises a substantially-spherical shell-shaped lens 602 and an LED bulb 603 disposed inside the lens 602. On an emitter body 603*a* of the LED bulb 603, as shown in FIGS. 59 and 60, a plurality of LED elements 604 are two-dimensionally mounted and each of the LED elements 604 is sealed by a transparent mold resin 605. There may be a case where one LED element 604 is used.

On the upper portion of the emitter body 603*a* of the LED bulb 603, a dome-shaped (hemispherical shell-shaped) resin cap member (the first dome-shaped cap member) 606 is mounted (see FIGS. 58 and 59). It is desirable that the center of curvature of the cap member 606 should be placed on a mount surface of the LED element 604.

A fluorescent material is mixed in the cap member 606. The fluorescent material has fluorescent characteristics of being excited by an incident light and emitting a light having a wavelength different from that of the incident light when getting back to a ground state. The cap member 606 is obtained by mixing the fluorescent material having this fluorescent characteristics into the transparent resin material and forming the mixture into a dome shape.

Next, the action and effect of the first preferred embodiment will be discussed referring to FIG. 61.

The light L1 emitted from the LED element 604 enters the dome-shaped cap member 606. Then, a fluorescent material 7 inside the dome-shaped cap member 606 is excited to emit an intrinsic fluorescent light L2 of the fluorescent material. On the other hand, part of the light L1 projected to the dome-shaped cap member 606 goes through the dome-shaped cap member.

As a result, from the dome-shaped cap member 606, a light of additively-mixed color of the transmission light L1 going through the dome-shaped cap member 606 and the fluorescent light L2 emitted by the fluorescent material 607.

For example, when an emitter which emits a light of blue wavelength (a light of the first wavelength) is used as the LED element 604 and a fluorescent material which emits a fluorescent light of yellow wavelength (a light of the second wavelength) longer than the blue wavelength as excited by the light of blue wavelength is used as the fluorescent material 607, a white light which is a mixture of blue light and yellow light is projected from the dome-shaped cap member 606.

Alternatively, when an emitter which emits a light of blue wavelength is used as the LED element 604 and a fluorescent material which emits a fluorescent light of red wavelength longer than the blue wavelength as excited by the light of blue wavelength is used as the fluorescent material 7, a pink light which is a mixture of blue light and red light is projected from the dome-shaped cap member 6.

Thus, it becomes possible to emit a white light or other color light which is hard to emit by a single LED element.

Moreover, in this case, since the LED bulb 603 of this preferred embodiment can be obtained merely by mounting the dome-shaped cap member 606 which is easy to form on the upper portion of the LED bulb, only a slight increase of cost is needed.

The Twenty-First Preferred Embodiment

Figure 62:
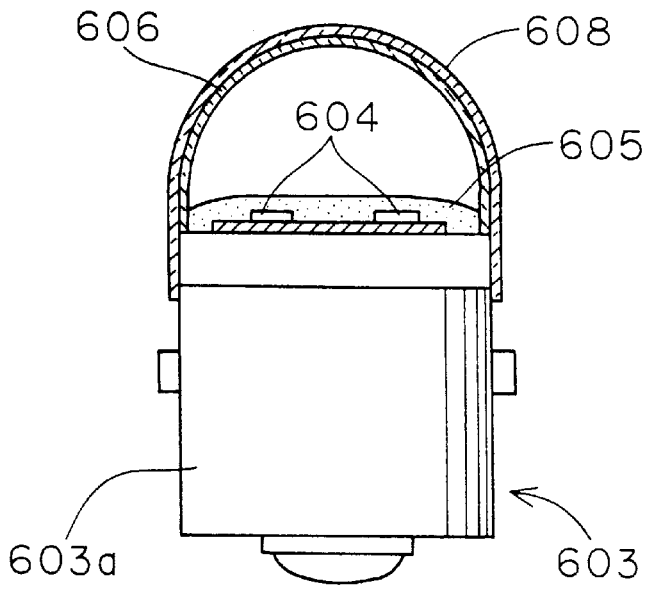
FIG. 62 is an enlarged cross section showing an LED bulb in accordance with a twenty-first preferred embodiment of the present invention.
Figure 63:
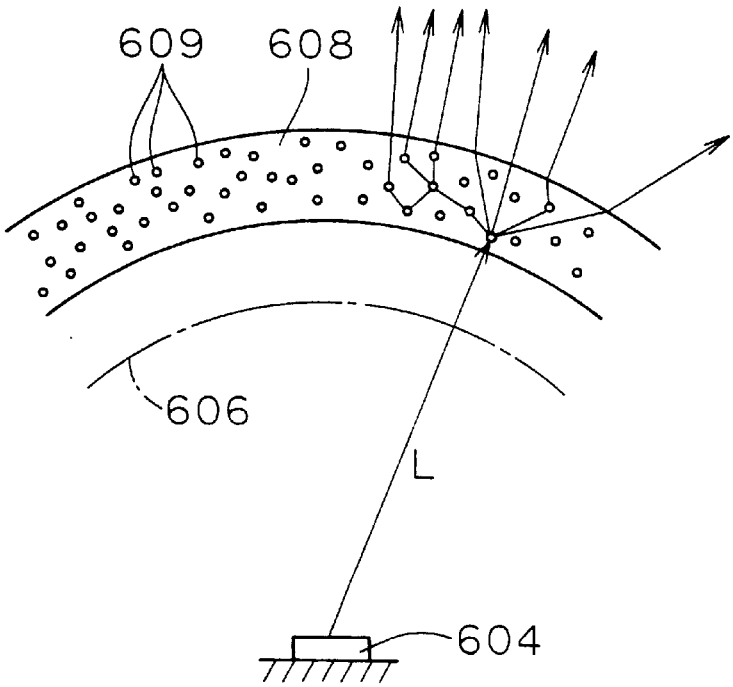
FIG. 63 is a view illustrating the action and effect of the twenty-first preferred embodiment.

FIG. 62 is an enlarged cross section showing an indicator device (LED bulb) in accordance with the twenty-first preferred embodiment of the present invention, and FIG. 63 is a view illustrating the action and effect thereof. Elements given the same reference signs as those of the twentieth preferred embodiment represent elements identical to or similar to those of the twentieth preferred embodiment.

As shown in FIG. 62, on the upper portion of the emitter body 603*a* of the LED bulb 603, around the periphery of the first dome-shaped cap member 606, a like dome-shaped resin cap member (the second dome-shaped cap member) 608 is mounted. It is desirable that the center of curvature of the cap member 608 should be placed on the mount surface of the LED element 604 like the cap member 606.

A diffusion material is mixed in the cap member 608. As this diffusion material, for example, ceramics powder is used, but application of this preferred embodiment is not limited to this and inorganic materials other than the ceramics powder and organic materials may be used only if these have the property of diffusing a light. The cap member 608 is obtained by mixing the diffusion material into the transparent resin material and forming the mixture into a dome shape.

Next, the action and effect of the twenty-first preferred embodiment will be discussed referring to FIG. 63.

A light L emitted from the LED element 604 goes through the dome-shaped cap member 606, being changed into a light of predetermined mixed color, e.g., a white light, and enters the dome-shaped cap member 608.

The light projected to the dome-shaped cap member 608 enters a lot of particles of the diffusion material 609 mixed in the cap member 608 and is diffused in various directions by surfaces of the particles.

As a result, since the whole dome-shaped cap member 608 serves as an emitting surface, the LED bulb 603 can have an emitting surface formed in a three-dimensional dome shape. That allows a check of on/off state of the LED bulb 603 from all directions, to improve the viewability of the LED bulb 603.

The Twenty-Second Preferred Embodiment

Though the twenty-first preferred embodiment shows a constitution where the dome-shaped cap member 608 including the diffusion material is mounted around the periphery of the dome-shaped cap member 606 including the fluorescent material, application of the present invention is not limited to this.

In the LED bulb 603 of FIG. 59, a dome-shaped cap member including the fluorescent material and the diffusion material may be used as the dome-shaped cap member 606.

In this case, the light projected to the dome-shaped cap member 606 from the LED element 604 is diffused in various directions by the diffusion material inside the dome-shaped cap member 606, and part of the light is projected from the dome-shaped cap member 606 and the rest of the light excites the fluorescent material to emit a fluorescent light.

With this constitution, since the whole dome-shaped cap member 606 serves as an emitting surface for a light of mixed color of outgoing-light color and the fluorescent color, e.g., a white light, the LED bulb 603 can have an emitting surface formed in a three-dimensional dome shape. That allows a check of on/off state of the LED bulb 603 from all directions, to improve the viewability of the LED bulb 603, like the twenty-first preferred embodiment.

Moreover, in this case, only one dome-shaped cap member is mounted on the emitter body 603*a*, and that allows simple fabrication and contributes to overall size reduction.

The Twenty-Third Preferred Embodiment

Figure 64:
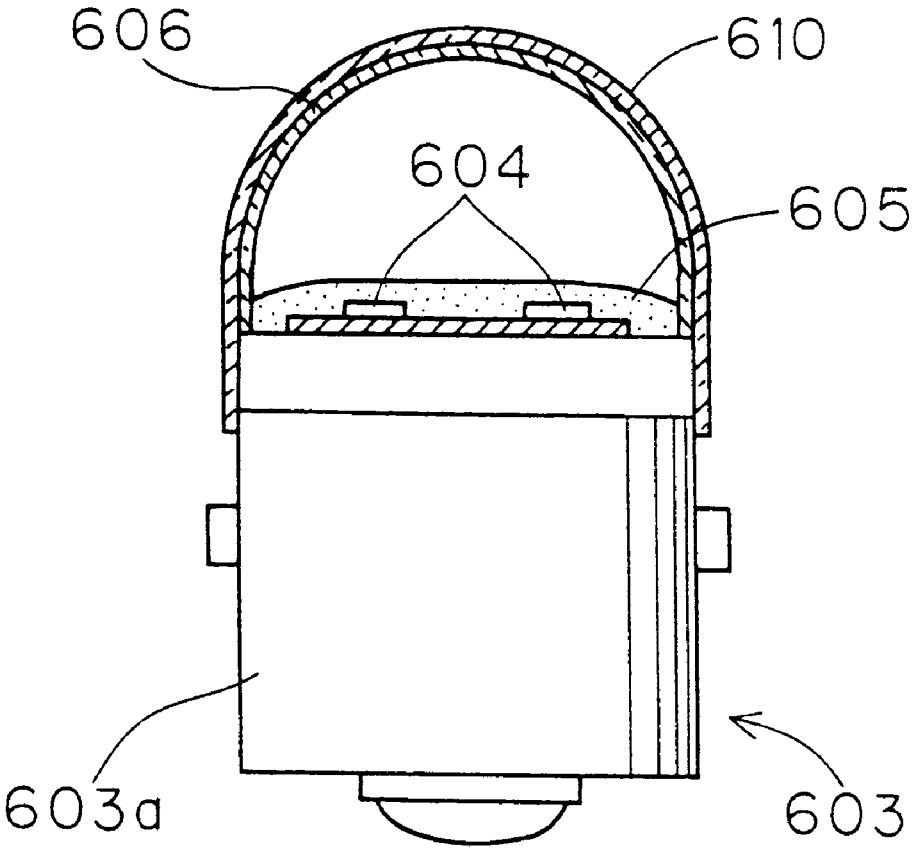
FIG. 64 is an enlarged cross section showing an LED bulb in accordance with a twenty-third preferred embodiment of the present invention.

FIG. 64 is an enlarged cross section showing an indicator device (LED bulb) in accordance with the twenty-third preferred embodiment of the present invention. In this figure, elements given the same reference signs as those of the twenty-first preferred embodiment represent elements identical to or similar to those of the twenty-first preferred embodiment.

The twenty-third preferred embodiment is different from the twenty-first preferred embodiment in that the third dome-shaped cap member (i.e., a color filter) 610 including a colorant is mounted, instead of the dome-shaped cap member 608 including the diffusion material of FIG. 62.

For example, when an emitter which emits a light of blue wavelength (a light of the first wavelength) is used as the LED element 604 and a fluorescent material which emits a fluorescent light of red wavelength (a light of the second wavelength) longer than the blue wavelength as excited by the light of blue wavelength is used as the fluorescent material 607 inside the dome-shaped cap member 606, a pink light which is a mixture of blue light and red light is projected from the dome-shaped cap member 606.

In this case, when a red one is used as the dome-shaped cap member 610, a component of blue light among the pink light is absorbed in the dome-shaped cap member 610 and only a red light is projected from the dome-shaped cap member 610, i.e., the LED bulb 603.

As one of other examples, various combinations of the fluorescent material 607 inside the dome-shaped cap member 606 and the colorant inside the dome-shaped cap member 610 allows emission of lights of all colors (full color).

The Twenty-Fourth Preferred Embodiment

Figure 65:
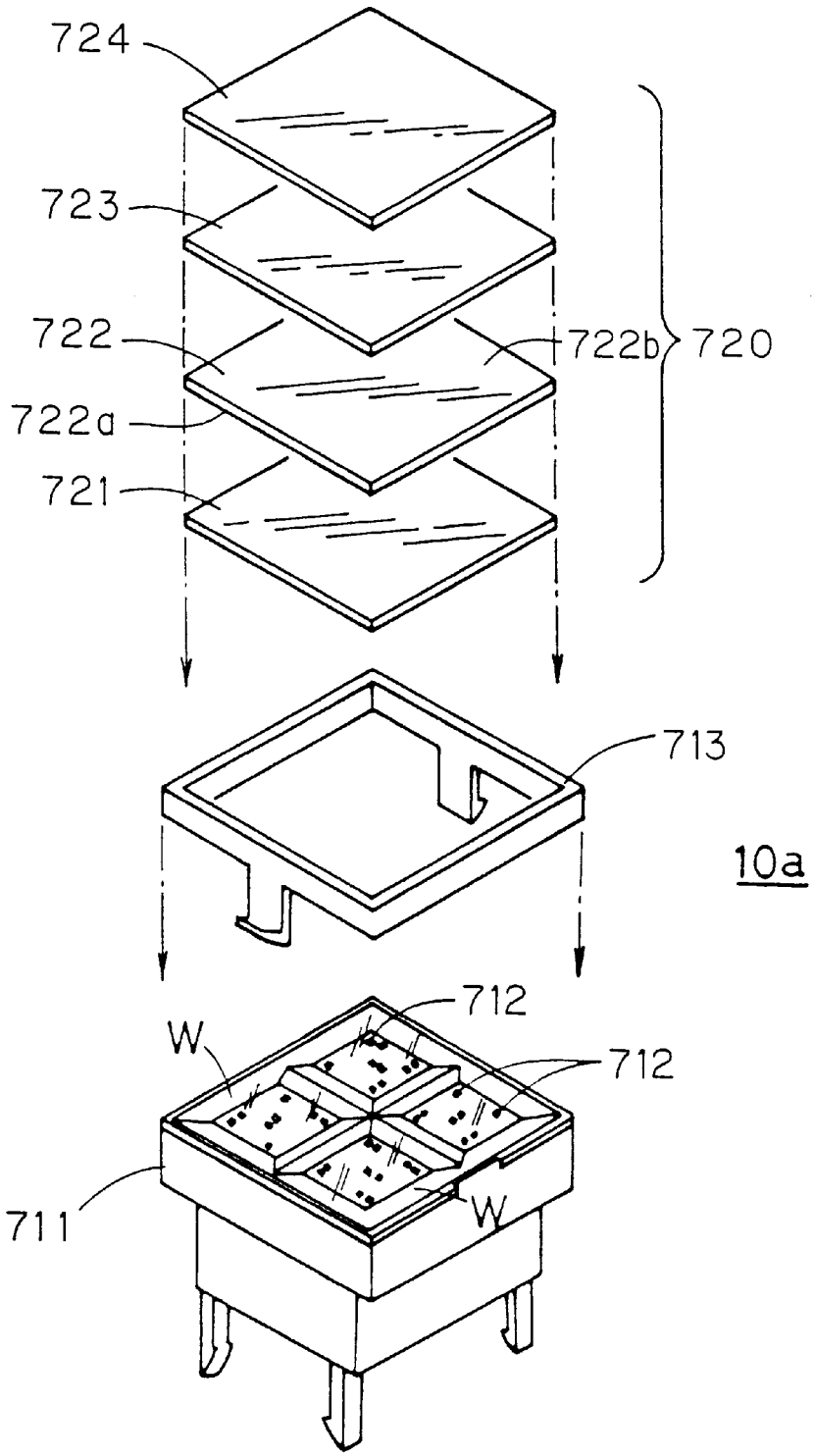
FIG. 65 is an explored perspective view of a unit indicator lamp to which a twenty-fourth preferred embodiment of the indicator device in accordance with the present invention is applied.
Figure 66:
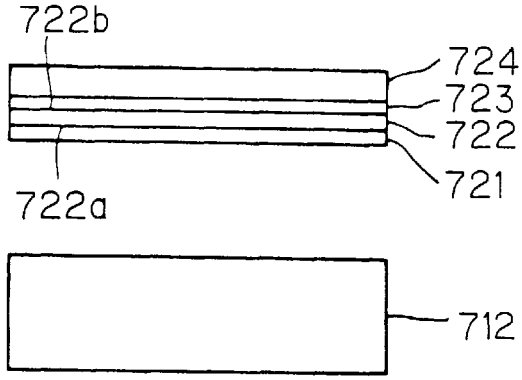
FIG. 66 is a schematic cross section of the unit indicator lamp of FIG. 65.

FIG. 65 is an explored perspective view of the unit indicator lamp 10*a* to which the twenty-fourth preferred embodiment of the indicator device (surface-illuminated indicator device) in accordance with the present invention is applied. FIG. 66 is a schematic cross section of the unit indicator lamp 10*a* of FIG. 65. In this unit indicator lamp 10*a*, a plurality of light sources 712 (LED elements) are arranged in a matrix inside a resin case 711 having the window W. Each of the light sources 712 is mounted on a major surface of the print board and accommodated in the case 711, and its light-emitting part is exposed towards the upper surface of the case 711. The LED elements constituting the light source 712 each emit a light of any one of wavelengths ranging from the ultraviolet region to blue (the first wavelength), herein a light of blue wavelength.

On the other hand, a frame 713 is disposed in an upper periphery of the window W. The frame 713 is fit in the housing 2 of FIG. 1 with the case 711 therebetween, and a compound plate 720 is fit into the frame 313. The compound plate 720 is constituted of four layered plates:

① a diffusion plate (light diffusion member) 721;

② a wavelength changing member 722;

③ an inscription plate 723 made of transparent resin; and

④ a cover plate 724 made of transparent resin, from the side of the light source 712. On the inscription plate 723, information (characters, signs and pictures) to be represented are inscribed.

Among them, the wavelength changing member 722 is provided in accordance with a main characteristic feature of the present invention. The wavelength changing member 722 is disposed between the cover plate 724 serving as the indicating surface and the light source 712, and it is a plate-like or sheet-like member having a light-incident surface 722*a* receiving a light from the light source 712 and a light-outgoing surface 722*b* facing the indicating surface (the upper side of this figure).

Figure 67:
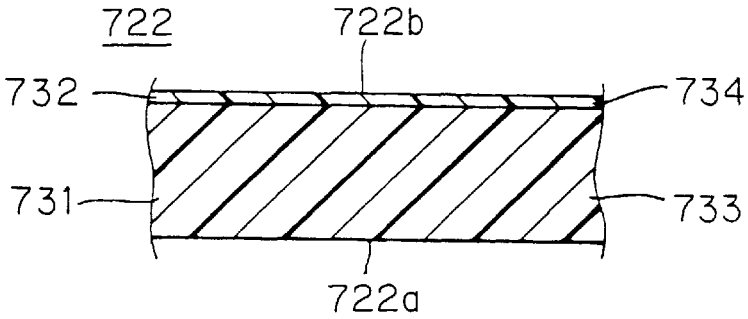
FIG. 67 is a fragmentary cross section of a wavelength changing member provided in the unit indicator lamp of FIG. 65.

FIG. 67 is a fragmentary cross section of the wavelength changing member 722. As shown in FIG. 67, the wavelength changing member 722 is of two-layer molding consisting of a fluorescent layer 731 and a filter layer 732 as a unity. The wavelength changing member 722 is provided so that the fluorescent layer 731 is placed on the side of the light-incident surface 722*a* and the filter layer 732 is placed on the side of the light-outgoing surface 722*b*.

The fluorescent layer 731 changes at least part of a light of the first wavelength projected through the light-incident surface 722*a* into a light of the second wavelength longer than the first wavelength. Therefore, in general, a light entering the filter layer 732 from the fluorescent layer 731 includes the light of the first wavelength emitted by the fluorescent layer 731 and the rest of the light of the first wavelength projected to the fluorescent layer 731, which is not changed into the light of the second wavelength by the fluorescent layer 731. When all the light of the first wavelength projected to the fluorescent layer 731 is substantially changed into the light of the second wavelength, the light entering the filter layer 732 from the fluorescent layer 731 includes no light of the first wavelength.

The light transmission characteristics of the filter layer 732 is so determined as to transmit at least part of the light projected from the fluorescent layer 731 towards the indicating surface as the indication light. The appearance color of the filter layer 732 depends on which wavelength component is included in the light passing through the filter layer 732 most among externally-projected lights (visible lights) such as a white light, and in general, is substantially identical or similar to the color of wavelength component passing through the filter layer 732 most. Herein, the appearance color of the filter layer 732 is so determined as to be substantially identical or similar to the color of the indication light which passes through the filter layer 732 and illuminates the indicating surface when the light source 712 is turned on.

With this, in an off state of the light source 712, when an externally-received white light enters the filter layer 732 through the cover plate 724 serving as the indicating surface and the inscription plate 723, a reflected light from the filter layer 732 is projected from the indicating surface and the appearance color of the filter layer 732 is thereby visually recognized substantially as the color of the indicating surface.

In other words, the filter layer 732 has two roles. The first role is to change or correct the color of the light projected from the fluorescent layer 731 towards the indicating surface (in general, an additively-mixed color obtained from the color of the light of the first wavelength and that of the light of the second wavelength) into a desired color (indication color). The second role is to make the color of the indicating surface (the color of the indication light) in an on state of the light source 712 and the color of the indicating surface in an off state substantially identical or similar to each other. Therefore, the light transmission characteristics of the filter layer 732 to substantially specify the color of the indication light and the color of the indicating surface in an off state of the light source 712 should be so determined as to achieve these two roles.

Figure 68:
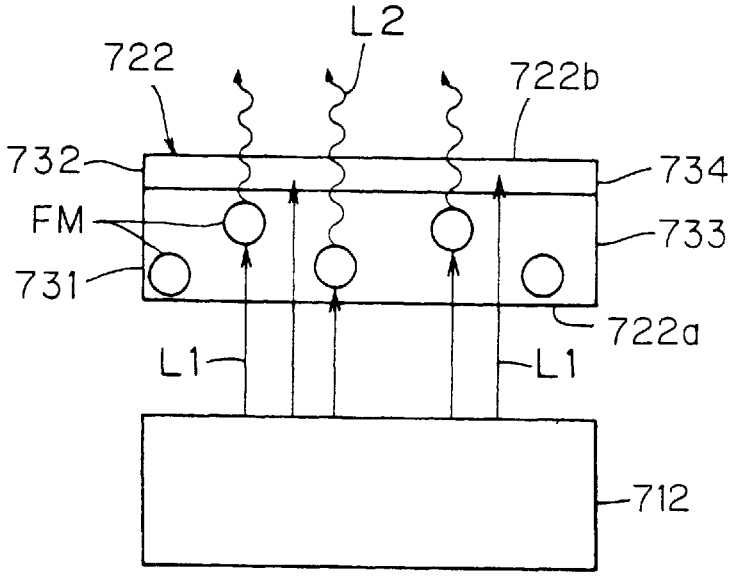
FIGS. 68 to 70 are schematic views each showing an example of optical characteristics of the wavelength changing member of FIG. 67.

FIG. 68 is a schematic view showing an example of optical characteristics of the fluorescent layer 731 and the filter layer 732 constituting the wavelength changing member 722. In the illustration of FIG. 68, the light transmission characteristics of the filter layer 732 is so determined as to substantially transmit only the light of the second wavelength emitted by the fluorescent layer 731, in other words, not to substantially transmit the light of wavelength component other than the second wavelength. With this, the appearance color of the filter layer 732 necessarily becomes substantially the same color as the color of the light of the second wavelength.

A fluorescent member 733 used for the fluorescent layer 731 is obtained by mixing a fluorescent material (color changing colorant) having such fluorescent characteristics as discussed later into the transparent resin material and forming the mixture into a plate-like or sheet-like shape, and the fluorescent material is represented by a reference sign FM in this figure.

The fluorescent material FM has fluorescent characteristics of emitting the light L2 of the second wavelength (indicated by a wavy line in this figure) longer than the first wavelength when getting back to the ground state after being excited by the light L1 of the first wavelength indicated by a solid line in this figure. Hence, when the light L1 of the first wavelength from the light source 712 is projected to the light-incident surface 722*a* of the fluorescent layer 731, the light L1 of the first wavelength is absorbed in the fluorescent material FM and the (fluorescent) light L2 of the second wavelength longer than the first wavelength is emitted to enter the filter layer 732 from the fluorescent layer 731.

The light L1 of the first wavelength entering the filter layer 732 is sufficiently attenuated until it reaches a surface of the filter layer 732 on the side of the indicating surface, not going through the filter layer 732. On the other hand, the light L2 of the second wavelength is hardly attenuated to go through the filter layer 732. From the surface of the filter layer 732 on the side of the indicating surface, a light substantially made of the light of the second wavelength is thereby projected towards the indicating surface.

Since the filter layer 732 further has the function of correcting the light L2 of the second wavelength emitted by the fluorescent layer 731, the intensity of each wavelength component of the light of the second wavelength is corrected when the light of the second wavelength goes through the filter layer 732, to obtain a light having a color more close to the desired color.

Figure 69:
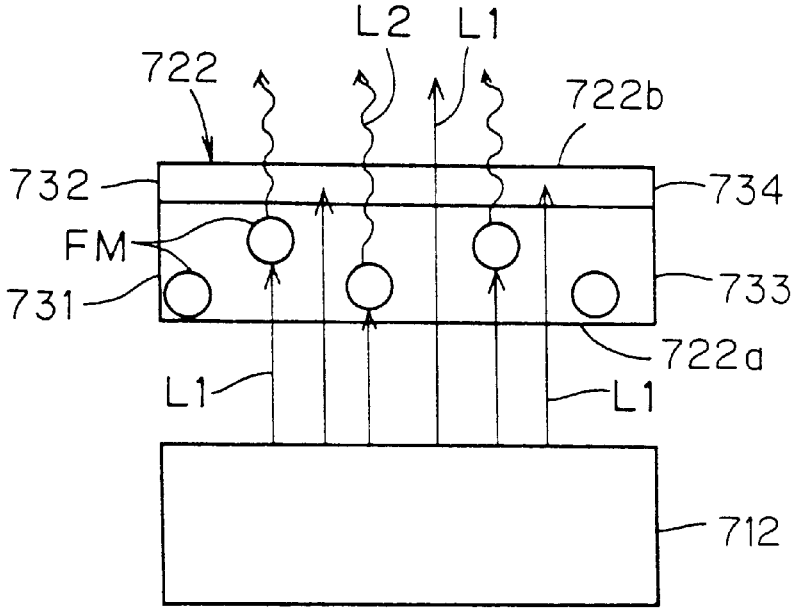
Figure 70:
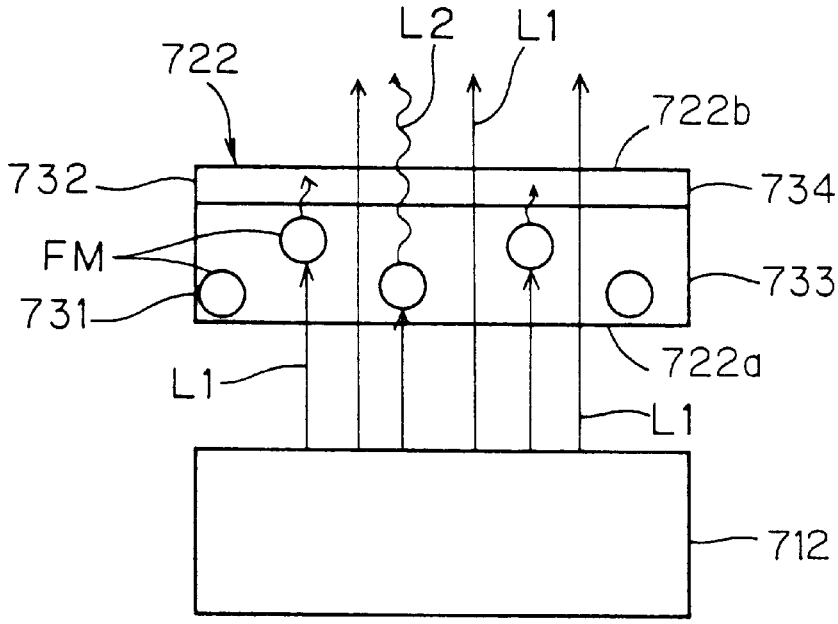

Though the light transmission characteristics of the filter layer 732 is so determined as to substantially transmit the light of the second wavelength, for example, it may be so determined as to transmit substantially all the light of the second wavelength and part of the light of the first wavelength, as shown in FIG. 69. Alternatively, the light transmission characteristics of the filter layer 732 may be so determined as to transmit substantially all the light of the first wavelength and part of the light of the second wavelength, as shown in FIG. 70, and thus variations are possible.

In any case, the filter layer 732 has to transmit part of the light projected from the fluorescent layer 731 and its appearance color has to be substantially identical or similar to the color of the indication light which goes through the filter layer 732. Examples of specific constitution of the wavelength changing member 722 will be discussed later in detail in the exemplary experiments.

Now, a method of forming the filter layer 732 will be discussed.

As the first method, an ink 734 (filter material) (see FIG. 67) or a colorant (filter material) having a predetermined light transmission characteristics and an appearance color substantially identical or similar to the indication color is screen-printed or sprayed onto one-side surface of the plate-like or sheet-like fluorescent member 733 used for the fluorescent layer 731, to form the filter layer 732. This method has an advantage of easy formation of the filter layer 732 through a simple step such as screen-printing and spray-coating. The filter layer 732 of this preferred embodiment is formed through the screen-printing.

As the second method, a thermal transfer film having a predetermined light transmission characteristics and an appearance color substantially identical or similar to the indication color is thermally transferred to one-side surface of the fluorescent member 733 used for the fluorescent layer 731, to form the filter layer 732. This method has an advantage of easy formation of the filter layer 732 through a simple step such as thermal transfer and a further advantage of easy formation of the filter layer 732 having a desired appearance color and light transmission characteristics since enough kinds of color thermal transfer films for the filter layer 732 are available.

As the third method, a predetermined colorant having an impregnating ability is impregnated to one-side surface of fluorescent member 733 used for the fluorescent layer 731 and one-side surface portion of the fluorescent member 733 is so colored as to have a predetermined light transmission characteristics and an appearance color substantially identical or similar to the indication color, to form the filter layer 732. Though there is a possibility that the filter layer 732 may be removed by contact with other members when the filter layer 732 is formed by coating and the like, this method has an advantage that the filter layer 732 is not removed since the predetermined colorant is impregnated to one-side surface of fluorescent member 733 used for the fluorescent layer 731 and partially colors the fluorescent member 733, to form the filter layer 732.

Figure 71:
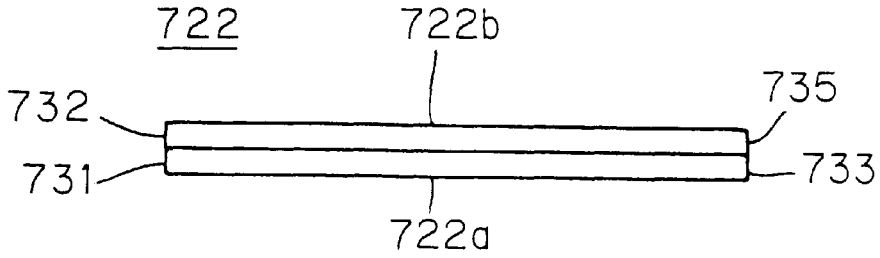
FIG. 71 is a side elevation of another wavelength changing member provided in the unit indicator lamp of FIG. 65.

As the fourth method, the plate-like or sheet-like fluorescent member 733 used for the fluorescent layer 731 and a plate-like or sheet-like filter member 735 used for the filter layer 732 are bonded with a transparent adhesive or their contact surfaces are welded with ultrasonic vibration as a unity, as shown in FIG. 71, to form the wavelength changing member 722.

As the fifth method, the wavelength changing member 722 having the fluorescent layer 731 and the filter layer 732 is integrally molded by two-layer molding (double molding). As a specific two-layer molding, a resin plate for either one of the fluorescent layer 731 and the filter layer 732 is first formed and loaded into a mold, and in this condition, a resin material for the other of the fluorescent layer 731 and the filter layer 732 is poured into the mold, to make the wavelength changing member 722.

Referring next back to FIG. 65, when the light source 712 is turned on and the light projected from the fluorescent layer 731 of the wavelength changing member 722 is transmitted to the filter layer 732 to generate an indication light having a predetermined indication color, the indication light is guided through the inscription plate 723 to the indicating surface made of the cover plate 724 and illuminates the whole indicating surface with the predetermined indication color to make a predetermined optical indication (information indication). In short, the indicator lamp 10*a* is turned on with the predetermined indication color.

Thus, since the color of the indication light which passes through the filter layer 732 and illuminates the indicating surface when the light source 712 is turned on and the appearance color of the filter layer 732 defining the color of the indicating surface when the light source 712 is turned off are substantially identical or similar to each other, the indicator lamp 10*a* (surface-illuminated indicator device) of this preferred embodiment allows the color of the indicating surface in an on state of the light source 712 (in other words, the color of the indication light which illuminates the indicating surface) to be easily recognized by intuition from the color of the indicating surface in an off state of the light source 712 and the meaning of its indication to be easily understood by intuition from the color of the indicating surface in the off state.

Further, since the fluorescent layer 731 disposed between the light source 712 and the indicating surface changes at least part of the light of the first wavelength projected from the light source 712 into the light of the second wavelength longer than the first wavelength to project it towards the indicating surface and the light projected from the fluorescent layer 731 and going through the filter layer 732 (indication light) illuminates the indicating surface, it is possible to easily obtain indication lights having various colors from the light of the first wavelength by changing the kinds of the fluorescent member 733 used for the fluorescent layer 731 and the filter material (ink 734 and the like) used for the filter layer 732. As a result, since it is necessary only to provide one kind of light source 712 emitting the light of the first wavelength (herein blue LED element) as the light source 712, it is possible to ensure higher productivity and lower cost as compared with, for example, changing of combination of the kinds of LED elements to be used according to the color of the indication light. A specific constitution example of the wavelength changing member 722 will be discussed in detail later in the exemplary experiment.

Further, since the fluorescent layer 731 and the filter layer 732 are formed as a unity in the wavelength changing member 722, it is possible to reduce the number of parts and thereby ensure simplification of the fabrication process and lower cost.

In this preferred embodiment, since the light from the light source 712 is diffused by the diffusion plate 721 and thereafter projected into the wavelength changing member 722, it is possible to reduce variation in the amount of light and color on the indicating surface.

Further, in this preferred embodiment, since the light of the first wavelength is one of short wavelength which has any one of wavelengths ranging from ultraviolet region to blue, herein blue light, it is possible to produce light of various colors from the light of the first wavelength.

Though the inscription plate 723 is interposed in the compound plate 720 to make an indication of information inscribed on the inscription plate 723 by turning on the light source 712 in this preferred embodiment, a piece of predetermined information may be indicated simply by illuminating or not-illuminating the indicating surface without the inscription plate 712.

Further, though the wavelength changing member 722 having the fluorescent layer 731 and the filter layer 31 formed as a unity is used in this preferred embodiment, a fluorescent plate having the same function as the fluorescent layer 731 and a filter member (filter) having the same function as the filter layer 732 may be separately formed and separately interposed in the compound plate 720.

There is a related technique of the present invention as follows.

Figure 72:
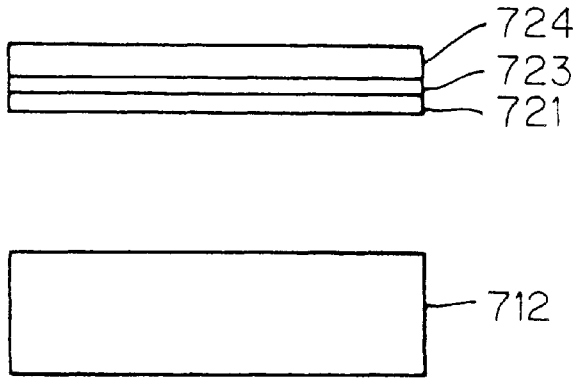
FIG. 72 is a schematic cross section of an indicator device in accordance with a related technique of the present invention.

FIG. 72 is a schematic cross section of an indicator device (surface-illuminated indicator device) in accordance with the related technique of the present invention. The surface-illuminated indicator device is a unit indicator lamp like the unit indicator lamp 10*a* of the twenty-fourth preferred embodiment, and elements which correspond to those in the unit indicator lamp 10*a* are given the same reference signs and will not be discussed.

Figure 73:
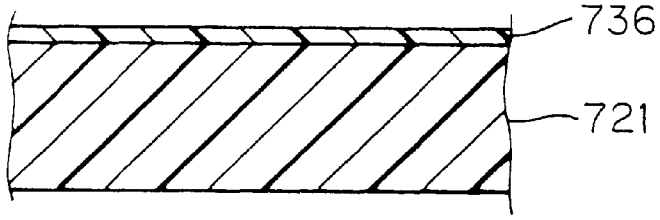
FIG. 73 is a fragmentary cross section of a diffusion plate provided in the indicator device of FIG. 72.

The unit indicator lamp does not use the wavelength changing member 722 and guides the light (the light of the first wavelength) emitted from the light source 712 substantially as it is onto the indicating surface to make an optical indication. The characteristic feature of this unit indicator lamp lies in that a liter layer 736 is formed on a surface of the diffusion plate 721 (herein milky-white diffusion plate) on the side of the indicating surface as shown in FIG. 73.

The filter layer 736 is provided for the same purpose as the filter layer 732, and transmits only the light having a wavelength component of a predetermined indication color to be used as the indication light (e.g., a light of pure blue wavelength component) among lights emitted from the light source 712. For this reason, the filter layer 736 necessarily has an appearance color substantially identical or similar to the indication color.

Therefore, the light of the first wavelength emitted from the light source 712 goes through the filter layer 736 of the diffusion plate 721 with its color being corrected to the predetermined indication color, and is projected towards the indicating surface. When the light source 712 is turned off, the color of the filter layer 36 substantially having the same color as the indication color is visually recognized through the cover plate 24 and the inscription plate 23. Thus, even when the light source 712 is turned off, the indication color in an on state of the unit indicator lamp can be visually recognized.

Exemplary Experiments of The Twenty-Fourth Preferred Embodiments

Figure 74:
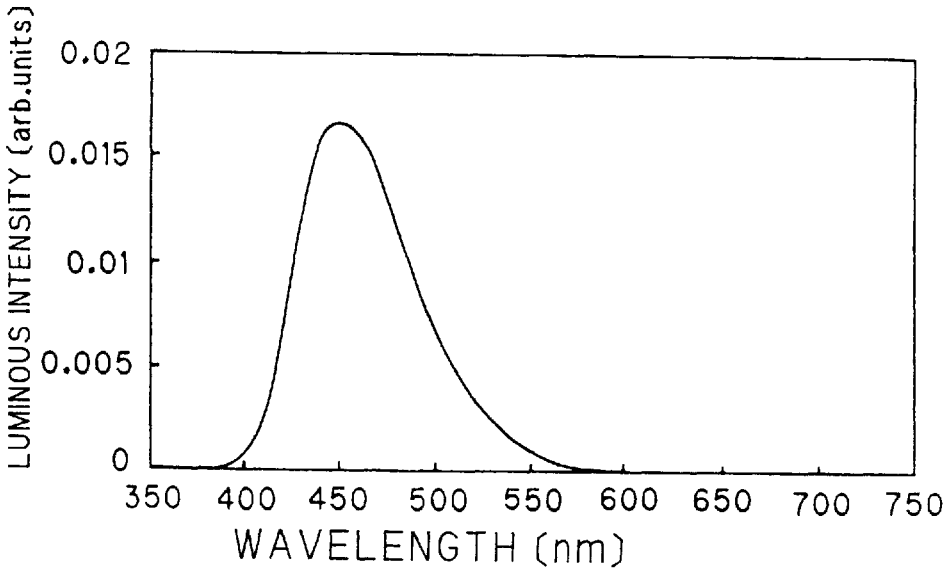
FIG. 74 is a graph showing a spectrum of a light emitted from the blue LED element in each experiment of the twenty-fourth preferred embodiment.

Discussion will be made herein on a case where a blue LED element is used in the light source 712 and six kinds of wavelength changing members 722 (wavelength changing members A, B, C, D, E and F) are used to generate a red indication light, a green indication light and white-group color (reddish white, yellowish white) indication lights from the light of blue wavelength (the light of the first wavelength) emitted from the blue LED element. The graph of FIG. 74 shows a spectrum of the light of blue wavelength emitted from the light source 712.

Figure 75:
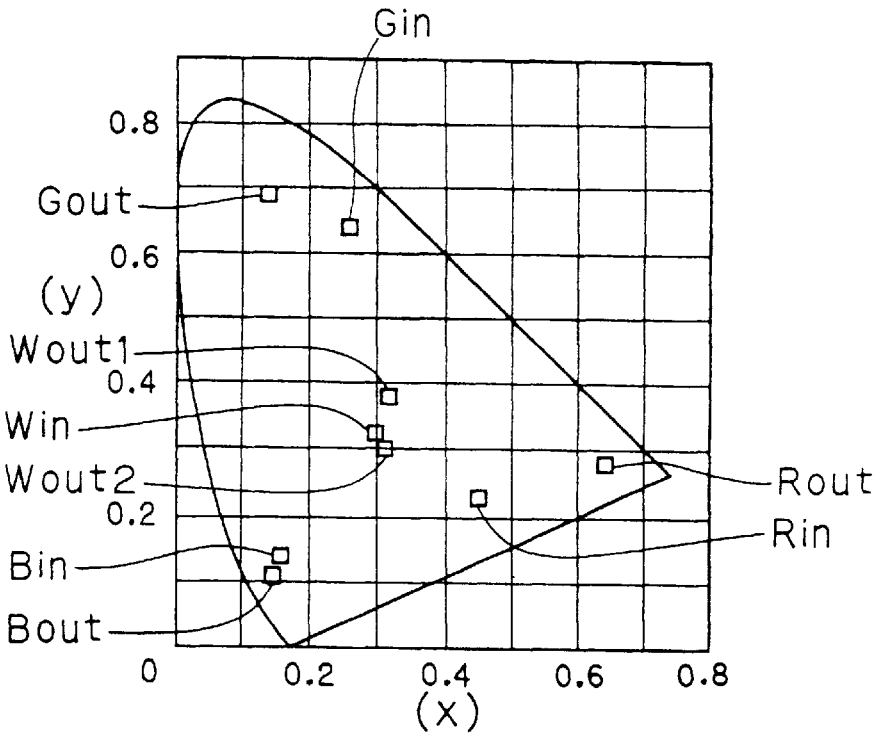
FIG. 75 is a view showing chromaticity coordinates of colors of indication lights obtained in experiments of the twenty-fourth preferred embodiment.

In the first exemplary experiment, the red indication light is generated by using the wavelength changing members A, B and C. In the second exemplary experiment, the green indication light is generated by using the wavelength changing member D. In the third exemplary experiment, the white-group color indication light is generated by using the wavelength changing members E and F. FIG. 75 shows chromaticity coordinates of colors of the indication light obtained in the exemplary experiments.

Figure 76:
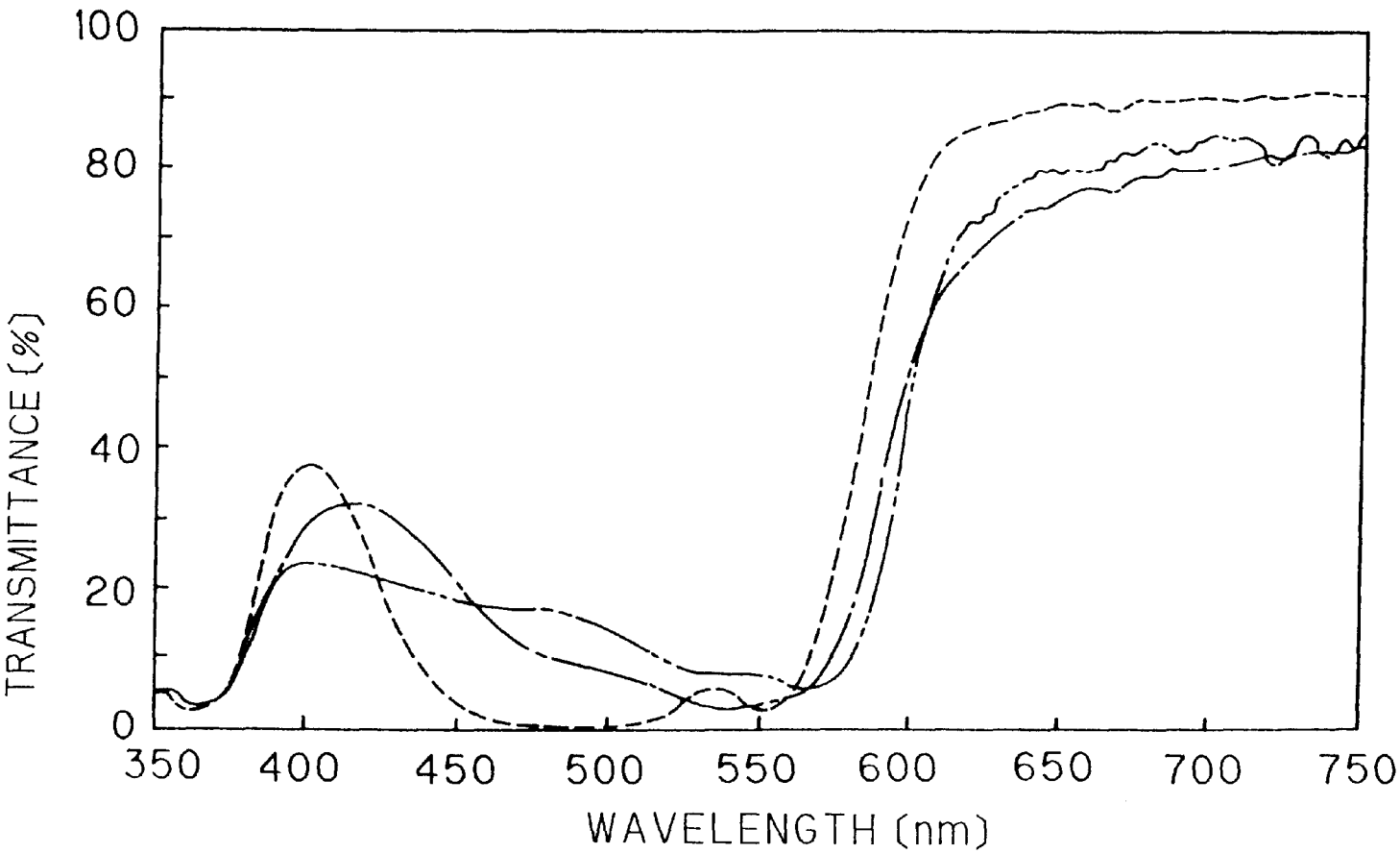
FIG. 76 is a graph showing light transmission characteristics of a filter layer provided in each of wavelength changing members A, B and C in accordance with a first exemplary experiment of the twenty-fourth preferred embodiment.

First, as the first exemplary experiment, generation of the red light from the light of blue wavelength will be discussed. In FIG. 76, respective graphs represented by a chain line, a two-dot chain line and a one-dot chain line indicate light transmission characteristics of a red ink 734 having a red appearance color used for the filter layers 732 of the wavelength changing members A, B and C. The fluorescent layers 731 of the wavelength changing members A, B and C use the same fluorescent member 733. Measurement of the light transmission characteristics is made by applying a light of halogen lamp to a transparent acrylic plate screen-printed with the ink 734 in accordance with each of the wavelength changing members A, B and C to measure the transmittance of each wavelength component of the light. The same method for measuring the light transmission characteristics applies to the other exemplary experiments below.

Figure 77:
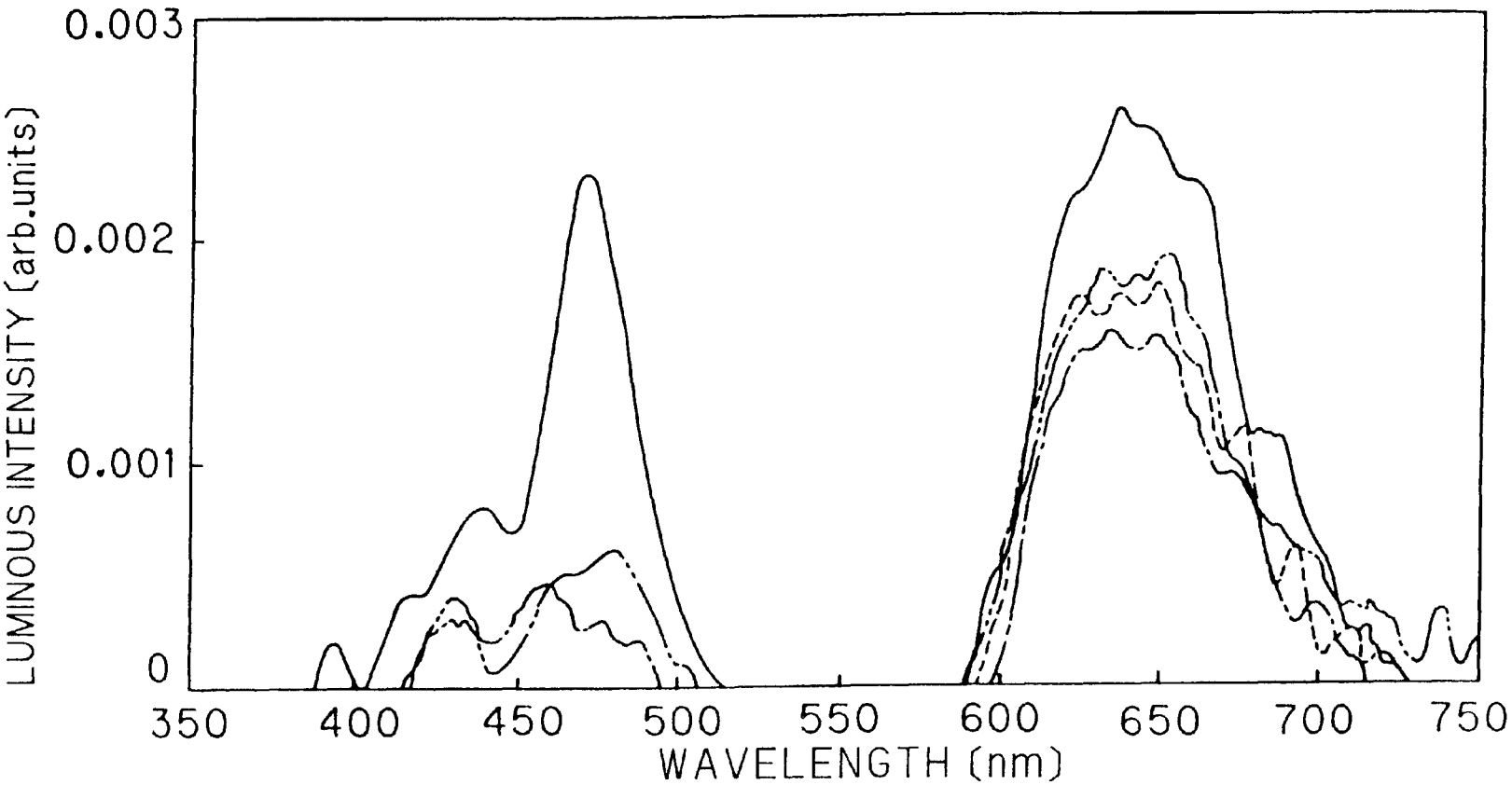
FIG. 77 is a view showing spectra of the indication lights produced from a light of blue wavelength by the wavelength changing members A, B and C in accordance with the first exemplary experiment of the twenty-fourth preferred embodiment.

In FIG. 77, a graph represented by a solid line indicates a spectrum of the light projected from the fluorescent member 733 when the light of blue wavelength from the light source 712 is applied to the fluorescent member 733 used for the fluorescent layers 731 of the wavelength changing members A, B and C. From the graph, it can be seen that the light projected from the fluorescent member 733 includes not a few light of blue wavelength passing through the fluorescent member 733 as well as the light of red wavelength emitted by the fluorescent member 733 from the light of blue wavelength emitted by the light source 712. A point Rin on the chromaticity diagram of FIG. 75 indicates the color of the light projected from the fluorescent member 733.

In FIG. 77, respective graphs represented by a chain line, a two-dot chain line and a one-dot chain line indicate spectra of the red lights generated by applying the light of blue wavelength from the light source 712 to the wavelength changing members A, B and C of this exemplary experiment. From the respective graphs, it can be seen that the lights of blue wavelength through the fluorescent layers 731 are removed or largely suppressed by the respective filter layers 732 of the wavelength changing members A, B and C. From these, it also can be seen that almost pure red indication light can be obtained by using the wavelength changing member A, and a pinkish red indication light, with the light of blue wavelength slightly mixed in the light of red wavelength, is obtained by using the wavelength changing members B and C. A point Rout on the chromaticity diagram of FIG. 75 indicates the color of the indication light generated by the wavelength changing member A.

Figure 78:
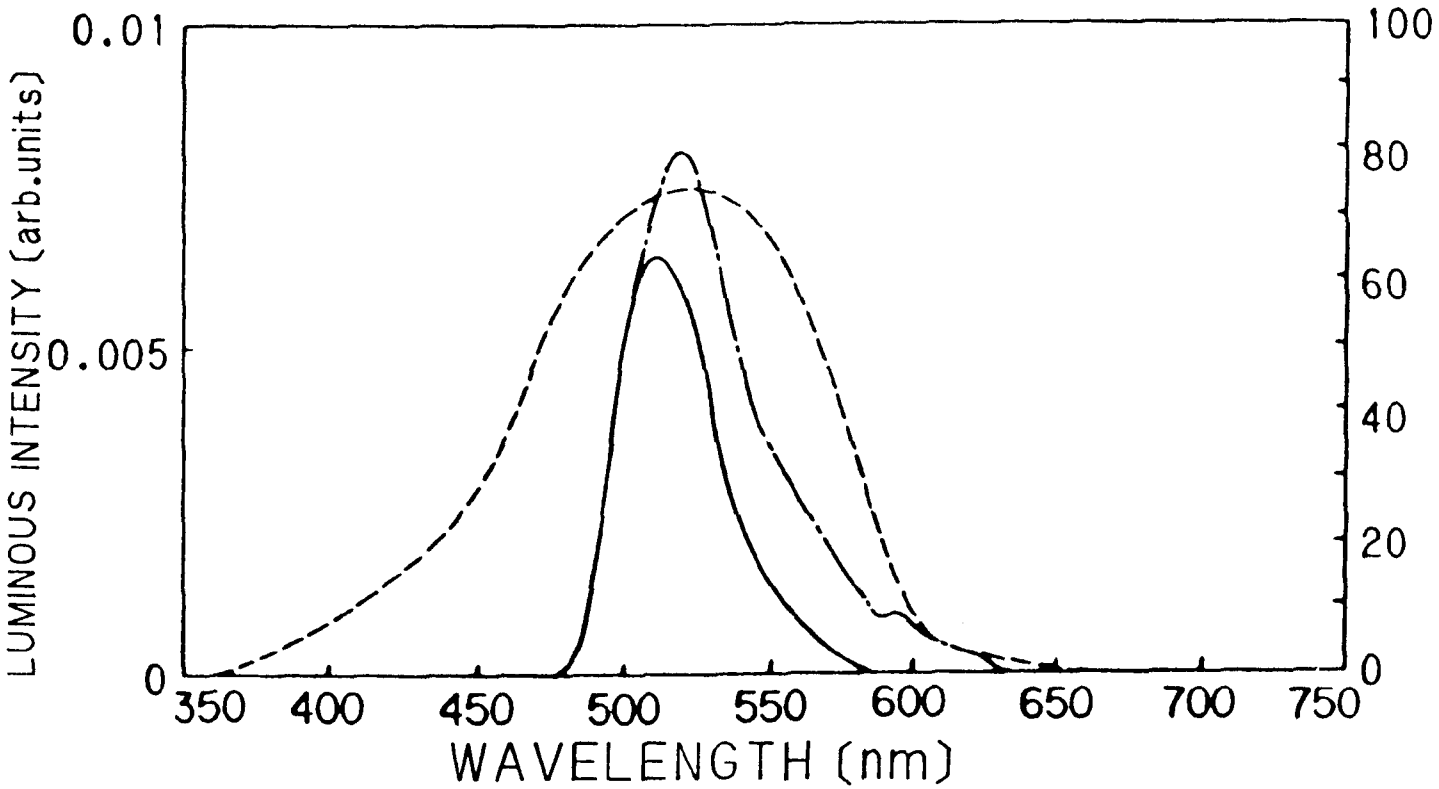
FIG. 78 is a graph showing optical characteristics of a wavelength changing member D in accordance with a second exemplary experiment of the twenty-fourth preferred embodiment.

Next, as the second exemplary experiment, generation of the green light from the light of blue wavelength will be discussed. In FIG. 78, a graph represented by a chain line indicates light transmission characteristics of a green ink 734 having a green appearance color used for the filter layer 732 of the wavelength changing member D. In this figure, a graph represented by a one-dot chain line indicates a spectrum of the light projected from the fluorescent member 733 when the light of blue wavelength from the light source 712 is applied to the fluorescent member 733 used for the fluorescent layer 731 of the wavelength changing member D. In this figure, a graph represented by a solid line indicates a spectrum of the light of green wavelength generated by applying the light of blue wavelength from the light source 712 to the wavelength changing member D. Points Gin and Gout on the chromaticity diagram of FIG. 75 indicate the color of the light projected from the fluorescent member 733 and the color of the indication light generated by the wavelength changing member D, respectively.

As can be seen from these graphs, the light of blue wavelength entering the fluorescent layer 731 is almost completely changed into the light of green wavelength and the light entering the filter layer 732 from the fluorescent layer 731 includes little light of blue wavelength since the fluorescent member 733 used for the fluorescent layer 731 has excellent wavelength changing characteristics, and a long wavelength component (yellow component) longer than the pure green wavelength component among the components of the light projected from the fluorescent layer 731 is removed by the filter layer 732 and the color of light is corrected, and therefore an indication light having a color close to a desired indication color (herein pure green with high chroma) can be obtained.

Figure 79:
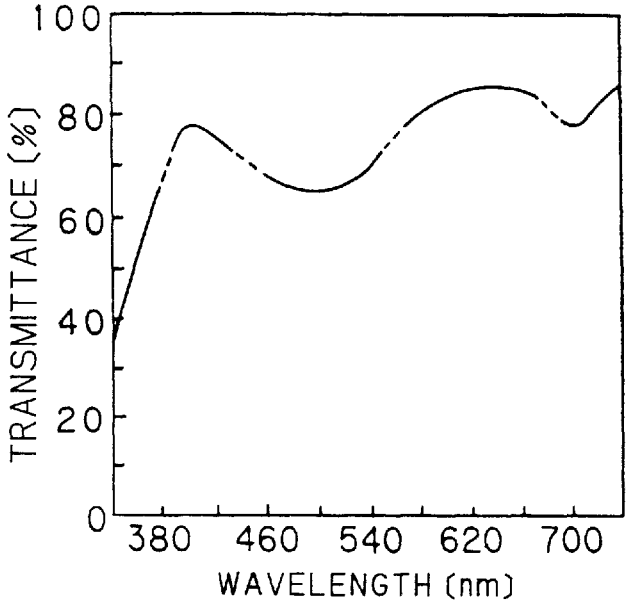
FIG. 79 is a graph showing light transmission characteristics of a filter layer provided in a wavelength changing member E in accordance with a third exemplary experiment of the twenty-fourth preferred embodiment.
Figure 80:
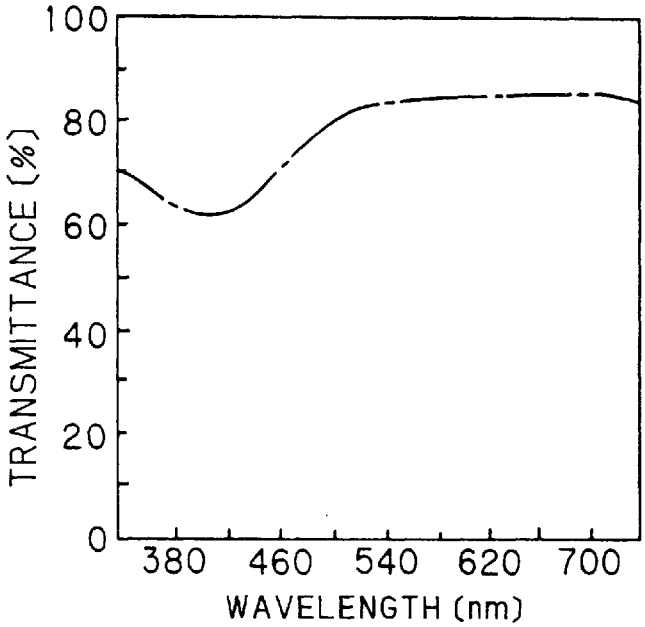
FIG. 80 is a graph showing light transmission characteristics of a filter layer provided in a wavelength changing member F in accordance with the third exemplary experiment of the twenty-fourth preferred embodiment.

Next, as the third exemplary experiment, generation of the white-group color light from the light of blue wavelength will be discussed. The graph of FIG. 79 shows the light transmission characteristics of the filter layer 732 (ink 734) of the wavelength changing member E for generating a light of reddish white, and the graph of FIG. 80 shows the light transmission characteristics of the filter layer 732 (ink 734) of the wavelength changing member F for generating a light of yellowish white. The fluorescent layers 731 of the wavelength changing members E and F use the same fluorescent member 733.

Figure 81:
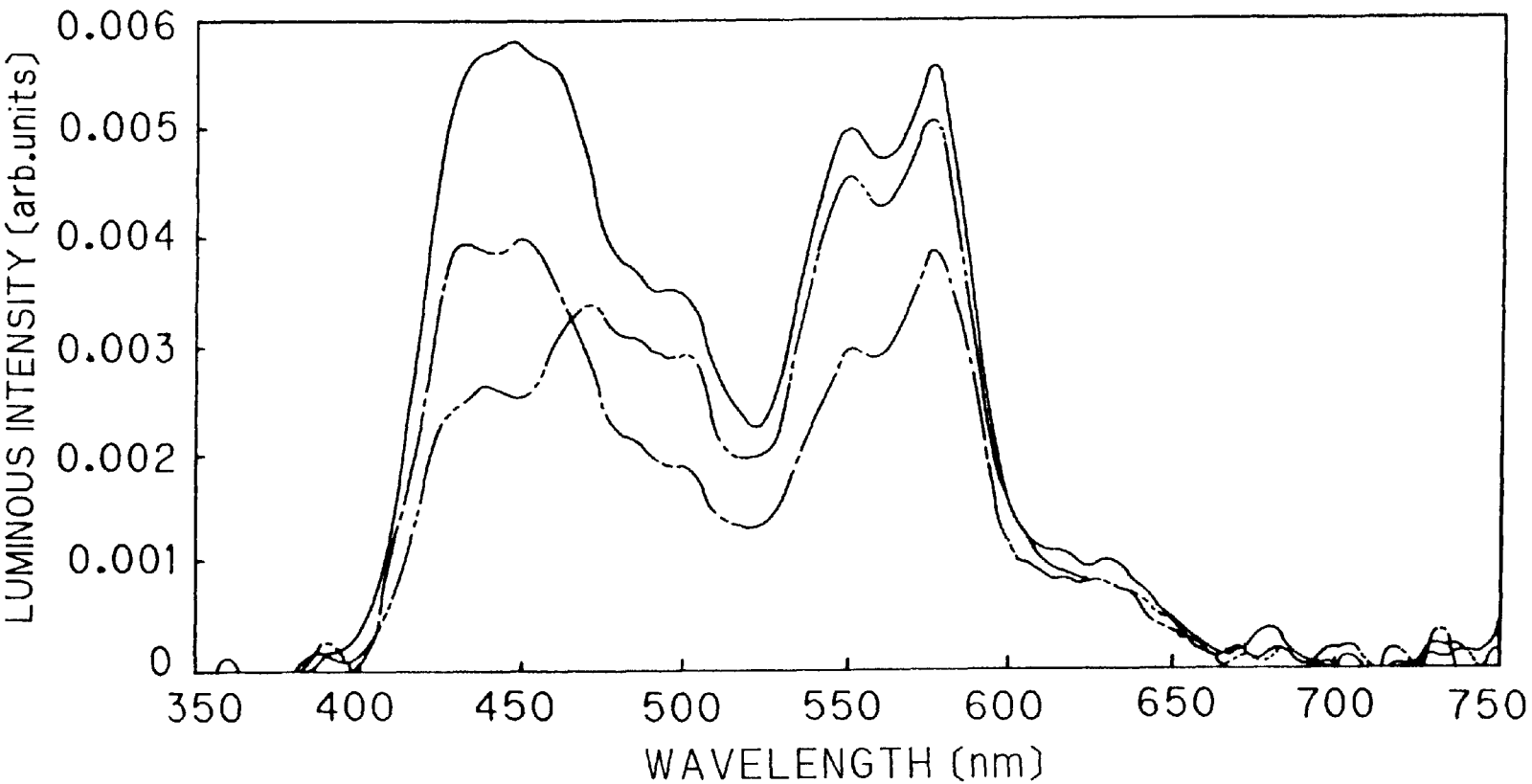
FIG. 81 is a view showing spectra of the indication lights produced from the light of blue wavelength by wavelength changing members E and F in accordance with the third exemplary experiment of the twenty-fourth preferred embodiment.

In FIG. 81, a graph represented by a solid line indicates a spectrum of the light projected from the fluorescent member 733 when the light of blue wavelength from the light source 712 is applied to the fluorescent member 733 used for the respective fluorescent layers 731 of the wavelength changing members E and F. In this figure, respective graphs represented by a two-dot chain line and a one-dot chain line indicate spectra of the reddish white light and the yellowish white light generated by applying the light of blue wavelength from the light source 712 to the wavelength changing members E and F of this exemplary experiment. Points Win, Wout1 and Wout2 on the chromaticity diagram of FIG. 75 indicates the color of the light projected from the fluorescent member 733 of the wavelength changing members E and F and the color of the indication light generated by the wavelength changing members E and F, respectively.

As can be seen from these graphs, the fluorescent layers 731 of the wavelength changing members E and F emit a light having a substantially yellow wavelength region from the light of blue wavelength, and the color of light projected from the fluorescent layers 731 is an additively-mixed color of the color of the light of blue wavelength and the color of the light of substantially yellow wavelength region, i.e., white. This white light is changed into the reddish white light and the yellowish white light by the filter layers 732 of the wavelength changing members E and F, respectively.

Though a light red or light yellow filter layer 732 is used to change the white light projected from the fluorescent layer 731 into the reddish white light or the yellowish white light in this exemplary experiment, the filter 732 having a white appearance color may be attached to the fluorescent layer 731 of this exemplary experiment to obtain a white indicating surface in the off state.

Figure 82:
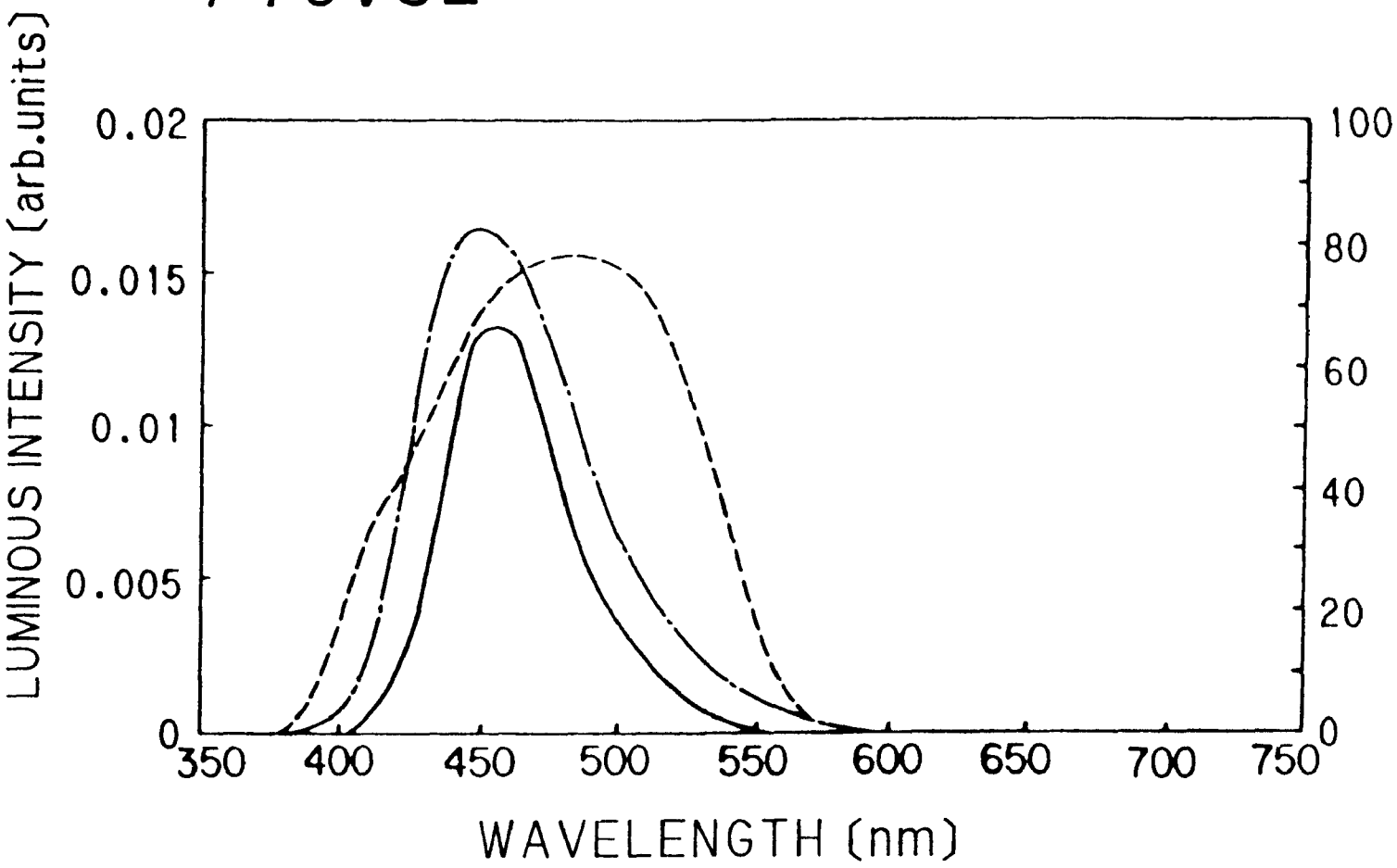
FIG. 82 is a graph showing optical characteristics of a filter layer used in the indicator device of FIG. 72 in accordance with the related technique.

Subsequently, a specific example of the filter layer 736 used in the surface-illuminated indicator device in accordance with the related technique of the present invention shown in FIGS. 72 and 73 will be discussed. In FIG. 82, a graph represented by a chain line indicates the light transmission characteristics of a blue ink having a blue appearance color used for the filter layer 736. In this figure, a graph represented by a one-dot chain line indicates a spectrum of the light of blue wavelength emitted from the light source 712. In this figure, a graph represented by a solid chain line indicates a spectrum of a transmission light when the light of blue wavelength is applied to the transparent acrylic plate with the filter layer 736 formed thereon.

As can be seen from these graphs, a peripheral component of a desired wavelength component (herein pure blue wavelength component) among the light components included in the light emitted from the light source 712 is suppressed by the filter layer 736, and the color of the light emitted from the light source 712 is thereby corrected to be close to the desired indication color.

While the invention has been shown and described in detail, the foregoing description is in all aspects illustrative and not restrictive. It is therefore understood that numerous modifications and variations can be devised without departing from the scope of the invention.

We claim:

1. An indicator device which makes an indication by illuminating a predetermined indicating surface, comprising:

a light source for emitting a light of a first wavelength (L1); and a fluorescent plate provided between said light source and said indicating surface, for changing at least part of said light of said first wavelength projected thereto from said light source into a light of a second wavelength (L2) longer than said first wavelength and projecting said light of said second wavelength towards said indicating surface, wherein said light source comprises a plurality of semiconductor light-emitting elements for emitting a light of any wavelength ranging from ultraviolet to blue as said light of said first wavelength (L1), wherein said plurality of semiconductor light-emitting elements are arranged in a matrix with a plurality of rows and columns to face the back surface of said fluorescent plate and uniformly project said light of first said wavelength towards said fluorescent plate.

2. An indicator device according to claim 1 further comprising:

a light diffusion member that diffuses or dispenses a light on an optical path from said light source towards said indicating surface.

3. The indicator device of claim 2, wherein said light diffusion member is a hologram diffusion plate.

4. The indicator device of claim 2, wherein said light diffusion member is a sheet member made of a light-transmissible material, including a plurality of prism surfaces arranged two-dimensionally on a light-outgoing surface side from which a light is projected, and is disposed with said light-outgoing surface said facing said indicating surface.

5. An indicator device which makes an indication by illuminating a predetermined indicating surface, comprising:

a light source for emitting a light of a first wavelength;

a fluorescent plate provided between said light source and said indicating surface, for changing at least part of said light of said first wavelength projected thereto from said light source into a light of a second wavelength longer than said first wavelength and projecting said light of said second wavelength towards said indicating surface; and a light diffusion member for diffusing or dispersing a light on an optical path from said light source towards said indicating surface, wherein said light diffusion member is a sheet member made of a light-transmissible material, including a plurality of prism surfaces arranged two-dimensionally on a light-outgoing surface side from which a light is projected, and is disposed with said light-outgoing surface side facing said indicating surface, and said plurality of prism surfaces of said sheet member are provided by disposing a plurality of prisms of polypyramid on said light-outgoing surface side of said sheet member so that bottom surfaces of adjacent prisms are in intimate contact with each other without any clearance.

6. The indicator device of claim 1, wherein a light diffusion material is mixed inside of said fluorescent plate.

7. The indicator device of claim 1, wherein:

said semiconductor light-emitting element emits a light of blue wavelength as said light of said first wavelength, said fluorescent plate has fluorescent characteristics to absorb part of said light of blue wavelength emitted from said semiconductor light-emitting element and emit a light of yellow wavelength as said light of said second wavelength, and a substantially white light is obtained from said light of blue wavelength and said light of yellow wavelength as a light for illuminating said indicating surface.

8. An indicator device which makes an indication by illuminating a predetermined indicating surface, comprising:

a light source for emitting a light of a first wavelength;

a fluorescent plate provided between said light source and said indicating surface, for changing at least part of said light of said first wavelength projected thereto from said light source into a light of a second wavelength longer than said first wavelength and projecting said light of said second wavelength towards said indicating surface; and a filter provided between said fluorescent plate and said indicating surface, for transmitting at least part of said light projected from said fluorescent plate towards said indicating surface, wherein a color of a light through said filter to illuminate said indicating surface in an on state of said light source and an appearance color of said filter which substantially defines a color of said indicating surface in an off state of said light source are substantially identical or similar to each other.

9. The indicator device of claim 8, wherein said fluorescent plate and said filter are united as a wavelength changing member comprising a fluorescent layer having a function of said fluorescent plate and a filter layer having a function of said filter as a unity.

10. The indicator device of claim 9, wherein said filter layer is formed by printing or coating a one-side surface of said fluorescent member used for said fluorescent layer with a predetermined filter material used for said filter layer.

11. The indicator device of claim 9, wherein said filter layer is formed by thermally transferring a thermal-transfer film used for said filter layer onto a one-side surface of said fluorescent member used for said fluorescent layer.

12. The indicator device of claim 9, wherein said filter layer is formed by impregnating a one-side surface of said fluorescent member used for said fluorescent layer with a predetermined colorant to color a one-side surface layer of said fluorescent member.

13. The indicator device of claim 9, wherein said wavelength changing member is formed by uniting a fluorescent member used for said fluorescent layer and a filter member used for said filter layer through adhesive-bonding or ultrasonic-welding.

14. The indicator device of claim 9, wherein said wavelength changing member is made of resin, having a two-layer molding of said fluorescent layer and said filter layer.

15. An indicator device which makes an indication by illuminating a predetermined indicating surface, comprising:

a light source for emitting a light of a first wavelength; and a fluorescent plate provided between said light source and said indicating surface, for changing at least part of said light of said first wavelength projected thereto from said light source into a light of a second wavelength longer than said first wavelength and projecting said light of said second wavelength towards said indicating surface, wherein said light source has a fist emitter for emitting said light of said first wavelength and a second emitter for emitting a light of another wavelength different from said first wavelength, and a color of a light projected from said fluorescent plate is changeable by projecting said lights emitted from said first and second emitters to said fluorescent plate and changing the emitting condition of said first and second emitters.

16. The indicator device of claim 15, wherein said fluorescent plate substantially transmits said light of said another wavelength.

17. The indicator device of claim 16, wherein:

a first chromatic color light is projected from said fluorescent plate when only said first emitter among said light source is turned on, a second chromatic color light is projected from said fluorescent plate when only said second emitter among said light source is turned on, and a third chromatic color light obtained by additive color mixing of said first and second chromatic color lights is projected from said fluorescent plate when both said first and second emitters are turned on.

18. The indicator device of claim 17, further comprising:

a luminance changing unit for changing luminances of said first and second emitters depending on whether either said first or second emitter is turned on or both said first and second emitters are turned on.

19. The indicator device of claim 1, further comprising:

a filter provided between said fluorescent plate and said indicating surface, for removing said light of said first wavelength through said fluorescent plate among lights projected from light-outgoing surface to substantially transmit only said light of said second wavelength towards said indicating surface.

20. An indicator device which makes an optical indication on a predetermined indicating surface by projecting a predetermined light from said indicating surface, comprising:

a light source for emitting a light of a first wavelength; and a wavelength changing member provided between said light source and said indicating surface and formed as one unit including a fluorescent material receiving said light of said first wavelength for emitting a light of a second wavelength longer than said first wavelength and a filter material for attenuating said light of said first wavelength, for projecting said light of said second wavelength emitted by said fluorescent material which receives said light of said first wavelength projected thereto towards said indicating surface and attenuating the rest of said light of said first wavelength which is projected thereto and not changed by said fluorescent material with said filter material not to be substantially transmitted.

21. The indicator device of claim 20, wherein said wavelength changing member includes:

a filter member including said filter material; and said fluorescent material mixed in said filter member.

22. The indicator device of claim 20, wherein said wavelength changing member includes:

a filter member including said filter material; and said fluorescent material coating a surface of said filter member on a side of said light source.

23. An indicator device which makes an optical indication on a predetermined indicating surface by projecting a predetermined light from said indicating surface, comprising:

a light source for emitting a light of a first wavelength; and a wavelength changing member constituted of a plurality of fluorescent plates which are layered for projecting part of an incident light and emitting lights of different wavelengths longer than said first wavelength from the rest of said incident light, having a light-incident surface receiving said light from said light source and a light-outgoing surface for projecting said light of said first wavelength and said lights emitted by said plurality of flourescent plates towards said indicating surface.

24. The indicator device of claim 23, wherein:

said light source has a first emitter for emitting said light of said first wavelength and a second emitter for emitting a light of another wavelength different from said first wavelength, and a color of a light projected from said light-outgoing surface is changeable by projecting said lights emitted from said first and second emitters to said light-incident surface of said wavelength changing member and changing the emitting condition of said first and second emitters.

25. The indicator device of claim 24, wherein said wavelength changing member substantially transmits said light of said another wavelength.

26. An illuminating device guiding a light from a light source to a predetermined light-projected surface to make an illumination entirely on said light-projected surface, comprising:

a sheet member made of a light-transmissible material, including a plurality of prism surfaces arranged two-dimensionally on a light-outgoing surface side from which a light is projected, said sheet member being provided between said light source and said light-projected surface with said light-outgoing surface side facing said light-projected surface, wherein said plurality of prism surfaces of said sheet member are provided by disposing a plurality of prisms of polypyramid on said light-outgoing surface side of said sheet member so that bottom surfaces of adjacent prisms are in intimate contact with each other without any clearance.

27. An indicator device using a light emitting diode element, comprising:

an emitter body including said light emitting diode element mounted two-dimensionally; and a first dome-shaped cap member including a predetermined fluorescent material and attached around said light emitting diode element in said emitter body.

28. The indicator device of claim 27, wherein a diffusion material is further mixed in said first dome-shaped cap member.

29. The indicator device of claim 27 wherein a second dome-shaped cap member including a diffusion material is attached around the perimeter of said first dome-shaped cap member.

30. The indicator device of claim 27, wherein a third dome-shaped cap member including a dye is attached around the perimeter of said first dome-shaped cap member.

31. The indicator device of claim 1, wherein said semiconductor light-emitting element emits a light of blue wavelength as said light of said first wavelength.

32. The illuminating device of claim 26, wherein:

said light source emits a light of a first wavelength, said illuminating device further comprising:

a flourescent plate provided between said sheet member and said light-projected surface for changing at least part of said light of said first wavelength projected thereto from said light source into a light of a second wavelength longer than said first wavelength and projecting said light of said second wavelength toward said light-projected surface.

* * * * *